US010766039B2

(12) United States Patent
Yuge et al.

(10) Patent No.: US 10,766,039 B2
(45) Date of Patent: Sep. 8, 2020

(54) ELECTROSTATIC PRECIPITATOR

(71) Applicant: SAMSUNG ELECTRONICS CO., LTD., Suwon-si (KR)

(72) Inventors: Seiro Yuge, Yokohama (JP); Daisuke Fukuoka, Yokohama (JP); Kazutoshi Takenoshita, Yokohama (JP); Yasuhiko Kochiyama, Yokohama (JP)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 427 days.

(21) Appl. No.: 15/538,881

(22) PCT Filed: Dec. 21, 2015

(86) PCT No.: PCT/KR2015/014012
§ 371 (c)(1),
(2) Date: Jun. 22, 2017

(87) PCT Pub. No.: WO2016/105045
PCT Pub. Date: Jun. 30, 2016

(65) Prior Publication Data

US 2017/0341087 A1 Nov. 30, 2017

(30) Foreign Application Priority Data

Dec. 22, 2014 (JP) ..... 2014-259429
Dec. 22, 2014 (JP) ..... 2014-259430
(Continued)

(51) Int. Cl.
*B03C 3/02* (2006.01)
*A47L 9/16* (2006.01)
*B03C 3/41* (2006.01)

(52) U.S. Cl.
CPC ..... *B03C 3/025* (2013.01); *A47L 9/1683* (2013.01); *B03C 3/41* (2013.01)

(58) Field of Classification Search
CPC combination set(s) only.
See application file for complete search history.

(56) References Cited

U.S. PATENT DOCUMENTS 4,689,056 A * 8/1987 Noguchi ..... B03C 3/12 96/79
5,137,552 A 8/1992 Sasaki
(Continued)

FOREIGN PATENT DOCUMENTS

CN 102049354 5/2011
CN 102218373 10/2011
(Continued)

OTHER PUBLICATIONS

Chinese Office Action dated Sep. 4, 2018 in Chinese Patent Application No. 201580069946.6.
(Continued)

*Primary Examiner* — Amber R Orlando
*Assistant Examiner* — Sonji Turner
(74) *Attorney, Agent, or Firm* — Staas & Halsey LLP

(57) ABSTRACT

Disclosed herein is provide an electrostatic precipitator capable of allowing a charger to be thin while suppressing ozone generation. The electrostatic precipitator 1 includes a charger 10 provided with a high voltage electrode 11 receiving a high voltage from a high voltage generating circuit 40 and a counter electrode 12 facing the high voltage electrode 11 and receiving a reference voltage from the high voltage generating circuit 40, and configured to charge suspended particles by generating a discharge between the high voltage electrode 11 and the counter electrode 12; and a dust collector 20 disposed in the downstream side of an air flow direction of the charger 10 and configured to collect the suspended particles charged by the charger 10.

19 Claims, 83 Drawing Sheets

(30) Foreign Application Priority Data

| | | |
|---|---|---|
| Dec. 22, 2014 | (JP) | 2014-259431 |
| Dec. 22, 2014 | (JP) | 2014-259432 |
| Jan. 27, 2015 | (JP) | 2015-013500 |
| Jul. 8, 2015 | (JP) | 2015-136771 |
| Nov. 27, 2015 | (JP) | 2015-232405 |
| Dec. 17, 2015 | (KR) | 10-2015-0180688 |

(56) References Cited

U.S. PATENT DOCUMENTS

| | | | | |
|---|---|---|---|---|
| 5,466,279 | A * | 11/1995 | Hattori | B03C 3/12 96/69 |
| 6,506,238 | B1 * | 1/2003 | Endo | B03C 3/12 96/79 |
| 7,942,952 | B2 * | 5/2011 | Gale | B03C 3/08 96/63 |
| 8,580,017 | B2 * | 11/2013 | Noh | B03C 3/08 96/69 |
| 8,597,415 | B2 * | 12/2013 | Noh | B03C 3/12 96/60 |
| 9,457,118 | B2 * | 10/2016 | Ota | B03C 3/09 |

FOREIGN PATENT DOCUMENTS

| | | | |
|---|---|---|---|
| JP | 2001-321692 | | 11/2001 |
| JP | 2001-321692 | A | 11/2001 |
| JP | 2006-281135 | | 10/2006 |
| JP | 2006-281135 | A | 10/2006 |
| JP | 2009-112938 | | 5/2009 |
| JP | 2009-112938 | A | 5/2009 |
| KR | 10-1996-0002436 | | 2/1996 |
| KR | 10-1996-0010566 | | 4/1996 |
| WO | WO 2016/105045 | A1 | 6/2016 |

OTHER PUBLICATIONS

Written Opinion; Form PCT/ISA/237; dated Apr. 11, 2016 in corresponding International Patent Application No. PCT/KR2015/014012 (9 pages).

International Search Report; Form PCT/ISA/210; dated Apr. 11, 2016 in corresponding International Patent Application No. PCT/KR2015/014012 (3 pages) (2 pages English Translation).

Chinese Office Action dated Apr. 28, 2019 in Chinese Patent Application No. 201580069946.6.

* cited by examiner

FIG. 5

| RESISTOR MATERIAL | VOLUME RESISTIVITY (Ω cm) | RELATIVE DIELECTRIC CONSTANT | DISTANCE G (mm) | OZONE GENERATION VOLTAGE (kV) | NUMBER OF ION AT OZONE GENERATION VOLTAGE (X $10^3/cm^3$) |
|---|---|---|---|---|---|
| NONE | - | - | 5 | 3.2 | 0 |
| ALKYD RESIN | $10^{12}$ | 5.1 | 5 | 4.0 | 1040 |
| ACRYLIC RESIN | $10^{14} \sim 10^{15}$ | 2.7~4.5 | 5 | 4.5 | 1400 |
| POLYIMIDE RESIN | $10^{16}$ | 3.3 | 5 | 6.0 | 1600 |
| POLYESTER RESIN | $10^{18}$ | 3.2 | 5 | NO OZONE GENERATION | NO ION GENERATION (NO CONDUCTOR EXPOSED) |
| | | | | | 2000 (CONDUCTOR EXPOSED 10kV) |
| PTFE | $> 10^{18}$ | 2 | 5 | NO ION GENERATION | |

FIG. 50

| | MASTER HIGH VOLTAGE ELECTRODE | | SLAVE HIGH VOLTAGE ELECTRODE | SUB COUNTER ELECTRODE | OZONE CONCENTRATION (ppb) | COLLECTION EFFICIENCY BY PARTICLE DIAMETER(%) | | | |
|---|---|---|---|---|---|---|---|---|---|
| | TYPE | CURRENT(μA) | | | | 20nm | 50nm | 100nm | 300nm |
| EXAMPLE 20 | TOOTH | 250 | WIRE (FLOATING VOLTAGE 1.8~2.5kV) | LAMINATE | 5.6 | 93 | > 99 | > 99 | 98 |
| | | 300 | | | 9.2 | 97 | > 99 | > 99 | > 99 |
| COMPARATIVE EXAMPLE 6 | TOOTH | 300 | - | LAMINATE | 22.9 | 76 | 83 | 86 | 85 |
| COMPARATIVE EXAMPLE 7 | WIRE | 440 | - | Al | 9.2 | 75 | 98 | > 99 | 97 |
| | | 3000 | | | 89 | 84 | > 99 | > 99 | > 99 |
| | | 5000 | | | 190 | 93 | > 99 | > 99 | > 99 |

FIG. 56

| | HIGH VOLTAGE ELECTRODE | | COUNTER ELECTRODE | OZONE CONCENTRATION (ppb) | COLLECTION EFFICIENCY BY PARTICLE DIAMETER(%) | | | |
|---|---|---|---|---|---|---|---|---|
| | TYPE | CURRENT(μA) | | | 20nm | 50nm | 100nm | 300nm |
| EXAMPLE 21 | TOOTH | 400 | Al | 3.0 | 90 | 99 | > 99 | > 99 |
| COMPARATIVE EXAMPLE 7 | WIRE | 440 | Al | 9.2 | 75 | 98 | > 99 | 97 |
| | | 5000 | | 190 | 93 | > 99 | > 99 | > 99 |

ELECTROSTATIC PRECIPITATOR

CROSS-REFERENCE TO RELATED APPLICATIONS

This application is a U.S. national stage application under 35 USC 371 of PCT International Patent Application No. PCT/KR2015/014012, filed on Dec. 21, 2015, which claims the benefit of Japanese Patent Application No. 2014-259429, filed on Dec. 22, 2014, Japanese Patent Application No. 2014-259430, filed on Dec. 22, 2014, Japanese Patent Application No. 2014-259431, filed on Dec. 22, 2014, Japanese Patent Application No. 2014-259432, filed on Dec. 22, 2014, Japanese Patent Application No. 2015-013500, filed on Jan. 27, 2015, Japanese Patent Application No. 2015-136771, filed on Jul. 8, 2015, Japanese Patent Application No. 2015-232405, filed on Nov. 27, 2015, and Korean Patent Application No. 10-2015-0180688, filed on Dec. 17, 2015, the contents of which are incorporated herein by reference.

TECHNICAL FIELD

Embodiments of the present disclosure relate to an electrostatic precipitator.

BACKGROUND ART

Electric products, such as air cleaners and air conditioners, are equipped with an electrostatic precipitator to charge suspended particles by using a discharge.

The electrostatic precipitator includes a charger charging suspended particles by discharging and a dust collector collecting charged suspended particles. As for the charger of the electrostatic precipitator, a high voltage of several kV is applied to generate a discharge between a high voltage (discharge) electrode and a counter (ground) electrode.

When a discharge current flowing between the high voltage electrode and the counter electrode becomes large to obtain the high dust-collection efficiency, ozone ($O_3$) may be easily generated according to the discharge. The ozone ($O_3$) has unique smell and thus when the ozone ($O_3$) is discharged to the indoor, it is needed that the ozone level is below the environmental standard (0.05 ppm).

Patent document 1 discloses a precipitator provided with an ion emitter emitting an ion without performing the corona discharge; and a dust collector formed in the downstream side thereof. The precipitator is configured such that a discharge electrode of the ion emitter is provided as a single or a plurality of linear electrodes and a ground electrode is formed on opposite sides of the linear electrodes, and an electrode connected to the ground is covered with an insulator or a semiconductor so that a discharge current is 1 μA or less than 1 μA a per 0.1 m linear electrode when a high voltage is applied to the linear electrode.

Patent document 2 discloses an electric dust collecting unit provided with an intake grill having a discharge needle to allow the high voltage to be applied thereto and having the center thereof expended to the front side, and a filter unit configured to ventilate, disposed in the downwind side of the discharge needle and to which a ground electron and a dust collecting filter are installed. The intake grill is formed such that non-conductive ribs formed of non-conductive resin and conductive ribs formed of conductive resin are arranged in a grid pattern and the conductive rib is connected to the ground electrode. Accordingly, the static electricity charged to the intake grill is discharged and thus dust is prevented from being attached to the intake grill.

Patent document 3 discloses a corona discharge device provided with a plurality of discharge members, a resistor connected to each of the discharge member, and a voltage source connected to the resistor.

Patent document 4 discloses an ion generator provided with a high voltage generator generating a high voltage and an ion generator having an ion generating electrode connected to an output of the high voltage generator to generate ions. The ion generator has an ozone generating electrode connected in parallel with the ion generating electrode in the output of the high voltage generator, and an impedance varying device connected in series with the ion generating electrode, and thus the ion generator is capable of controlling the amount of ozone generated in the ion generating electrode by changing the impedance of the impedance varying device.

Non-patent document 1 discloses that one side of an electrode is covered with a high resistance sheet of a few MO/cm instead of a dielectric. It is disclosed that a discharge occurs in a pulse shape that can be repeated with several 10 kHz in a width of a few μs, when operated by the direct current (DC).

RELATED ART DOCUMENT

Patent Document

Patent Document 1: International Publication No. WO01/064349

Patent Document 2: Japanese Patent Laid-Open Publication 2005-021817

Patent Document 3: Japanese Patent Laid-Open Publication No. 7-5746

Patent Document 4: Japanese Patent Laid-Open Publication No. 2004-216037

Non-Patent Document

Non-Patent Document 1: Mounir Laroussi, Igor Alexeff, Paul Richardson, Francis F. Dyer, [The Resistive Barrier Discharge], IEEE TRANSACTION ON PLASMA SCIENCE, February 2002, Vol. 30, No. 1, p. 158-159.

DISCLOSURE

Technical Problem

However, the miniaturization of the electrostatic precipitator is demanded in order to facilitate the assembly in various electrical products. It is difficult to make a dust collector thin while ensuring the desired dust collecting performance. Therefore, it is required to make a charger thinner.

When the charger is thin, a distance between a high voltage electrode and a counter electrode is reduced and thus there is the risk of increase in the ozone generation.

Since it is difficult to charge ultra-fine particles, e.g., PM 0.1 that is equal to or less than 0.1 μm and mass of the ultra-fine particle is small, it may be hard to efficiently collect the ultra-fine particle.

Therefore, it is an aspect of the present disclosure to provide an electrostatic precipitator capable of allowing a charger to be thin while suppressing ozone generation.

It is another aspect of the present disclosure to provide an electrostatic precipitator capable of efficiently collecting ultra-fine while suppressing ozone generation.

Technical Solution

In accordance with one aspect of the present disclosure, an electrostatic precipitator includes a charger and a dust collector. The charger is provided with a high voltage electrode receiving a high voltage from a high voltage generating circuit and having a portion generating an electric field concentration, and a counter electrode facing the high voltage electrode and receiving a reference voltage from the high voltage generating circuit, and the charger generates a discharge between the high voltage electrode and the counter electrode to charge suspended particles. The dust collector is disposed in the downstream side of an air flow direction of the charger to collect the suspended particles charged by the charger.

In accordance with another aspect of the present disclosure, an electrostatic precipitator includes a charger and a dust collector. The charger is provided with a high voltage electrode receiving a high voltage from a high voltage generating circuit and a counter electrode facing the high voltage electrode and receiving a reference voltage from the high voltage generating circuit. The charger generates a discharge between the high voltage electrode and the counter electrode to charge suspended particles. The dust collector is disposed in the downstream side of an air flow direction of the charger to collect the suspended particles charged by the charger. As for the charger, the counter electrode is provided with a conductor formed of a conductive material. The counter electrode is provided with a resistor covering at least one surface of the conductor facing the high voltage electrode, suppressing a discharge current between the high voltage electrode and the counter electrode and having a volume resistivity of $10^{14}$ Ω·cm or more and $10^{18}$ Ω·cm or less.

As for the charger, the resistor of the counter electrode may have a relative dielectric constant of 3 or more.

The high voltage electrode may have a wire shape.

The high voltage electrode may be provided with a tooth shaped portion having a pointed leading end, or a needle shaped portion having a pointed leading end.

A plurality of tooth shaped portions or a plurality of needle shaped portions may be across the air flow direction while being divided into a plurality of rows. In each of the plurality of rows, a leading end of the tooth shaped portion or a leading end of the needle shaped portion may be arranged to across each other between adjacent rows in a row direction. When a length of the tooth shaped portions or the needle shaped portions is L, a space (S) between leading ends of the tooth shaped portions or between leading ends of the needle shaped portions between the plurality of rows may be equal to or less than 3 L. In addition, a pitch (P) of the tooth shaped portions in each rows or a pitch of the tooth shaped portions in each rows may be equal to or more than 2 L.

Accordingly, it may be possible to allow the charger to be thinner in comparison with a case in which the tooth shaped portions or the needle shaped portions is disposed in parallel with the air flow direction or a case in which the high voltage electrode and the counter electrode are disposed perpendicular to the air flow direction.

A plurality of tooth shaped portions or a plurality of needle shaped portions may be across the air flow direction while being divided into a plurality of rows. In each of the plurality of rows, a leading end of the tooth shaped portion or a leading end of the needle shaped portion may be arranged to face each other between the row and an adjacent row. When a length of the tooth shaped portions or the needle shaped portions is L, a space (S) between leading ends of the tooth shaped portions or between leading ends of the needle shaped portions between the plurality of rows may be equal to or more than 6 L and equal to or less than 8 L. In addition, a pitch (P) of the tooth shaped portions in each rows or a pitch of the tooth shaped portions in each rows may be equal to or more than 2 L.

Accordingly, it may be possible to allow the charger to be thinner in comparison with a case in which the tooth shaped portions or the needle shaped portions is disposed in parallel with the air flow direction or a case in which the high voltage electrode and the counter electrode are disposed perpendicular to the air flow direction.

As for the charger, the high voltage electrode may have a brush shape.

The high voltage electrode may include a master high voltage electrode and a slave high voltage electrode.

As for the high voltage electrode, the master high voltage electrode may be provided with a tooth shaped portion or a needle shaped portion and the slave high voltage electrode may be provided as a wire shape.

As for the master high voltage electrode, a leading end of the tooth shaped portion or the needle shaped portion is directed to the upstream side of the air flow direction.

The slave high voltage electrode may be formed between the master high voltage electrode and the counter electrode.

A voltage of the master high voltage electrode may be set to have two times or more than and five times or less than a voltage of the slave high voltage electrode.

The master high voltage electrode may be set as a predetermined voltage and the slave high voltage electrode may be in a floating state to which a voltage is not set.

The conductor of the counter electrode may be formed with a plurality of flat plates disposed at an interval to secure the air flow.

The conductor of the counter electrode may be formed with a mesh having an opening to secure the air flow.

The conductor of the counter electrode may be formed with a punching metal having an opening to secure the air flow.

The conductor of the counter electrode may be formed with an expanded metal having an opening to secure the air flow.

The counter electrode may be disposed in the upstream side of the air flow direction with respect to the high voltage electrode of the charger.

In accordance with another aspect of the present disclosure, an electrostatic precipitator includes a charger and a dust collector. The charger is provided with a high voltage electrode receiving a high voltage from a high voltage generating circuit and a counter electrode facing the high voltage electrode and receiving a reference voltage from the high voltage generating circuit. The dust collector is disposed in the downstream side of the air flow direction. The dust collector is provided with other high voltage electrode receiving a high voltage from other high voltage generating circuit. The dust collector is provided with other counter electrode facing the other high voltage electrode and receiving a reference voltage from the other high voltage generating circuit. The dust collector collects the suspended particles charged by the charger. The other high voltage electrode of the dust collector is disposed from an end portion of a member, which is the closest to the dust collector among members forming the charger, by a distance of 5 mm or more in the downstream of the air flow direction.

In accordance with another aspect of the present disclosure, an electrostatic precipitator includes a charger and a dust collector. The charger is provided with a high voltage electrode receiving a high voltage from a high voltage generating circuit and a counter electrode facing the high voltage electrode and receiving a reference voltage from the high voltage generating circuit. The charger generates a discharge between the high voltage electrode and the counter electrode to charge suspended particles. The dust collector is disposed in the downstream side of the air flow direction of the charger to collect the suspended particles charged by the charger. A case formed of a resin material is provided to accommodate the charger. The high electrode of the charger is formed apart from the case by 5 mm or more.

The counter electrode may include a conductor formed of a conductive material, and a resistor covering a surface of the conductor facing the high voltage electrode. The case accommodating the charger may have an electrical contact electrified to the conductor of the counter electrode.

Accordingly, the discharge caused by the static electricity may be effectively suppressed in comparison with a case in which the counter electrode is not connected to the case in an exposed area.

The counter electrode may include a conductor formed of a conductive material, a resistor covering a surface of the conductor facing the high voltage electrode and an insulator disposed between the conductor and the resistor.

In accordance with another aspect of the present disclosure, an electrostatic precipitator includes a charger and a dust collector. The charger is provided with a high voltage electrode receiving a high voltage from a high voltage generating circuit and a counter electrode facing the high voltage electrode and receiving a reference voltage from the high voltage generating circuit. The charger includes a current limit circuit having an inductor and lowering a potential of the high voltage electrode by a pulse shaped current in a discharge generated between the high voltage electrode and the counter electrode. The charger charges suspended particles by generating the discharge between the high voltage electrode and the counter electrode. The dust collector is disposed in the downstream side of the air flow direction of the charger to collect the suspended particles charged by the charger It may be effectively suppress the increase in the ozone generation caused by the pulse-shaped current generated according to the emission of the secondary electron in comparison with a case in which the current limit circuit is not provided.

The current limit circuit may include a parallel circuit of the inductor and a diode.

The diode of the current limit circuit may be connected in a reverse direction about the high voltage.

The current limit circuit may further include a circuit provided with a junction FET and a resistance element connected to between a source and gate of the junction FET. The circuit having the junction FET and the resistance element connected to between a source and gate of the junction FET may be serially connected to the parallel circuit of the inductor and the diode.

A short circuit current between the high voltage electrode and the counter electrode may be suppressed in comparison with a case in which the circuit having the junction FET and the resistance element is not provided.

The current limit circuit may further include a serial circuit of MOSFET and a resistance element serially connected to the parallel circuit of the inductor and the diode.

A short circuit current between the high voltage electrode and the counter electrode may be suppressed in comparison with a case in which the serial circuit of the MOSFET and the resistance element is not provided.

The current limit circuit of the charger may be formed on a path from the high voltage generating circuit to the high voltage electrode.

The high voltage electrode of the charger may include a plurality of sub high voltage electrodes, wherein the current limit circuit may be provided in the sub high voltage electrode, respectively.

As for the charger, the sub high voltage electrode of the high voltage electrode may be provided a plurality of tooth shaped portions, wherein the current limit circuit may be provided in the tooth shaped portion, respectively.

It may be possible to prevent a decrease in collection efficiency in comparison with a case in which the current limit circuit is not provided in each sub high voltage electrode, respectively.

The current limit circuit of the charger may be formed on a path from the high voltage generating circuit to the counter electrode.

The counter electrode of the charger may include a plurality of sub counter electrodes, wherein the current limit circuit may be provided in each sub counter electrode, respectively.

In accordance with another aspect of the present disclosure, an electrostatic precipitator includes a charger and a dust collector. The charger is provided with a high voltage electrode receiving a high voltage from a high voltage generating circuit and a counter electrode facing the high voltage electrode and receiving a reference voltage from the high voltage generating circuit. The charger generates a discharge between the high voltage electrode and the counter electrode to charge suspended particles. The dust collector is disposed in the downstream side of the air flow direction of the charger to collect the suspended particles charged by the charger. The counter electrode includes a conductor formed of a conductive material, a first member covering a portion of the conductor in the side of the counter electrode, and a second member covering a portion of the first member in the side of the counter electrode. The counter electrode has a connection area in which the second member is electrically contacted to the conductor.

The high voltage electrode may include a master high voltage electrode and a slave high voltage electrode.

As for the high voltage electrode, the master high voltage electrode may be provided with a tooth shaped portion or a needle shaped portion and the slave high voltage electrode may be provided as a wire shape.

As for the master high voltage electrode, a leading end of the tooth shaped portion or the needle shaped portion is directed to the upstream side of the air flow direction.

The slave high voltage electrode may be formed between the master high voltage electrode and the counter electrode.

A voltage of the master high voltage electrode may be set to have two times or more than and five times or less than a voltage of the slave high voltage electrode.

The master high voltage electrode may be set as a predetermined voltage and the slave high voltage electrode may be in a floating state to which a voltage is not set.

The second member of the counter electrode may have a smaller volume resistivity than the first member.

When a voltage of 5 kV is applied between the high voltage electrode and the counter electrode, the second member may have a surface resistivity of 1 GΩ/cm or more.

The conductor of the counter electrode may be formed with a plurality of flat plates disposed at an interval to secure the air flow.

The conductor of the counter electrode may be formed with a mesh having an opening to secure the air flow.

The conductor of the counter electrode may be formed with a punching metal having an opening to secure the air flow.

The conductor of the counter electrode may be formed with an expanded metal formed of a conductive material and provided with an opening to secure the air flow.

A breakdown voltage between the high voltage electrode and the counter electrode may be higher than a case in which the first member is not provided.

In accordance with another aspect of the present disclosure, an electrostatic precipitator includes a charger and a dust collector. The charger is provided with a high voltage electrode receiving a high voltage from a high voltage generating circuit and a counter electrode facing the high voltage electrode and receiving a reference voltage from the high voltage generating circuit. The charger generates a discharge between the high voltage electrode and the counter electrode to charge suspended particles. The dust collector is disposed in the downstream side of the air flow direction of the charger to collect the suspended particles charged by the charger. The counter electrode includes a substrate forming a shape of the counter electrode, a first member formed in a surface of the substrate that does not face the high voltage electrode and a second member having the conductivity formed in a surface of the substrate that does not face the high voltage electrode.

In accordance with another aspect of the present disclosure, an electrostatic precipitator includes a charger and a dust collector. The charger is provided with a high voltage electrode receiving a high voltage from a high voltage generating circuit and a counter electrode facing the high voltage electrode and receiving a reference voltage from the high voltage generating circuit. The charger generates a discharge between the high voltage electrode and the counter electrode to charge suspended particles. The dust collector is disposed in the downstream side of the air flow direction of the charger to collect the suspended particles charged by the charger. The counter electrode includes a substrate forming a shape of the counter electrode, a first member formed in a surface of the substrate facing the high voltage electrode and a second member having the conductivity and covering a surface of the substrate that does not face the high voltage electrode.

In accordance with another aspect of the present disclosure, an electrostatic precipitator includes a charger and a dust collector. The charger is provided with a high voltage electrode receiving a high voltage from a high voltage generating circuit and a counter electrode facing the high voltage electrode and receiving a reference voltage from the high voltage generating circuit. The charger includes a current limit circuit having an inductor and lowering a potential of the high voltage electrode by a pulse shaped current in a discharge generated between the high voltage electrode and the counter electrode. The charger generates a discharge between the high voltage electrode and the counter electrode to charge suspended particles. The dust collector is disposed in the downstream side of the air flow direction. The dust collector is provided with other high voltage electrode receiving a high voltage from other high voltage generating circuit. The dust collector is provided with other counter electrode facing the other high voltage electrode and receiving a reference voltage from the other high voltage generating circuit. The dust collector collects the suspended particles charged by the charger. A case formed of a resin material is provided to accommodate the charger. The high voltage electrode is provided with a tooth shaped portion having a pointed leading end formed of a conductive material, or a needle shaped portion having a pointed leading end formed of a conductive material. The plurality of tooth shaped portions or the plurality of needle shaped portions is across the air flow direction while being divided into a plurality of rows. In each of the plurality of rows, the leading end of the tooth shaped portion or the leading end of the needle shaped portion is arranged to across each other between adjacent rows in a row direction. When a length of the tooth shaped portions or the needle shaped portions is L, a space (S) between leading ends of the tooth shaped portions or between leading ends of the needle shaped portions between the plurality of rows is equal to or less than 3 L. In addition, a pitch (P) of the tooth shaped portions in each rows or a pitch of the tooth shaped portions in each rows is equal to or more than 2 L. The high electrode of the charger is formed apart from the case by 5 mm or more. The counter electrode is provided with a conductor formed of a conductive material and a resistor covering at least one surface of the conductor facing the high voltage electrode, suppressing a discharge current between the high voltage electrode and the counter electrode and having a volume resistivity of $10^{14}$ Ω·cm or more and $10^{18}$ Ω·cm or less. The other high voltage electrode of the dust collector is disposed from an end portion of a member, which is the closest to the dust collector among members forming the charger, by a distance of 5 mm or more in the downstream of the air flow direction.

In accordance with another aspect of the present disclosure, an electrostatic precipitator includes a charger and a dust collector. The charger is provided with a high voltage electrode receiving a high voltage from a high voltage generating circuit and a counter electrode facing the high voltage electrode and receiving a reference voltage from the high voltage generating circuit. The charger generates a discharge between the high voltage electrode and the counter electrode to charge suspended particles. The dust collector is disposed in the downstream side of the air flow direction to collect the suspended particles charged by the charger. The high voltage electrode includes a tooth shaped portion or a needle shaped portion and the counter electrode includes a sub counter electrode formed of a conductive material and formed in a plate shape. The plurality of tooth shaped portions or the plurality of needle shaped portions and the sub counter electrode are across the air flow direction. The plurality of tooth shaped portions or the plurality of needle shaped portions of the high voltage is disposed in parallel with the surface of the sub counter electrode formed in the plate shape.

As for the charger, the leading end of the tooth shaped portion or the needle shaped portion of the high voltage electrode may be directed to the upstream side of the air flow direction and disposed in the downstream side than the upstream end of the air flow direction of the sub counter electrode in the plate shape.

The sub counter electrode may be disposed in the downstream side of the air flow direction from the leading end of the tooth shaped portion or the needle shaped portion of the high voltage electrode, and disposed along at least a length of the tooth shaped portion or the needle shaped portion.

The high voltage electrode of the dust collector may be disposed from an end portion of a member, which is the closest to the dust collector among members forming the charger, by a distance of 5 mm or more in the downstream of the air flow direction.

The charger may include a current limit circuit having an inductor and lowering a potential of the high voltage electrode by a pulse shaped current in a discharge generated between the high voltage electrode and the counter electrode.

Advantageous Effects

In accordance with one aspect of the present disclosure, it may be possible to thin the charger while suppressing ozone generation.

It may be possible to efficiently collect ultra-fine particle while suppressing ozone generation.

DESCRIPTION OF DRAWINGS

These and/or other aspects of the present disclosure will become apparent and more readily appreciated from the following description of the embodiments, taken in conjunction with the accompanying drawings of which:

FIG. 2A is a top plan view of the high voltage electrode and FIG. 2B is a top plan view of the counter electrode;

FIG. 3A illustrates the charger of the electrostatic precipitator to which the first embodiment is applied, and FIG. 3B illustrates a charger of an electrostatic precipitator according to a comparative example to which the first embodiment is not applied;

FIG. 5 is a table illustrating the relationship among a material forming the resistor (sub material for the resistor) of the counter electrode, ozone generation voltage (kV) and the number of ion ($\times 10^3/cm^3$) in the ozone generation voltage (kV);

FIG. 7A is a top plan view of the high voltage electrode and FIG. 7B is a top plan view of the counter electrode;

FIG. 10A is a top plan view of the high voltage electrode and FIG. 10B is a top plan view of the counter electrode;

FIG. 12A is a perspective view of the charger, FIG. 12B is a view of the charger viewed from the side of the counter electrode, and FIG. 12C is a cross-sectional view taken along line XIIC-XIIC of the counter electrode;

FIG. 13A is a perspective view of the charger, and FIG. 13B is a cross-sectional view taken along line XIIIB-XIIIB of FIG. 13A;

FIG. 14A is a top plan view of the high voltage electrode and FIG. 14B is a top plan view of the counter electrode;

FIG. 15A is a view illustrating a case in which the tooth is arranged differently from the arrangement of FIG. 2A, and FIG. 15B is a view illustrating a case in which the tooth is arranged differently from the arrangement of FIG. 10A;

FIG. 16A is a view illustrating a case in which the high voltage electrode is configured with a plurality of needle rows having a plurality of needles and leading ends of the needles faces each other between adjacent needle rows, and FIG. 16B is a view illustrating a case in which the high voltage electrode is configured with a plurality of needle rows having a plurality of needles and a leading end of the needle is arranged in a zigzag pattern between adjacent needle rows;

FIG. 21A is a top plane view viewed from the high voltage electrode, and FIG. 21B is a cross-sectional view taken along line XXIB-XXIB of FIG. 21A;

FIG. 28A illustrates the charger of the electrostatic precipitator according to the example 7, and FIG. 28B illustrates the charger of the electrostatic precipitator according to the comparative example 3;

FIG. 36A illustrates that a connection order of a secondary electron current limit section and a short current limit section in the current limit circuit of FIG. 32 is switched, FIG. 36B illustrates that the current limit circuit is connected to the counter electrode, and FIG. 36C illustrates that the high voltage electrode and the counter electrode are formed between the secondary electron current limit section and the short current limit section in the current limit circuit;

FIG. 38A is related to the example 11 and FIG. 38B is related to the comparative example 4;

FIG. 39A is a perspective view of the charger and FIG. 39B is a cross-sectional view taken along line XXXIXB-XXXIXB of the counter electrode;

FIG. 40A is a perspective view of the charger and FIG. 40B is a cross-sectional view illustrating a portion of the counter electrode;

FIG. 42A is a perspective view of the charger and FIG. 42B is a cross-sectional view taken along line XLIIB-XLIIB of FIG. 42A;

FIG. 44A is a perspective view of the charger and FIG. 44B is a cross-sectional view illustrating a portion of the counter electrode;

FIG. 45A is a perspective view of the charger and FIG. 45B is a cross-sectional view taken along line XLVB-XLVB of the counter electrode 12 of FIG. 45A;

FIG. 46A is a perspective view of the charger and FIG. 46B is a cross-sectional view taken along line XLVIB-XLVIB of the counter electrode of FIG. 46A;

FIG. 49A illustrates the example 20, FIG. 49B illustrates the comparative example 6, and FIG. 49C illustrates the comparative example 7;

FIG. 50 is a table illustrating ozone concentration and collection efficiency by a particle diameter according to the example 20, and the comparative examples 6 and 7;

FIG. 55A illustrates the example 21 and FIG. 55B illustrates the comparative example 7; and FIG. 56 is a table illustrating ozone concentration and collection efficiency by the particle diameter in the electrostatic precipitator according to the example 21 and the comparative example 7.

BEST MODE

Hereinafter, embodiments of the present disclosure will be described in detail with reference to the accompanying drawings.

A First Embodiment

Figure 1:
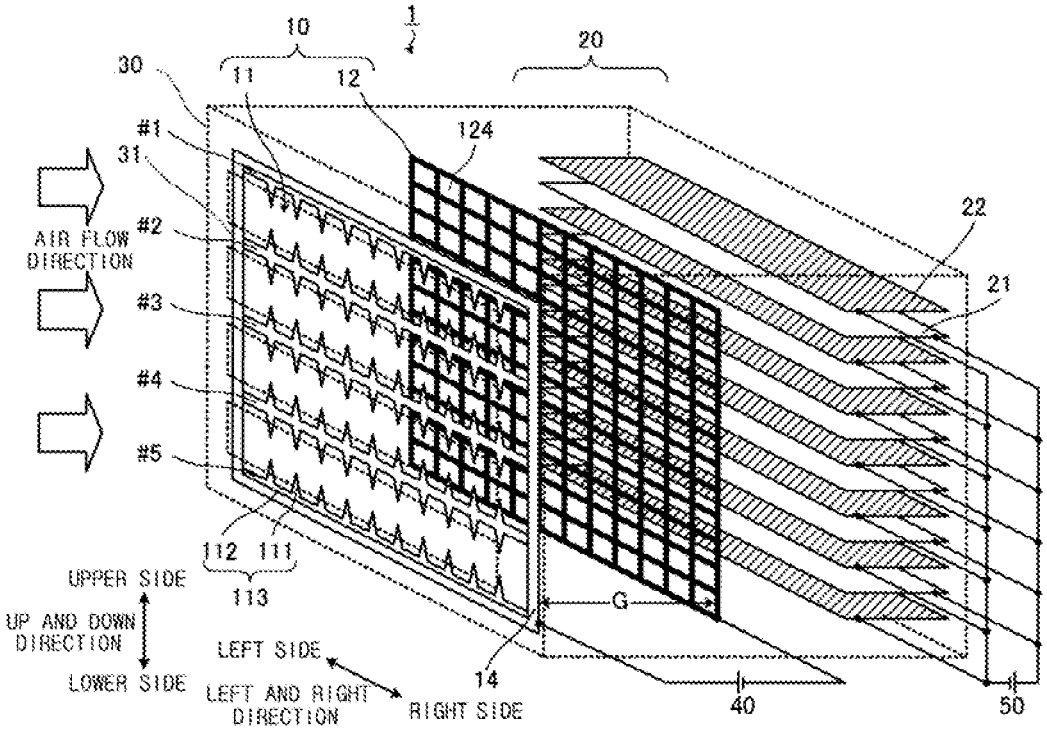
FIG. 1 is a view illustrating an example of an electrostatic precipitator in accordance with a first embodiment of the present disclosure.

FIG. 1 is a view illustrating an example of an electrostatic precipitator 1 in accordance with a first embodiment of the present disclosure. A case 30 is illustrated with a broken line, and a charger 10 and a dust collector 20 provided in the case 30 are shown.

The electrostatic precipitator 1 may include the charger 10, the dust collector 20 and the case 30 accommodating the charger 10 and the dust collector 20. The electrostatic precipitator 1 may be a two-layer type electrostatic precipitator in which the charger 10 and the dust collector 20 are separated from each other.

A direction of air flow (ventilation) is set in a direction from the charger 10 to the dust collector 20 (from the left side to the right side of FIG. 1). The ventilation is performed by a fan (not shown) disposed in the downstream side of the air flow direction of the dust collector 20.

For convenience of description, the up and down direction in the drawings are indicated by the upper side and the lower side, and the left and right direction which are perpendicular to the upper and lower direction are indicated by the left side and the right side, as illustrated in FIG. 1.

Unless the ventilation is interrupted, the electrostatic precipitator 1 may be arranged in any direction.

(Charger 10)

The charger 10 may be provided with a high voltage electrode 11 and a counter electrode 12 facing the high voltage electrode 11. The high voltage electrode 11 represents an electrode to which a high voltage is applied and thus is referred to as "high-voltage electrode". The high voltage electrode 11 is an electrode generating a discharge and thus referred to as "discharge electrode". Since there is a case in which the counter electrode 12 is grounded (GND), the counter electrode 12 is referred to as "ground electrode".

Since a high voltage DC is applied between the high voltage electrode 11 and the counter electrode 12, the corona discharge (discharge) may occur between the high voltage electrode 11 and the counter electrode 12. By the generated corona discharge, suspended particles may be charged.

For example, the high voltage electrode 11 is provided with a plurality of tooth rows 113 (five rows from #1~#5 in FIG. 1) in which a plurality of tooth shaped portion having a pointed leading end 111 (hereinafter referred to as "tooth" 111) is arranged. A longitudinal direction of the respective tooth row 113 is toward the right and left direction. In FIG. 1, in the up and down direction, the tooth row 113 in the most upper side (#1 in FIG. 1) is provided with the plurality of teeth 111 (10 teeth in FIG. 1) arranged toward the lower side. In the up and down direction, the tooth row 113 in the most lower side (#5 in FIG. 1) is provided with the plurality of teeth 111 (10 teeth in FIG. 1) arranged toward the upper side. The tooth row 113 (#2 to #4 in FIG. 1) is provided with the plurality of teeth 111 (10 teeth in FIG. 1) arranged toward the lower side and the plurality of teeth 111 (10 teeth in FIG. 1) arranged toward the upper side.

Meanwhile, the teeth 111 and/or a leading end thereof is one example of a portion generating the electric field concentration.

The number of the tooth row 113 and the number of the tooth 111 in the tooth row 113 is set as a predetermined number.

The plurality of the teeth 111 in the tooth row 113 may be connected to a connecting portion 112. An end portion of each the connecting portion 112 is fixed by a supporting portion 14 formed of an insulating material. The supporting portion 14 is provided with a circuit board (printed circuit board: PCB) having wirings. Through the wiring in the circuit board, the tooth row 113 may be connected to an anode of a high voltage generating circuit 40 configured to supply a high voltage DC.

The supporting portion 14 may be a part of the case 30.

Each tooth 111 is formed in a direction perpendicular to the air flow direction. Each tooth 111 is formed such that a leading end of the tooth 111 is arranged to face each other between the tooth row 113 and other tooth row 113 adjacent to the tooth row 113, i.e., between the tooth row 113 (#1) and the tooth row 113 (#2).

Each tooth 111 may be formed in an oblique direction with respect to the air flow direction. That is, the tooth 111 may be formed in a cross direction with respect to the air flow direction.

The tooth 111 and the connecting portion 112 of the high voltage electrode 11 may be integrally formed of a conductive material. Meanwhile, the supporting portion 14 is not a separate member, and the supporting portion 14 may be integrally formed with the tooth 111 and the connecting portion 112 and formed of a conductive material.

To secure the air flow, the counter electrode 12 may be provided with a member formed of a conductive material having a through-opening (hole) 124, and a member (resistor) configured to cover of the conductive material and formed of a resistant material functioning as a resistance against the current (refer to a conductor 121 and a resistor 122 in FIG. 2). The counter electrode 12 may be connected to a cathode of the high voltage generating circuit 40.

The member formed of the resistant material may suppress the discharge current and the ozone generation. Therefore, characteristics, e.g., the volume resistivity of the member formed of the resistant material may be set in consideration of the relationship between the collection efficiency and the ozone concentration.

In FIG. 1, the counter electrode 12 is illustrated as a wire mesh in which the conductor 121 is formed of the conductive material. FIG. 1 illustrates that the mesh structure (the opening 124) is markedly enlarged, which is the same as in FIG. 2B described later. A size of the mesh structure (the opening 124) may be set in consideration of the discharge generated between the high voltage electrodes 11.

A distance between the high-voltage electrode 11 and the counter electrode 12 is G.

(Dust Collector 20)

The dust collector 20 may be provided with a high voltage electrode 21 formed in a flat plate shape and provided with a surface coated with a film formed of an insulating material; and a counter electrode 22 formed in a flat plate shape, wherein the high voltage electrode 21 and the counter electrode 22 are alternately stacked. A space between the high voltage electrode 21 and the counter electrode 22 becomes the air flow direction. Meanwhile, since the counter electrode 22 is grounded (GND), the counter electrode 22 may be referred to as "ground electrode".

By the high voltage generating circuit 50, a high voltage of direct current (DC) is applied between the high voltage electrode 21 and the counter electrode 22. The suspended particles charged in the charger 10 are attached to the surface of the counter electrode 22 by the static electricity. Thus, the suspended particles are collected.

The film formed of the insulating material covering the surface of the high-voltage electrode 21 may include polyethylene, polyethylene terephthalate (PET) and polytetrafluoroethylene (PTFE).

The dust collector 20 may be formed in the downstream side of the airflow direction of the charger 10. Between the high voltage electrode 21 and the counter electrode 22 of the dust collector 20, the closest electrode to the charger 10 may be disposed apart from an end portion of a member that is the closest to the dust collector 20 in the member forming the charger 10, by a predetermined distance in the downstream of the air flow direction. This relationship is the same in other embodiments described below. At this time, the predetermined distance may be equal to or greater than 5 mm.

(Case 30)

The case 30 may accommodate the charger 10 and the dust collector 20. A plurality of grids (grilles) 31 may be formed on the front surface portion facing the charger 10. Meanwhile, the grid 31 may be configured to prevent a user from contacting the charger 10 while allowing the resistance against the air flow to be small.

For example, the case 30 may be formed of resin material, e.g., acrylonitrile, butadiene, and styrene copolymer (ABS).

Figure 2A:
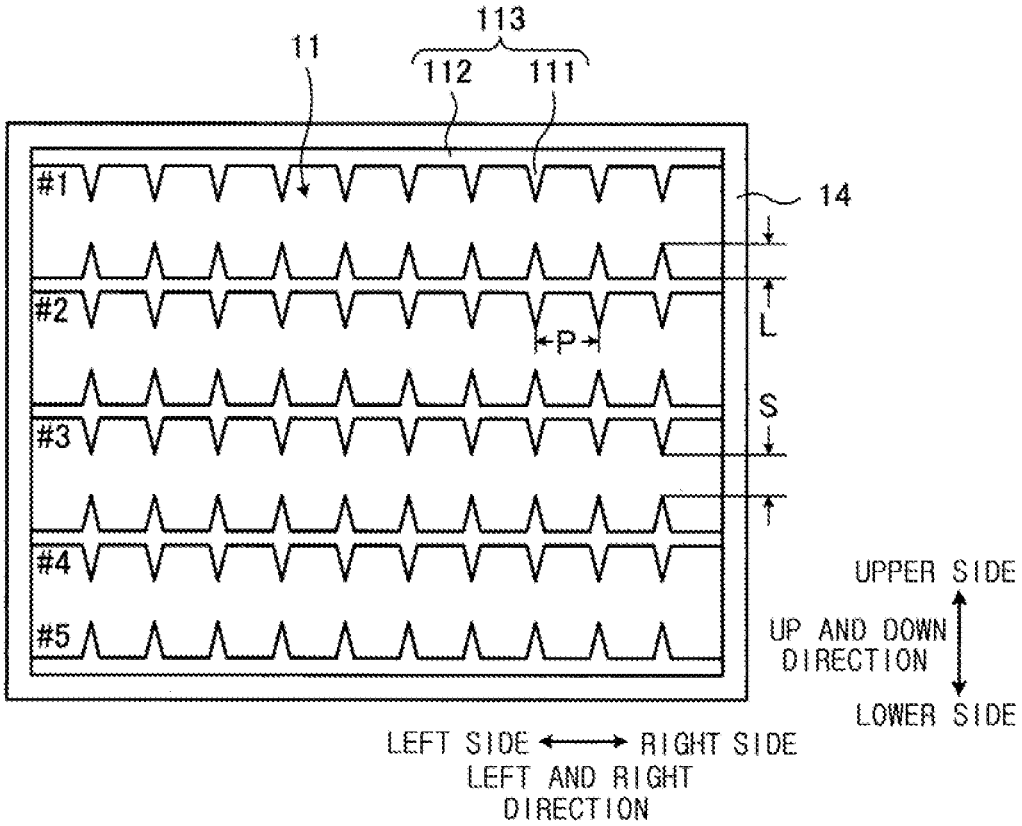
FIGS. 2A and 2B are top plan views of a high voltage electrode and a counter electrode of a charger, particularly
Figure 2B:
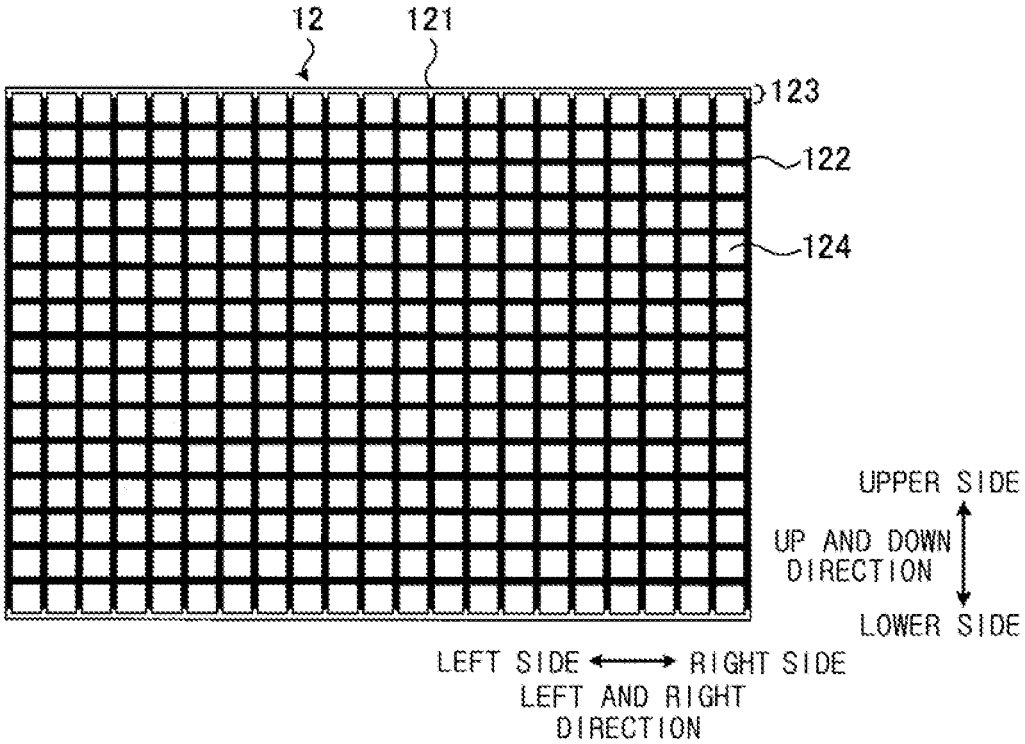

FIGS. 2A and 2B are top plan views of the high voltage electrode 11 and the counter electrode 12 of the charger 10. FIG. 2A is a top plan view of the high voltage electrode 11 and FIG. 2B is a top plan view of the counter electrode 12.

As illustrated in FIG. 2A, the high voltage electrode 11 is provided with the plurality of tooth rows 113 (#1 to #5 in FIG. 2) in which a plurality of the teeth 111 is arranged. The tooth 111 is formed such that a leading end of the tooth 111 is arranged to be opposite to each other (to face each other) between the tooth row 113 and the other tooth row 113 adjacent to the tooth row 113.

A distance from the leading end of the tooth 111 to the connecting portion 112 is L (length: L), and a distance between the tooth 111 in the tooth row 113 is P (pitch: P). Between the tooth row 113 and the other tooth row 113 adjacent to the tooth row 113, a distance between the leading end of the tooth 111 in the direction perpendicular to the tooth row is S (space; S).

As illustrated in FIG. 2B, the counter electrode 12 may be provided with the conductor 121 corresponding to a wire mesh formed of a conductive material, and the resistor 122 configured to cover a surface of the conductor. An end portion of the upper and lower sides is configured with a conductor exposed area 123 in which the surface of the conductor 121 is exposed. The conductor exposed area 123 in which the surface of the conductor 121 is exposed may be formed in an end portion of the left and right sides.

Alternatively, the conductor exposed area 123 in which the surface of the conductor 121 is exposed may be formed in an end portion of a part of the counter electrode 12.

It is allowed that the conductor exposed area 123 is formed by removing the resistor 122 or by not forming the resistor 122 (e.g., not applying)

Forming the resistor 122 in the counter electrode 12 is to suppress the discharge current and the ozone generation. Therefore, as described later, the member forming the resistor 122 may have a relative dielectric constant of 3 or more, a volume resistivity of $10^{14}$ Ω·cm or more and $10^{18}$ Ω·cm or less. A resistance value in the thickness direction may change in accordance with the thickness of the resistor 122. Accordingly, a value of the discharge current may be set according to the thickness of the resistor 122.

When the volume resistivity is $10^{14}$ Ω·cm, it may represent that the volume resistivity is around $10^{14}$ Ω·cm. It may be applied to other value of the volume resistivity.

Figure 3A:
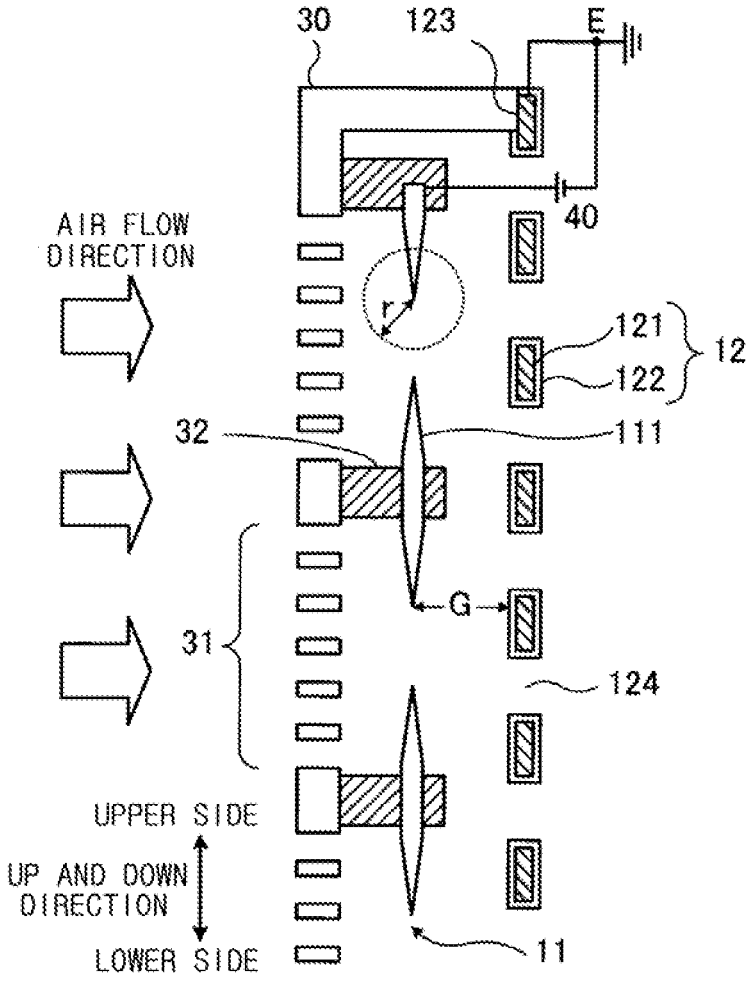
FIGS. 3A and 3B are cross-sectional views of the charger in detail, particularly.
Figure 3B:
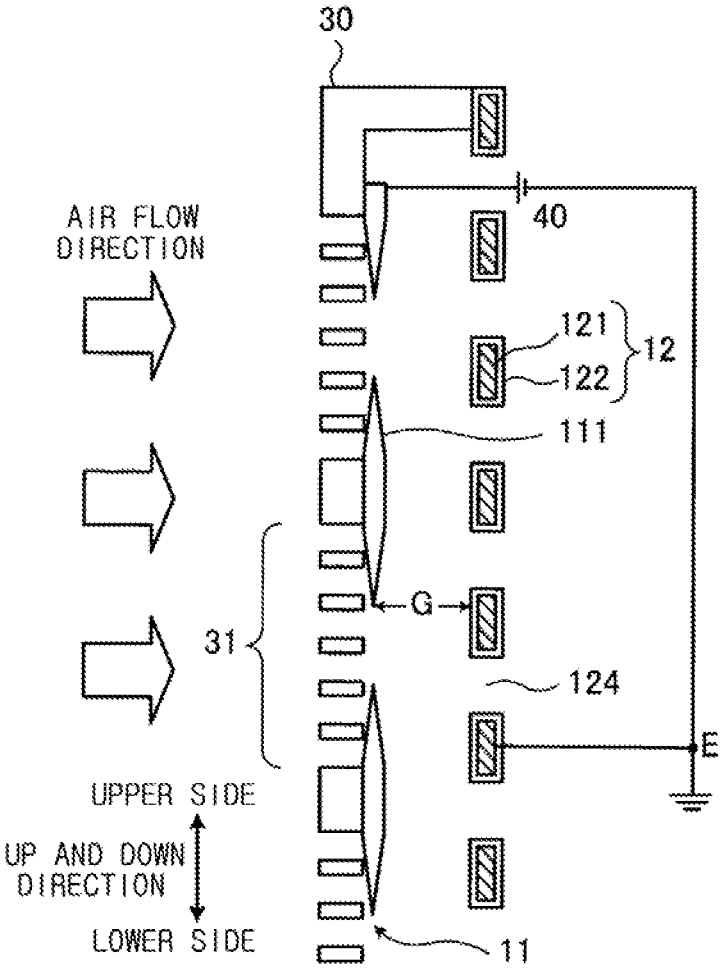

FIGS. 3A and 3B are cross-sectional views of the charger 10 in detail. FIG. 3A illustrates the charger 10 of the electrostatic precipitator 1 to which the first embodiment is applied, and FIG. 3B illustrates the charger 10 of the electrostatic precipitator 1 to which the first embodiment is not applied.

The high voltage electrode 11 is provided with the plurality of the teeth 111. In FIGS. 3A and 3B, it is illustrated that each of the tooth 111 is not electrically connected to each other. However, as illustrated in FIGS. 1, 2A and 2B, the high voltage electrode 11 is electrically connected.

The counter electrode 12 is provided with the conductor 121 and the resistor 122 configured to cover a surface of the conductor 121. In FIGS. 3A and 3B, it is illustrated that each of the tooth 111 is not electrically connected to each other. However, as illustrated in FIGS. 1, 2A and 2B, since the conductor 121 is a wire mesh (mesh) formed of a conductive material, the conductor 121 may be electrically connected to each other.

In the charger 10 of the electrostatic precipitator 1 to which the first embodiment is applied, as illustrated in FIG. 3A, the high voltage electrode 11 is attached to the case 30 via an insulating spacer 32 formed of an insulating member (insulator). Accordingly, the high voltage electrode 11 is not in direct contact with the case 30. It is allowed that the supporting portion 14 is the insulating spacer 32 or alternatively, the supporting portion 14 is attached to the case 30 via the insulating spacer 32.

The insulating spacer 32 may be formed of a material having high insulating properties or formed of ceramics, resin materials and air.

The insulating spacer 32 is an example of the insulating member.

The counter electrode 12 is attached to the case 30 such that the conductor exposed area 123 in which the conductor 121 is exposed is electrically connected to the case 30. The conductor exposed area 123 may be connected to the ground terminal (E). Meanwhile, the ground terminal (E) may be not grounded.

The member (resin member) formed of resin material, e.g., the case 30, is not formed within a predetermined distance (r) of the leading end of the tooth 111. The resin member is not limited to the member forming the case 30, and thus the resin member includes a member formed in the case 30.

As for a charger 10 of an electrostatic precipitator 1 in a comparative example 1, as illustrated in FIG. 3B, an end portion of a counter electrode 12 does not expose the conductor 121. That is, the electrostatic precipitator 1 in the comparative example 1, the counter electrode 12 is not provided with the conductor exposed area 123.

The high voltage electrode 11 is attached to the case 30 such that the high voltage electrode 11 directly makes contact with the case 30.

The counter electrode 12 is attached to the case 30 so that the counter electrode 12 is connected to the case 30 via the resistor 122. The counter electrode 12 is connected to the ground terminal (E) in a portion other than a portion connected to the case 30. The ground terminal (E) may be not grounded.

An Example 1

A result of measuring the collection efficiency and the ozone concentration of the electrostatic precipitator 1 to which the first embodiment is applied (the electrostatic precipitator 1 in the example 1) and the electrostatic precipitator 1 to which the first embodiment is not applied (the electrostatic precipitator 1 in the comparative example 1) will be described.

The charger 10 of the electrostatic precipitator 1 in the example 1 and the charger 10 of the electrostatic precipitator 1 in the comparative example 1 are different from each other as illustrated in FIG. 3. However, other components are the same except that.

As for the charger 10 of the electrostatic precipitator 1, the size of the supporting portion 14 of the high voltage electrode 11 has about 400 mm in the left and right direction and about 300 mm in the up and down direction with respect to the air flow direction. A grid 31 may be disposed on the surface of the case 30 so that a plurality of openings of 40 mm×125 mm is formed therein.

In the charger 10, the tooth 111 and the connecting portion 112 of the high voltage electrode 11 is formed by a plate-shaped stainless steel (SUS) having a thickness of 0.5 mm. As for the tooth 111, a distance from a leading end thereof to the connecting portion 112 is about 10 mm. A space (S) between the leading ends of the tooth 111 between the tooth row 113 is set as about 30 mm.

In the charger 10, the counter electrode 12 has the conductor 121 formed by a wire mesh (mesh) formed of SUS having opening ratio of 87.1%. The resistor 122 covering the surface of the conductor 121 is formed of polyimide resin having a thickness of about 50 μm. The polyimide resin has a relative dielectric constant of 3.3 and a volume resistivity of $10^{16}$ Ω·cm.

A distance (G) between the high voltage electrode 11 and the counter electrode 12 is about 5 mm.

The corona discharge is generated by applying a DC voltage of about 4 kV between the high voltage electrode 11 and the counter electrode.

As for the dust collector 20, the high voltage electrode 21 and the counter electrode 22 allow a width of the air flow direction to be about 20 mm and a distance perpendicular to the air flow direction to be about 400 mm. A distance between the high voltage electrode 21 and the counter electrode 22 is about 1.5 mm. A DC voltage of about 6 kV is applied to between the high voltage electrode 21 and the counter electrode 22.

As for the electrostatic precipitator 1 in the example 1, the resin member forming the case 30 is not formed within about 5 mm (radius; r) of the leading end of the tooth 111.

Figure 4:
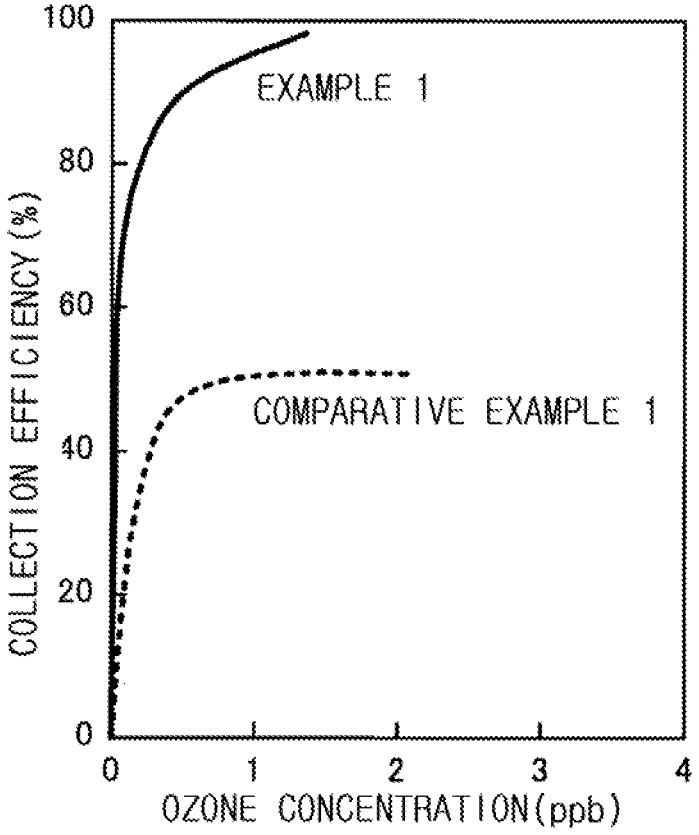
FIG. 4 is a graph illustrating the collection efficiency and the ozone concentration of the electrostatic precipitator according to an example 1 and the electrostatic precipitator according to the comparative example 1.

FIG. 4 is a graph illustrating the collection efficiency and the ozone concentration of the electrostatic precipitator 1 according to the example 1 and the electrostatic precipitator 1 according to the comparative example 1. A wind speed of the air flow direction is 1 m/s.

The ozone concentration is obtained an amount of ozone measured by an ozone concentration meter, and an amount of air blowing into the ozone concentration meter. The collection efficiency is obtained by using a particle counter, wherein the particle counter counts the number of suspended particles in the upstream of the air flow direction (before entering the electrostatic precipitator 1) and the downstream of the air flow direction (after discharging from the electrostatic precipitator 1).

As illustrated in FIG. 4, when operating the electrostatic precipitator 1 in the example 1 in a state of acquiring almost 100% collection efficiency, the ozone concentration is equal to or less than 2.0 ppb. The value is significantly below the environmental standard (0.05 ppm).

Meanwhile, as for the electrostatic precipitator 1 in the comparative example 1, the collection efficiency is saturated to about 50%. Although the collection efficiency is about 50%, the ozone concentration is greater than that of the electrostatic precipitator 1 in the example 1. However, the electrostatic precipitator 1 in the comparative example 1, the maximum of the ozone concentration is 2.0 ppb, which is below the environmental standard (0.05 ppm).

As for the electrostatic precipitator 1 in the example 1 and the electrostatic precipitator 1 in the comparative example 1, the ozone concentration is set to be lower than the environmental standard. It is assumed that because that the counter electrode 12 of the charger 10 is provided with the resistor 122 covering the surface of the conductor 121 and thus the discharge current is prevented.

However, the electrostatic precipitator 1 in the example 1 and the electrostatic precipitator 1 in the comparative example 1, the collection efficiency are different from each other. It is assumed that because that the case 30 of the electrostatic precipitator 1 in the comparative example 1 is easily charged by the static electricity in comparison with the electrostatic precipitator 1 in the example.

As for the electrostatic precipitator 1 in the comparative example, the high voltage electrode 11 directly makes contact with the case 30. Due to the resin material forming the case 30, the high voltage DC supplied from the high voltage generating circuit 40 is insulated and thus the case 30 is not connected to the ground terminal (E).

It is difficult to flow the electricity in the case 30, since the case 30 formed of the resin material has a high electrical resistivity. Therefore, the surface of the case 30 is easily charged into the static electricity. Since the case 30 is not connected to the ground electrode, the charged static electricity may not be discharged. That is, by charging of the case 30, more particularly by charging of the case 30 adjacent to the high voltage electrode 11, the charging efficiency and the collection efficiency of the suspended particles are reduced.

Meanwhile, in the electrostatic precipitator 1 in the example 1, the high voltage electrode 11 is attached to the case 30 through the insulating spacer 32. Accordingly, the high voltage electrode 11 and the case 30 are not electrically connected to each other. Since the case 30 is connected to the counter electrode 12, the charged static electricity may be discharged. The resin member forming the case 30 is not formed within a predetermined distance (r) (5 mm in the example 1) from the leading end of the tooth 111.

Therefore, since it is prevented that the case 30 is charged into the static electricity, it becomes difficult to suppress the charging of the suspended particles and the collection efficiency is increased.

As mentioned above, as for the electrostatic precipitator 1 to which the first embodiment is applied, the counter electrode 12 of the charger 10 is configured with the conductor 121 and the resistor 122 covering the surface of the conductor 121. Accordingly, the discharge current is suppressed to be smaller than that in the case where the resistor 122 is not formed and thus the ozone concentration also is suppressed to be low.

The high voltage electrode 11 of the charger 10 is fixed to the case 30 using the insulating spacer 32. The resin member forming the case 30 is not formed within a range of a predetermined distance (r) from the leading end of the tooth 111. In the counter electrode 12, the conductor exposed area 123 is electrically connected to the case 30 to be electrified. Accordingly, it is prevented that the case 30 is charged into the static electricity and thus the collection efficiency is improved.

The high voltage electrode 11 of the charger 10 is disposed such that the leading end of the tooth 111 faces to each other between the tooth rows 113, and thus an area in which the discharge is generated becomes wide in comparison with a case in which the tooth 111 in one side (e.g., the lower side) is not used.

As for the charger 10 of the electrostatic precipitator 1 to which the first embodiment is applied, the high voltage electrode 11 and the counter electrode 12 are disposed in the air flow direction. A portion configured to generate the discharge of the high voltage electrode 11 corresponds to the tooth 111, and the tooth 111 is disposed perpendicular to the air flow direction or diagonally disposed with respect to the air flow direction. Therefore, the distance (G) between the high voltage electrode 11 and the counter electrode 12 may be set to be short, e.g., about 5 mm. Accordingly, it may be possible to downsize the electrostatic precipitator 1.

In comparison with the electrostatic precipitator 1 to which the first embodiment is applied, in a state in which the resistor 122 configured to cover the surface of the conductor 121 of the counter electrode 12 is not provided, as the distance between the high voltage electrode 11 and the counter electrode 12 is reduced, the discharge current is increased and thus the ozone generation is increased.

An Example 2

As described above, the counter electrode 12 is provided with the conductor 121 and the resistor 122 covering the surface of the conductor 121.

In the example 2, it will be described with respect to a material for the resistor 122 covering the surface of the counter electrode 12.

FIG. 5 is a table illustrating the relationship among a material forming the resistor 122 (sub material for the resistor) of the counter electrode 12, ozone generation voltage (kV) and the number of ion ($\times 10^3/cm^3$) in the ozone generation voltage (kV). In FIG. 5, a volume resistivity (Ω·cm) and a relative dielectric constant represent the properties of the material (sub material for the resistor). In addition, in FIG. 5, a distance (G) mm represents a distance between the high voltage electrode 11 and the counter electrode 12, wherein the distance (G) between the high voltage electrode 11 and the counter electrode 12 is set as 5 mm.

The ozone generation voltage represents a voltage at a point in which ozone generation is detected by the ozone concentration meter when a DC voltage applied between the high voltage electrode 11 and the counter electrode 12 is gradually increased.

The number of ion at the ozone generation voltage represents the number of ion ($\times 10^3/cm^3$) between the high voltage electrode 11 and the counter electrode 12 when the ozone generation voltage is applied between the high voltage electrode 11 and the counter electrode 12. The number of ion is measured by the ion counter.

As for the electrostatic precipitator 1, it is appropriate that the ozone generation voltage is high and the number of ion generated at the ozone generation voltage is large.

The electrostatic precipitator 1 illustrated in FIG. 1 is used in this test, except for the material forming the resistor 122 of the counter electrode 12. The high voltage electrode 11 of the charger 10 has the tooth 111 and the counter electrode 12 corresponds to a wire mesh (mesh) in which the conductor 121 is formed of a conductive material.

The high voltage electrode 11 is attached to the case 30 via the insulating spacer 32. The counter electrode 12 is attached such that the conductor exposed area 123 is connected to the case 30, and an attached portion is connected to the ground terminal (E).

The material of the resistor 122 includes "none", "alkyd resin", "acrylic resin", "polyimide" "polyester", and "polytetrafluoroethylene (PTFE)".

The thickness of the resistor 122 is set to about 50 μm, respectively.

When the resistor 122 is "none", the ozone generation voltage is 3.2 kV, and the number of ion in the ozone generation voltage is 0 (zero). That is, in a state in which a DC voltage applied between the high voltage electrode 11 and the counter electrode 12 is gradually increased, when the DC voltage is 3.2 kV, the ozone generation is started. However, at the ozone generation voltage, ion is not generated.

When the resistor 122 is alkyd resin, the ozone generation voltage is 4.0 kV, and the number of ion in the ozone generation voltage is $1040\times 10^3/cm^3$. That is, in a state in which a DC voltage applied between the high voltage electrode 11 and the counter electrode 12 is gradually increased, when the DC voltage is 4.0 kV, the ozone generation is started. However, the ion generation starts at a DC voltage below the ozone generation voltage.

When the resistor 122 is acrylic resin, the ozone generation voltage is 4.5 kV, and the number of ion at the ozone generation voltage is $1400\times 10^3/cm^3$. That is, in a state in which a DC voltage applied between the high voltage electrode 11 and the counter electrode 12 is gradually increased, when the DC voltage is 6.0 kV, the ozone generation is started. However, the ion generation starts at a DC voltage below the ozone generating voltage.

When the resistor 122 is polyimide resin, the ozone generation voltage is 6.0 kV, and the number of ion in the ozone generation voltage is $1600\times 10^3/cm^3$. That is, in a state in which a DC voltage applied between the high voltage electrode 11 and the counter electrode 12 is gradually increased, when the DC voltage is 4.5 kV, the ozone generation is started. However, the ion generation starts at a DC voltage below the ozone generating voltage.

When the resistor 122 is polyester resin or PTFE, although a DC voltage applied between the high voltage electrode 11 and the counter electrode 12 is gradually increased to 10 kV, ozone is not generated and thus ion is not generated. When the resistor 122 is polyester resin, the conductor exposed area 123 is formed. Although the DC voltage between the high voltage electrode 11 and the counter electrode 12 is applied to 10 kV, the ozone is not generated but the ion is generated. That is, when the DC voltage between the high voltage electrode 11 and the counter electrode 12 is 10 kV, the number of ion is $2000\times 10^3/cm^3$.

From the above description, as the material of the resistor 122 (sub material for the resistor) in FIG. 5, the polyimide resin has the highest ozone generation voltage and the largest number of ion in the ozone generation voltage. That is, the polyimide resin is the most appropriate as the material of the resistor 122. The acrylic resins and the alkyd resin are appropriate as the material of the resistor 122, in this order. In addition, the polyester resin may be used by forming the conductor exposed area 123.

According to the properties, it is appropriate that the relative dielectric constant is equal to or more than 3 and the volume resistivity is equal to more than $10^{12}$ Ω·cm or equal to or less than $10^{18}$Ω. Particularly, it is more appropriate that the volume resistivity is equal to more than $10^{14}$ Ω·cm or equal to or less than $10^{15}$Ω.

Meanwhile, in a state in which the conductor exposed area 123 is not provided, when the volume resistivity of the resistor 122 exceeds $10^{17}$ Ω·cm, the resistor 122 functions as an insulator, and it is prevented that the discharge is generated between the high voltage electrode 11 and the counter electrode 12. Therefore, in this case, it is needed that the conductor exposed area 123 is formed.

An Example 3

In the example 3, the relationship between the collection efficiency and the ozone concentration between when the counter electrode 12 of the charger 10 is provided with the resistor 122 and when the counter electrode 12 of the charger 10 is not provided with the resistor 122. An electrostatic precipitator 1 described herein is described as the electrostatic precipitator 1 according to the example 3.

Figure 6:
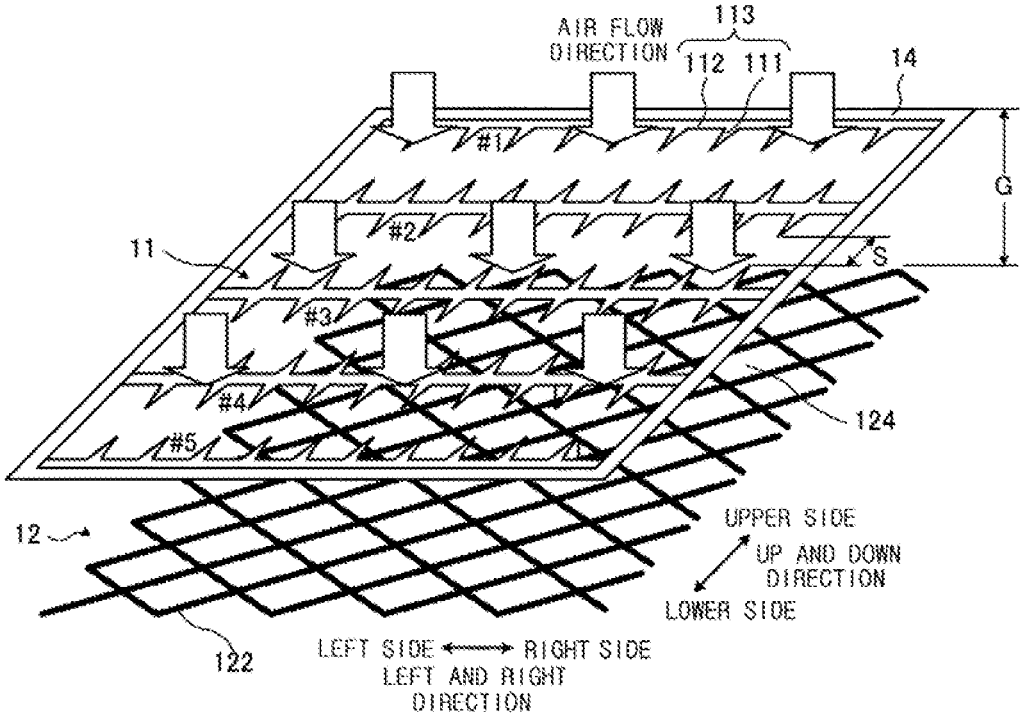
FIG. 6 is a perspective view of a charger of an electrostatic precipitator according to an example 3.

FIG. 6 is a perspective view of a charger 10 of an electrostatic precipitator 1 according to the example 3. As for the electrostatic precipitator 1 in FIG. 1, the air flow direction represents a direction from the right side to the left side based on the drawings. However, the air flow direction represents a direction from the upper side to the lower side based on the drawings.

The high voltage electrode 11 of the electrostatic precipitator 1 is the configuration illustrated in FIGS. 1 and 2. That is, the high voltage electrode 11 is provided with the plurality of the tooth rows 113 in which the plurality of the teeth 111 is disposed. The tooth 111 is disposed such that a leading end of the tooth 111 faces to each other between the tooth rows 113.

As for the counter electrode 12 of the electrostatic precipitator 1, the conductor 121 is formed of expanded metal. The expanded metal is a mesh-shaped member in which an opening 124 having a rhombus shape is formed, by putting a cutting line on a plate formed of the conductive material and then by stretching the plate.

Figure 7A:
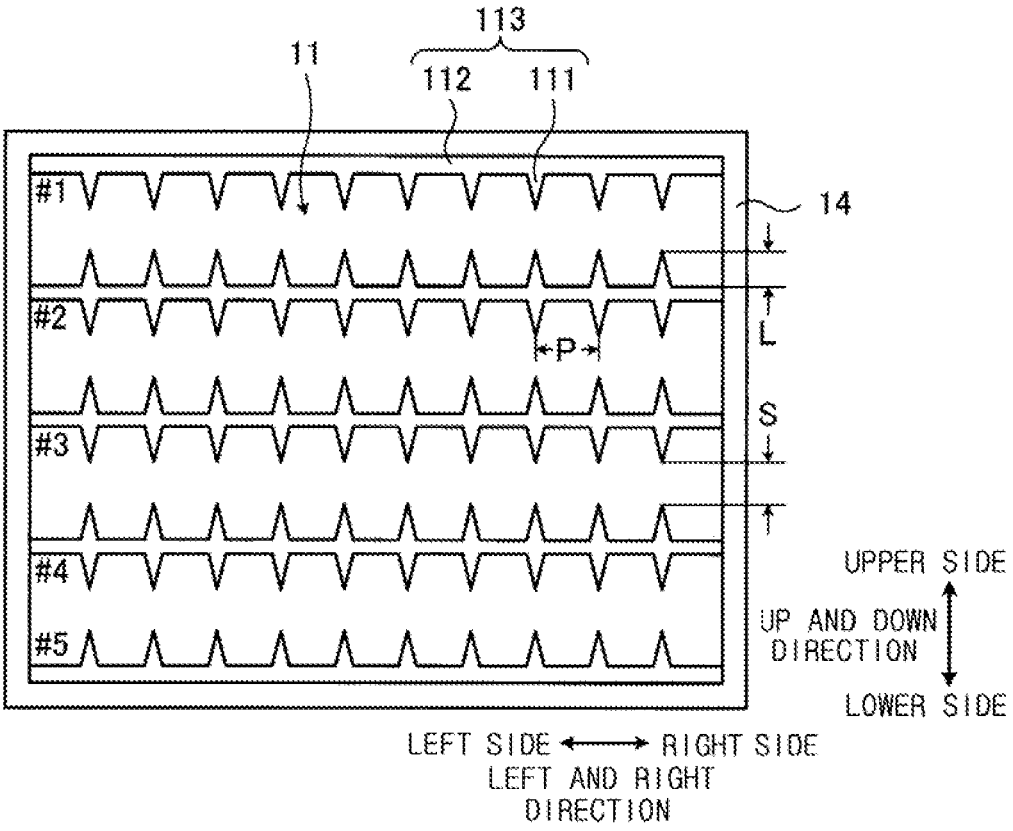
FIGS. 7A and 7B are top plan views of the high voltage electrode and the counter electrode of the electrostatic precipitator according to the example 3, particularly.
Figure 7B:
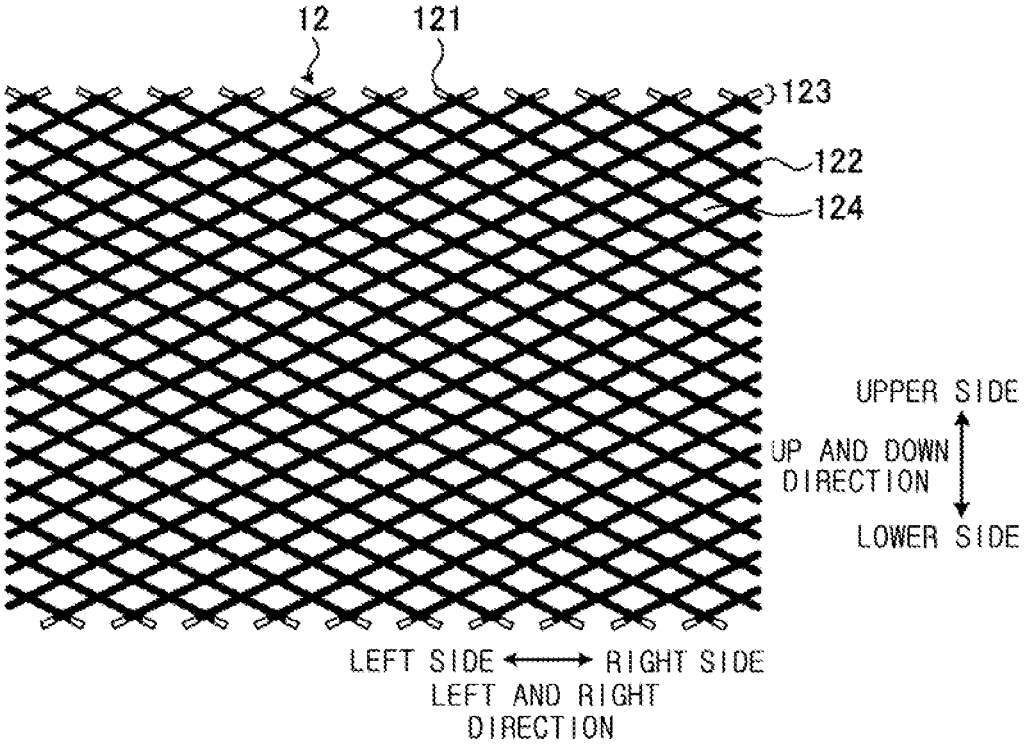

FIGS. 7A and 7B are top plan views of the high voltage electrode 11 and the counter electrode 12 of the electrostatic precipitator 1 in the example 3. FIG. 7A is a top plan view of the high voltage electrode 11 and FIG. 7B is a top plan view of the counter electrode 12.

The high voltage electrode 11 in FIG. 7A is the same as the electrostatic precipitator 1 in FIG. 2A.

As illustrated in FIG. 7B, the counter electrode 12 is provided with the conductor 121 formed of expanded metal and the resistor 122 configured to cover a surface of the conductor 121. A portion of the conductor 121 (the upper side and the lower side in the up and down direction) is configured by the conductor exposed area 123 in which the resistor 122 is not provided.

The high voltage electrode 11 is attached to the case 30 via the insulating spacer 32. The counter electrode 12 is attached such that the conductor exposed area 123 is connected to the case 30, and an attached portion is connected to the ground terminal (E) (refer to FIG. 3).

The size of the supporting portion 14 of the high voltage electrode 11 has about 400 mm in the left and right direction and about 300 mm in the up and down direction.

The high voltage electrode 11 is formed by a plate-shaped stainless steel (SUS) having a thickness of 0.5 mm. A space (S) between the leading end of the tooth 111 between the tooth rows 113 is set as about 30 mm. The high voltage electrode 11 is provided with five tooth rows 113 (#1 to #5).

The conductor 121 of the counter electrode 12 is formed of expanded metal and the size of the opening 124 is 4 mm×8 mm.

The resistor 122 covering the conductor 121 of the counter electrode 12 is formed of polyimide having a thickness of 50 μm.

The polyimide used as the resistor 122 has a permittivity of 3.3, and a volume resistivity of $10^{16}$ Ω·cm.

A distance (G) between the high voltage electrode 11 and the counter electrode 12 is set as 5 mm.

When a DC voltage of about 4 kV is applied to between the high voltage electrode 11 and the counter electrode 12, the ion generation starts and it may be possible to charge the suspended particles.

As illustrated in FIG. 1, the dust collector 20 is disposed in the downstream of the air flow direction, and the suspended particles in the air is removed by blowing the air into the charger 10 and the dust collector 20 while applying the current to the charger 10 and the dust collector 20.

Figure 8:
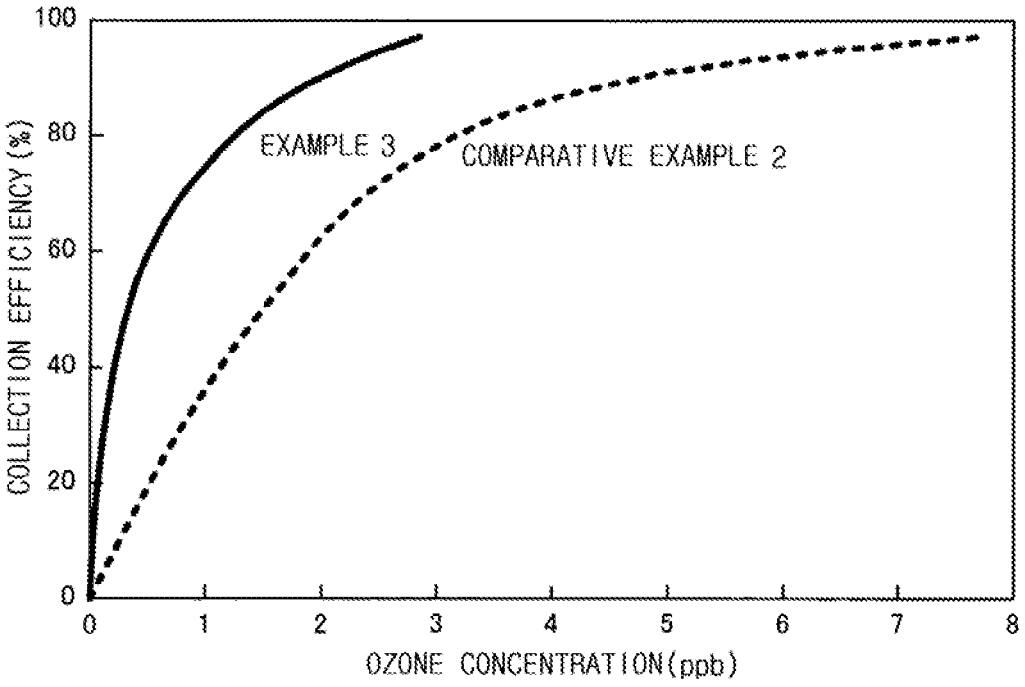
FIG. 8 is a graph illustrating the relationship between the collection efficiency and the ozone concentration in the electrostatic precipitator according to the example 3.

FIG. 8 is a graph illustrating the relationship between the collection efficiency and the ozone concentration in the electrostatic precipitator 1 according to the example 3. In FIG. 8, the electrostatic precipitator 1 configured as mentioned above represents the electrostatic precipitator 1 according to the example 3 and the electrostatic precipitator 1 in which the resistor 122 is not formed in the counter electrode 12 of the charger 10 represents a comparative example 2. As for the electrostatic precipitator 1 according to the comparative example 2, the counter electrode 12 of the charger 10 is connected to the case 30, and an attached portion is connected to the ground terminal (E).

When operating the electrostatic precipitator 1 in the example 3 in a state of acquiring almost 100% collection efficiency, the ozone concentration is equal to or less than 3.0 ppb. The value is significantly below the environmental standard (0.05 ppm).

Meanwhile, when operating the electrostatic precipitator 1 in the comparative example 2 in a state of acquiring almost 100% collection efficiency, the ozone concentration is greater than 7 ppb. The value is significantly below the environmental standard (0.05 ppm) but the value is more than twice that of the electrostatic precipitator 1 according to the example 3.

As mentioned above, since the electrostatic precipitator 1 in the example 3 is provided with the resistor 122 in the counter electrode 12 of the charger 10, it is possible to acquire high collection efficiency while maintaining the ozone concentration in a low level.

An Example 4

In a state in which the configuration of the high voltage electrode 11 of the charger 10 in the electrostatic precipitator 1 varies, the relationship between the collection efficiency and the ozone concentration will be described. The electrostatic precipitator 1 described herein will be indicated by an electrostatic precipitator 1 according to the example 4.

Figure 9:
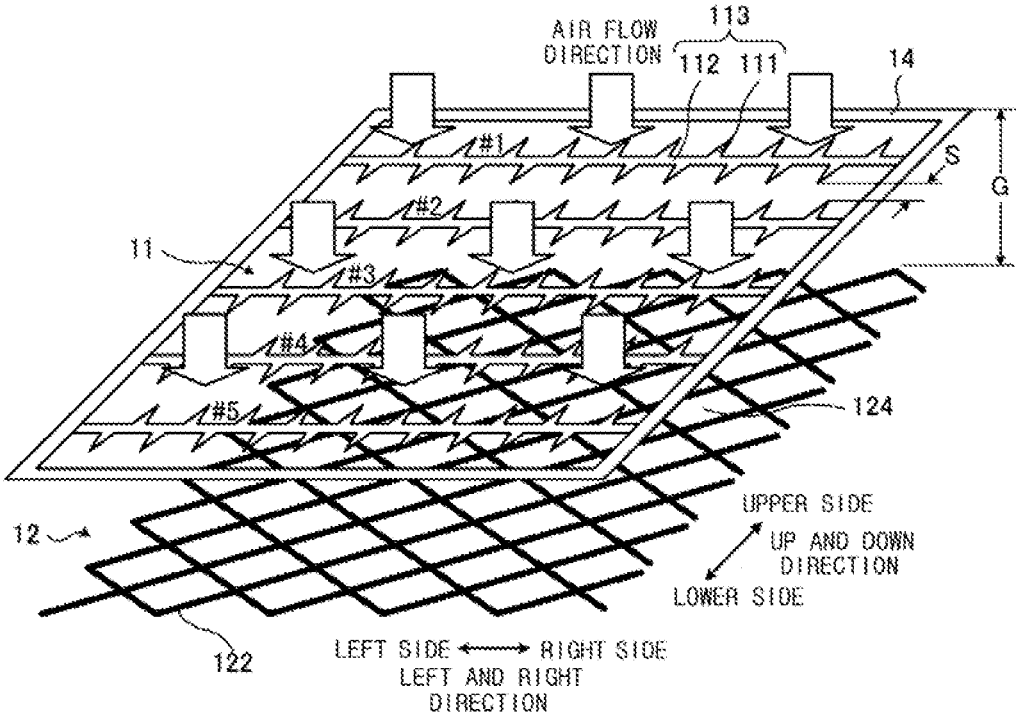
FIG. 9 is a perspective view of a charger of an electrostatic precipitator according to an example 4.

FIG. 9 is a perspective view of a charger 10 of an electrostatic precipitator 1 according to the example 4. In FIG. 9, the air flow direction is described as the up and down direction.

The high voltage electrode 11 of the electrostatic precipitator 1 is provided with the plurality of the tooth rows 113 in which the plurality of the teeth 111 is provided. The tooth row 113 is provided with the tooth 111 toward the upper side and the lower side. The leading end of the tooth 111 is arranged in a zigzag pattern (stagger) between the tooth rows 113. That is, the leading end of the tooth 111 is not opposite to each other between the tooth rows 113, and particularly, a leading end of the tooth 111 in the tooth row 113 in one side is arranged between leading ends of the tooth 111 in the tooth row 113 in other side. That is, between the tooth rows 113, the tooth 111 is crossed to each other in the row direction.

Meanwhile, as for the counter electrode 12 of the electrostatic precipitator 1, the conductor 121 is formed of expandable metal, as the same as the example 3.

Figure 10A:
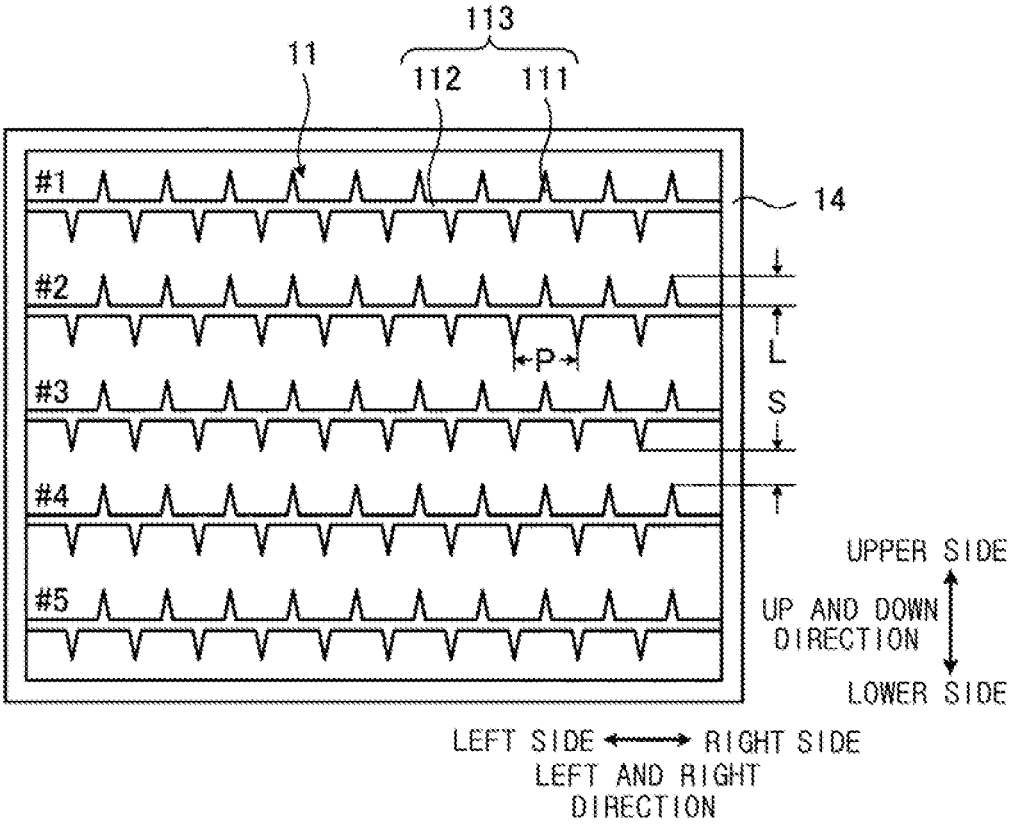
FIGS. 10A and 10B are top plan views of the high voltage electrode and the counter electrode of the electrostatic precipitator according to the example 4, particularly.
Figure 10B:
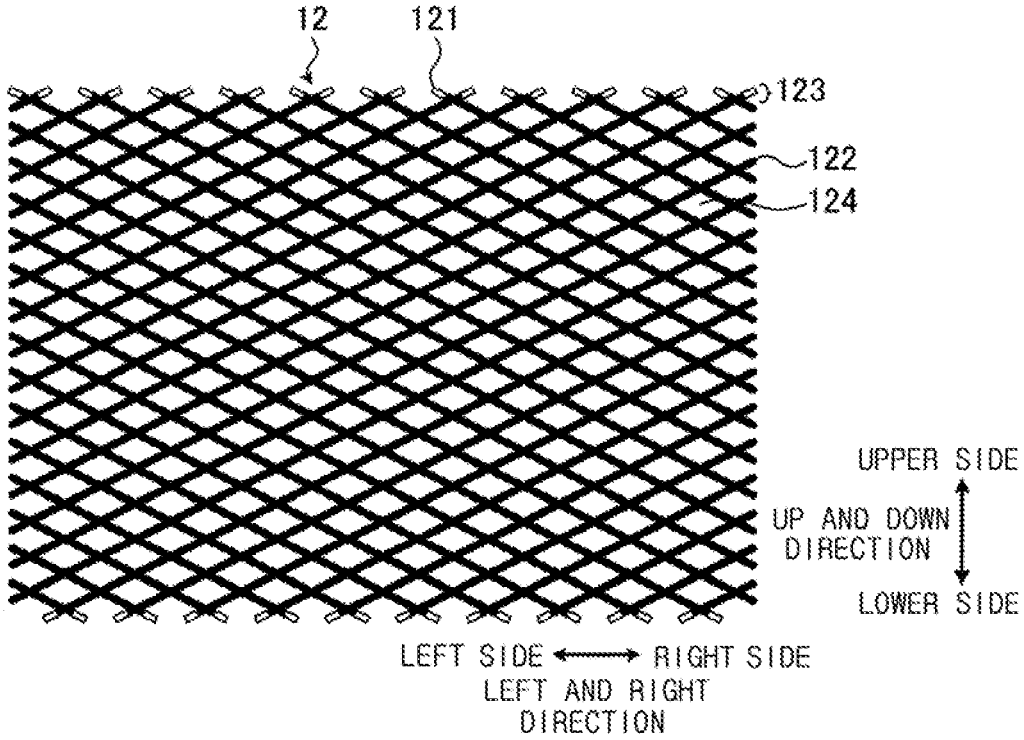

FIGS. 10A and 10B are top plan views of the high voltage electrode 11 and the counter electrode 12 of the electrostatic precipitator 1 according to the example 4. FIG. 10A is a top plan view of the high voltage electrode 11 and FIG. 10B is a top plan view of the counter electrode 12.

As illustrated in FIG. 10A, the tooth 111 is formed in the up and down direction of all of the tooth row 113, and thus the number of the tooth 111 is greater than that of the electrostatic precipitator 1 in the example 3.

The high voltage electrode 11 is attached to the case 30 via the insulating spacer 32. The counter electrode 12 is attached such that the conductor exposed area 123 is connected to the case 30, and an attached portion is connected to the ground terminal (E).

The size of the supporting portion 14 of the high voltage electrode 11 has about 400 mm in the left and right direction and about 300 mm in the up and down direction.

The high voltage electrode 11 is formed by a stainless steel (SUS) having a thickness of 0.5 mm. A space (S) between the leading end of the tooth 111 between the tooth rows 113 is set as about 20 mm. The high voltage electrode 11 is provided with five tooth rows 113 (#1 to #5).

The conductor 121 of the counter electrode 12 is formed of the expendable metal of the SUS, and the size of the opening 124 has about 4 mm×about 8 mm. The resistor 122 covering the conductor 121 of the counter electrode 12 is formed of polyimide resin having a thickness of 50 μm. The polyimide resin used as the resistor 122 has a permittivity of 3.3, and a volume resistivity of $10^{16}$ Ω·cm.

Figure 11:
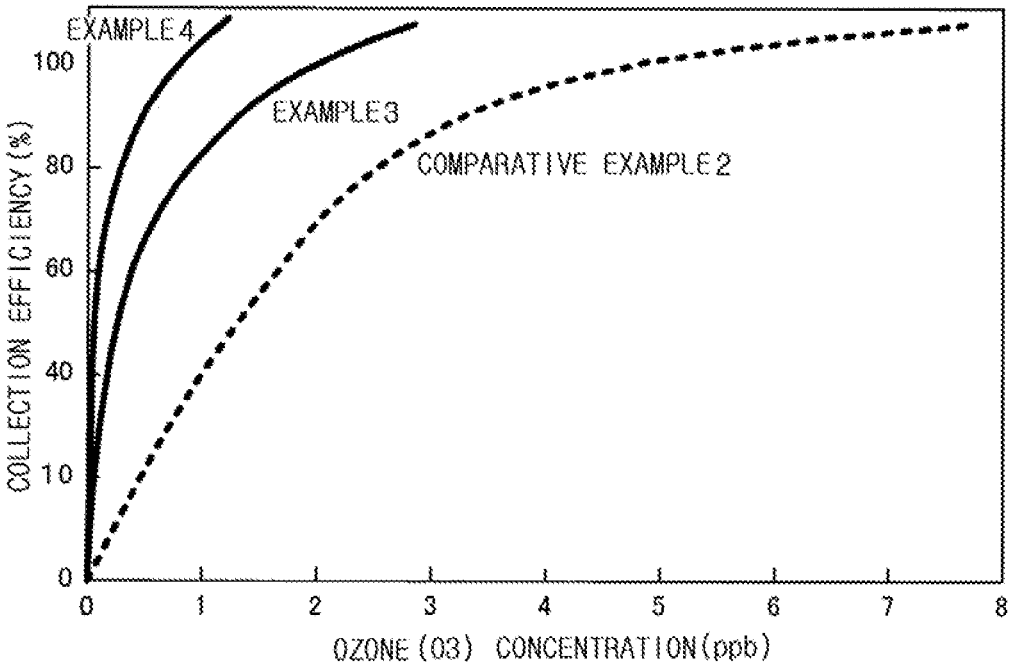
FIG. 11 is a graph illustrating the relationship between the collection efficiency and the ozone concentration in the electrostatic precipitator according to the example 4.

FIG. 11 is a graph illustrating the relationship between the collection efficiency and the ozone concentration in the electrostatic precipitator 1 according to the example 4. In FIG. 8, the electrostatic precipitator 1 configured as mentioned above represents the electrostatic precipitator 1 according to the example 4. FIG. 11 illustrates the electrostatic precipitator 1 in the example 3 and the electrostatic precipitator 1 in the comparative example 2

As illustrated in FIG. 11, when operating the electrostatic precipitator 1 in the example 4 in a state of acquiring almost 100% collection efficiency, an ozone concentration is equal to or less than 2.0 ppb. The ozone concentration is lower than that of the electrostatic precipitator 1 according to the example 3.

It is assumed that because that the tooth 111 is arranged in a zigzag pattern between the tooth rows 113 of the high voltage electrode 11. That is, between the high voltage electrode 11 and the counter electrode 12, an area (range), in which the corona discharge occurs, become larger in comparison with a case in which the tooth 111 is opposite to each other between the tooth rows 113.

As mentioned above, the electrostatic precipitator 1 according to the example 4 may maintain the ozone concentration in the low level while acquiring high collection efficiency by changing the shape of the high voltage electrode 11.

Figure 12A:
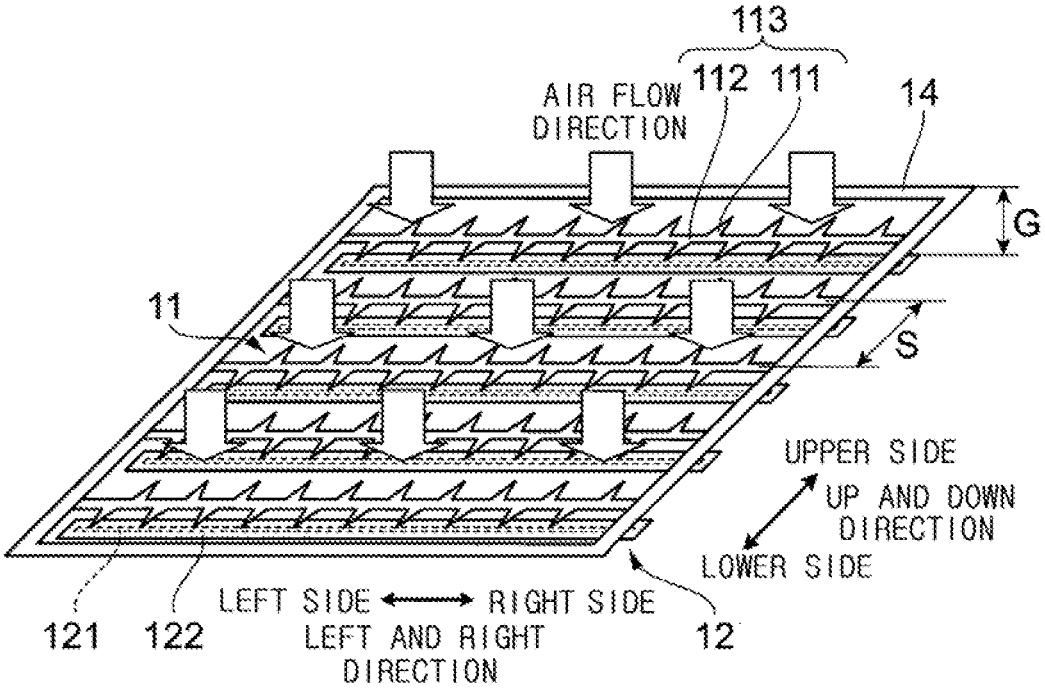
FIGS. 12A to 12C are views illustrating a modified example of the charger of the electrostatic precipitator according to the example 4, particularly.
Figure 12B:
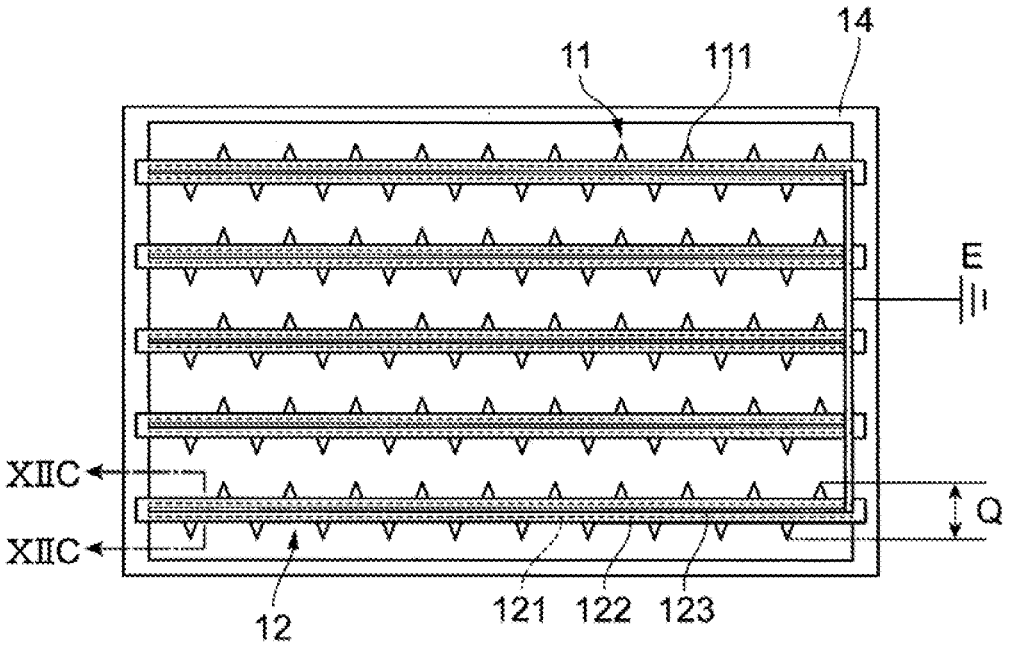
Figure 12C:
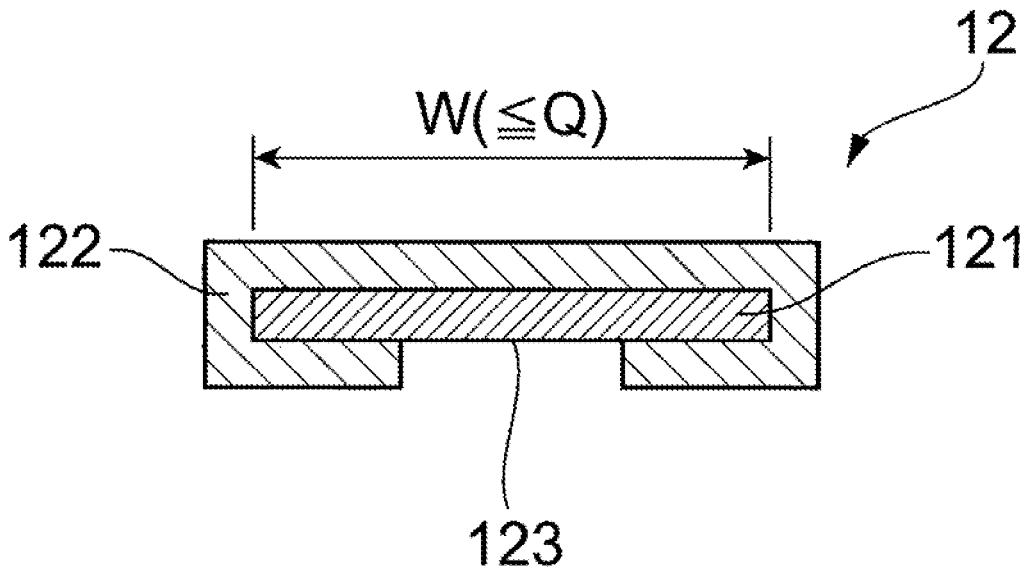

FIGS. 12A to 12C are views illustrating a modified example of the charger 10 of the electrostatic precipitator 1 according to the example 4. FIG. 12A is a perspective view of the charger 10, FIG. 12B is a view of the charger 10 when viewing from the side of the counter electrode 12, and FIG. 12C is a cross-sectional view taken along line XIIC-XIIC of the counter electrode 12.

The conductor 121 of the counter electrode 12 is configured with a plurality of flat plates, and the resistor 122 is coated on the surface of each flat plate forming the plurality of flat plates. Each flat plate is disposed to be pair with the tooth row 113.

Each flat plate is formed in a flat surface in the distance (G) from the high voltage electrode 11. In the tooth row 113 facing the conductor 121, a width (W) of the conductor 121 may be less than a distance (Q) between the leading ends of the teeth 111 in the width direction of the conductor 121.

A portion of the conductor 121 (a back side with respect to the tooth row 113) corresponds to the conductor exposed area 123 in which the resistor 122 is not provided. The counter electrode 12 is attached such that the conductor exposed area 123 is connected to the case 30, and an attached portion is connected to the ground terminal (E). The conductor exposed area 123 is configured to prevent the discharge from directly occurring between the high voltage electrodes 11. That is, the conductor exposed area 123 of the counter electrode 12 is exposed in a portion where the electrical breakdown does not occur, and an insulation distance is maintained between the conductor exposed area 123 of the counter electrode 12 and the high voltage electrode 11.

An Example 5

According to examples from 1 to 4, the tooth 111 has been used in the high voltage electrode 11 of the charger 10 of the electrostatic precipitator 1.

Hereinafter a case in which a wire 114 is used in the high voltage electrode 11 of the charger 10 of the electrostatic precipitator 1 will be described. The electrostatic precipitator 1 described herein will be indicated by an electrostatic precipitator 1 according to the example 5.

Figure 13A:
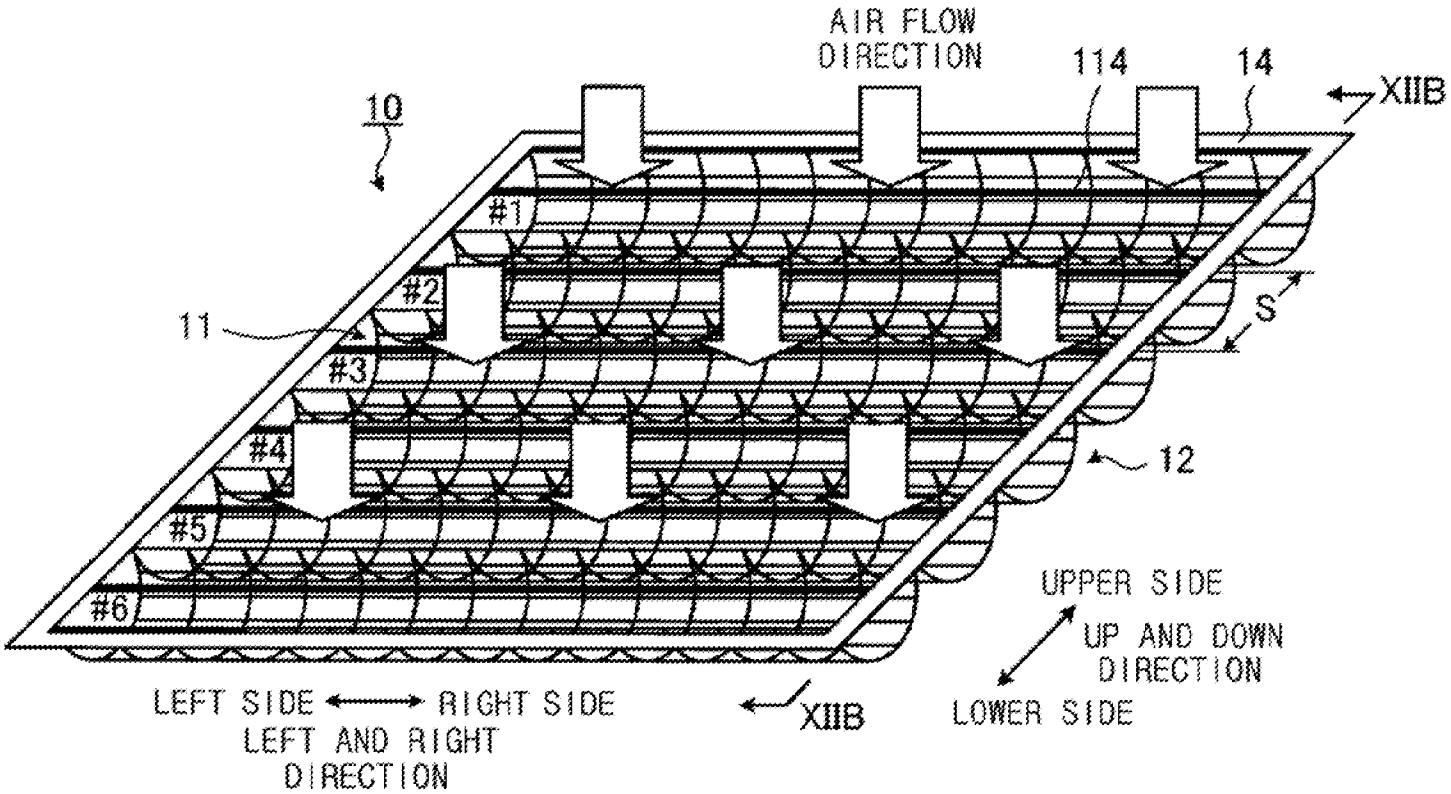
FIGS. 13A and 13B are views illustrating a charger of an electrostatic precipitator according an example 5, particularly.
Figure 13B:
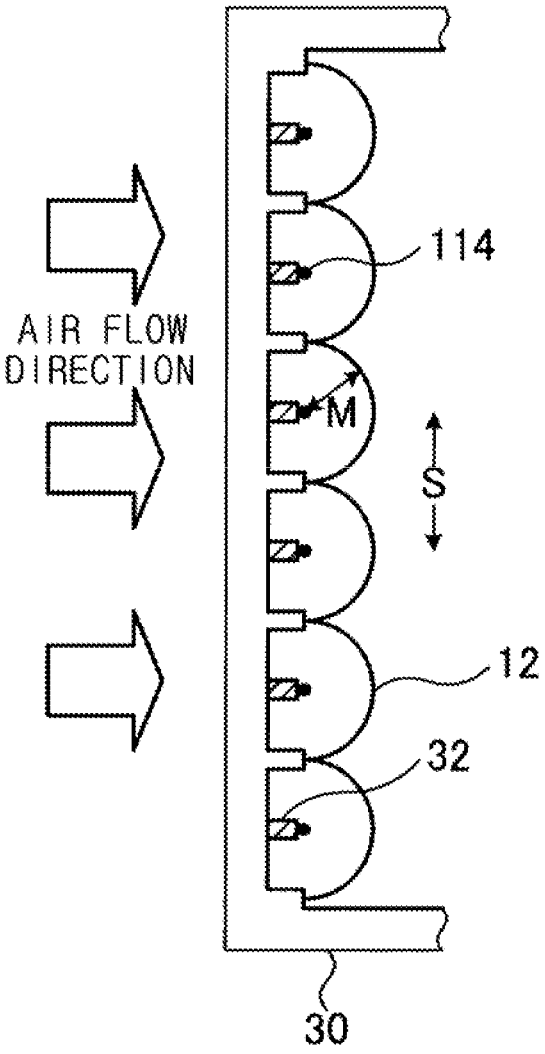

FIGS. 13A and 13B are views illustrating the charger 10 of the electrostatic precipitator 1 according the example 5. FIG. 13A is a perspective view of the charger 10, FIG. 13B is a cross-sectional view taken along line XIIIB-XIIIB of FIG. 13A. In FIG. 13A, the air flow direction is described as the direction from the upper side to the lower side on the drawings.

As illustrated in FIG. 13A, the high voltage electrode 11 of the charger 10 of the electrostatic precipitator 1 is provided with a plurality of wires 114. The plurality of wires 114 is formed in the left and right direction. Opposite end portions of the plurality of wires 114 are fixed to the supporting portion 14. A DC voltage is fed to the plurality of wires 114 via a wiring formed in a circuit board provided in the supporting portion 14.

As for the counter electrode 12 of the charger 10, the conductor 121 is a wire mesh formed of the conductive material. The counter electrode 12 is provided with the resistor 122 configured to cover a surface of the conductor 121 (refer to FIGS. 14A and 14B described later).

As illustrated in the cross-sectional view of FIG. 13B, the counter electrode 12 is curved in a semi-cylindrical shape having a radius (M), so as to surround each of wires 114. The radius (M) is set as a half of a space (S) between the wires 114. Meanwhile, it is allowed that the counter electrode 12 is formed in a semi-cylindrical shape surrounding the plurality of wires 114.

The wire 114 of the high voltage electrode 11 is attached to the case 30 via the insulating spacer 32. Alternatively, it is allowed that the supporting portion 14 is attached to the case 30 via the insulating spacer 32. Also, it is allowed that the supporting portion 14 is a portion of the case 30.

The counter electrode 12 is attached such that the conductor exposed area 123 is connected to the case 30, and an attached portion is connected to the ground terminal (E).

Figure 14A:
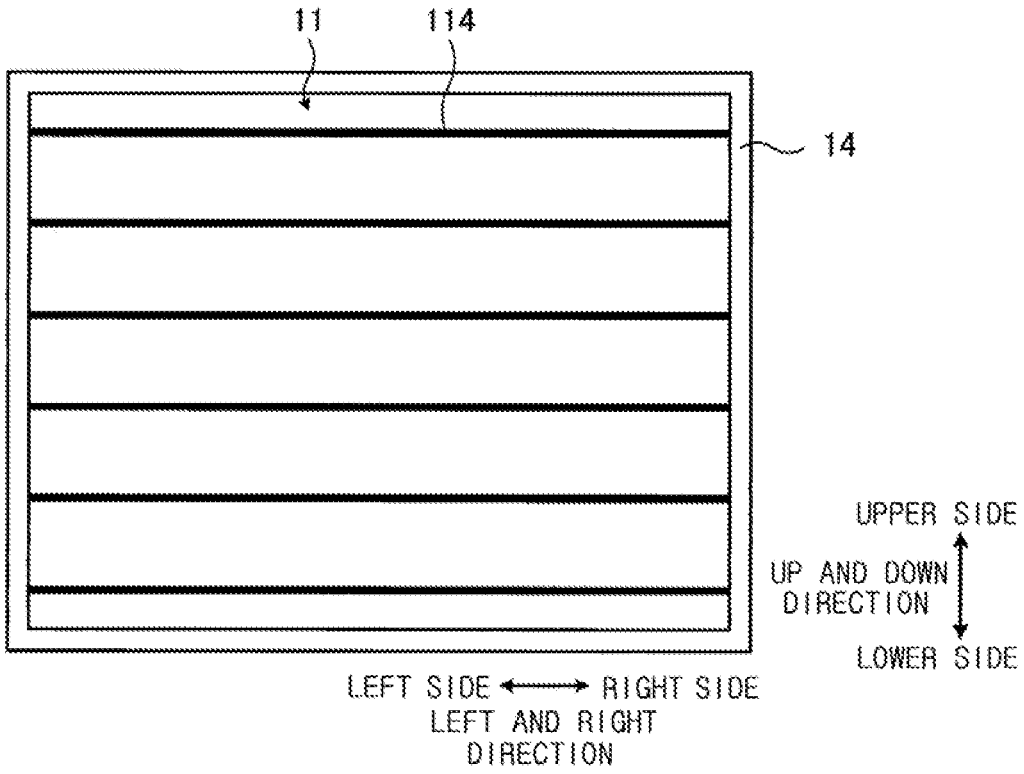
FIGS. 14A and 14B are top plan views of the high voltage electrode and the counter electrode of the electrostatic precipitator according to the example 5, particularly.
Figure 14B:
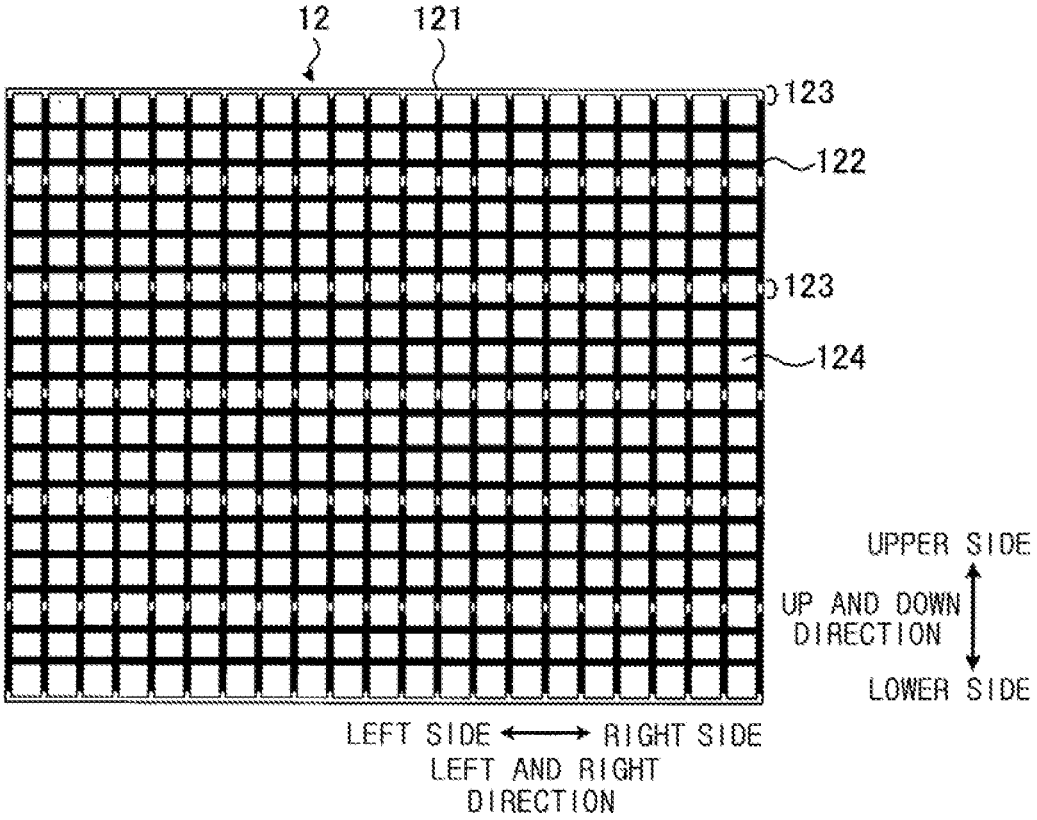

FIGS. 14A and 14B are top plan views of the high voltage electrode 11 and the counter electrode 12 of the electrostatic precipitator 1 according to the example 5. FIG. 14A is a top plan view of the high voltage electrode 11 and FIG. 14B is a top plan view of the counter electrode 12.

As illustrated in FIG. 14A, the high voltage electrode 11 is provided with the plurality of wires 114.

As illustrated in FIG. 14B, the conductor 121 is a wire mesh formed of the conductive material. The counter electrode 12 is provided with the resistor 122 configured to cover a surface of the conductor 121. Meanwhile, as illustrated in FIG. 13B, when the counter electrode 12 is formed in the semi-cylindrical shape, a portion in which the counter electrode 12 makes contact with the case 30 is the conductor exposed area 123 to which the resistor 122 is not provided.

As for the electrostatic precipitator 1 in the example 5, it is possible to maintain the ozone concentration in the low level while acquiring the high collection efficiency It is assumed that because the discharge current is limited since the counter electrode 12 of the charger 10 is provided with the resistor 122 covering the surface of the conductor 121. Further, by forming the counter electrode 12 in the semi-cylindrical shape about each of wires 114, the corona discharge occurs in each space surrounding wire 114.

(A Modified Example of the High Voltage Electrode 11 in the Charger 10)

Figure 15A:
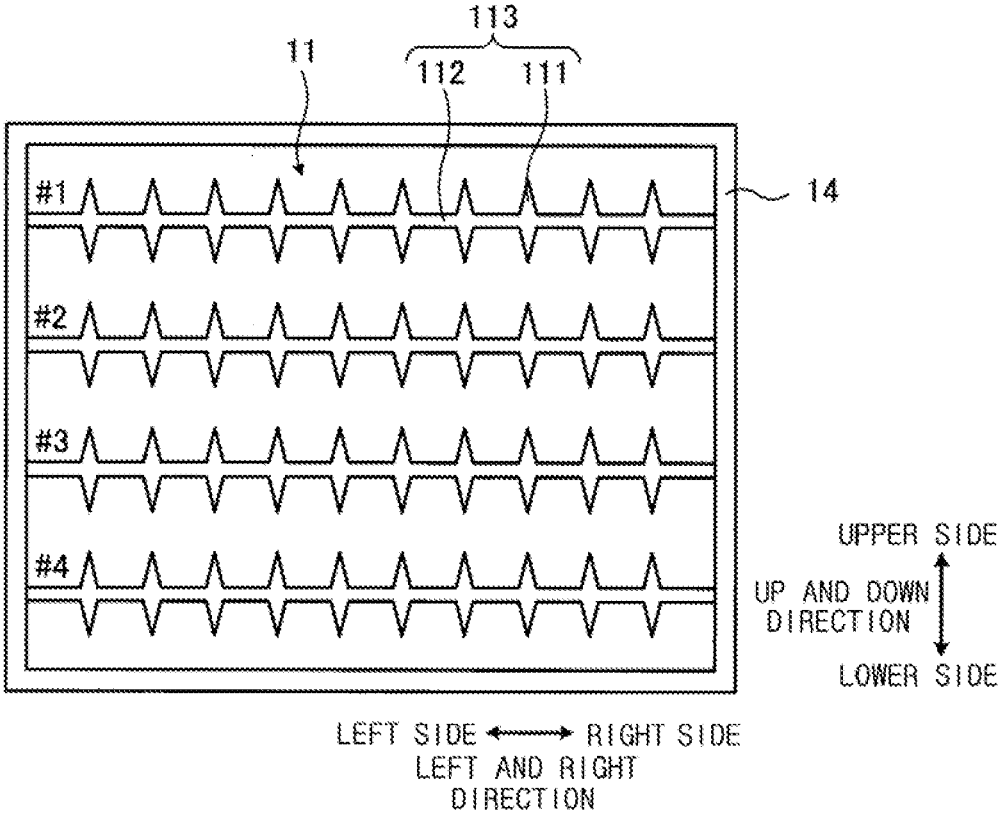
FIGS. 15A and 15B are views illustrating a modified example of the high voltage electrode of the charger in the electrostatic precipitator, particularly.
Figure 15B:
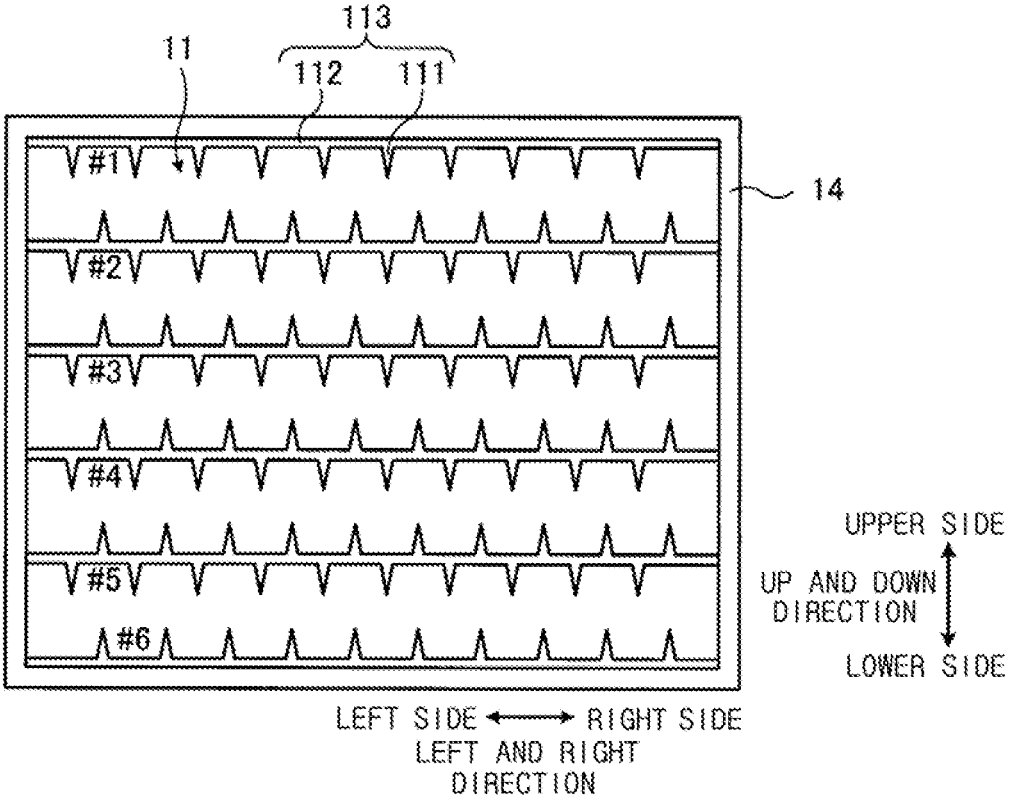

FIGS. 15A and 15B are views illustrating a modified example of the high voltage electrode 11 of the charger 10 in the electrostatic precipitator 1. FIG. 15A is a view illustrating a case in which the tooth 111 is arranged differently from the arrangement of FIG. 2A, and FIG. 15B is a view illustrating a case in which the tooth 111 is arranged differently from the arrangement of FIG. 10A.

FIG. 15A will be described first.

As illustrated in FIG. 2A, the connecting portion 112 of the tooth row 113 in the most upper side and in the most lower side (#1 and #5 in FIG. 2) is close to the supporting portion 14 or makes contact with the supporting portion 14. Accordingly, in the most upper side tooth row 113 and in the most lower side tooth row 113 (#1 and #5 in FIG. 2A), the tooth 111 is formed in only one of the upper side and the lower side.

However, as illustrated in FIG. 15A, as for the high voltage electrode 11, all of the tooth row 113 is provided with the tooth 111 in both of the upper side and the lower side.

Next, FIG. 15B will be described

As illustrated in FIG. 10A, all of the tooth row 113 is provided with the tooth 111 in both of the upper side and the lower side.

However, as illustrated in FIG. 15B, as for the high voltage electrode 11, the connecting portion 112 of the tooth row 113 in the most upper side and in the most lower side (#1 and #6 in FIG. 15B) is close to the supporting portion 14 or makes contact with the supporting portion 14. Accordingly, in the tooth row 113 in the most upper side and in the most lower side (#1 and #6 in FIG. 15B), the tooth 111 is formed in on only one of the upper side and the lower side.

By applying the above mentioned high voltage electrode 11 to the electrostatic precipitator 1 in the examples 1, 3, and 4, it is possible to maintain the ozone concentration in the low level while acquiring a high collection efficiency.

Figure 16A:
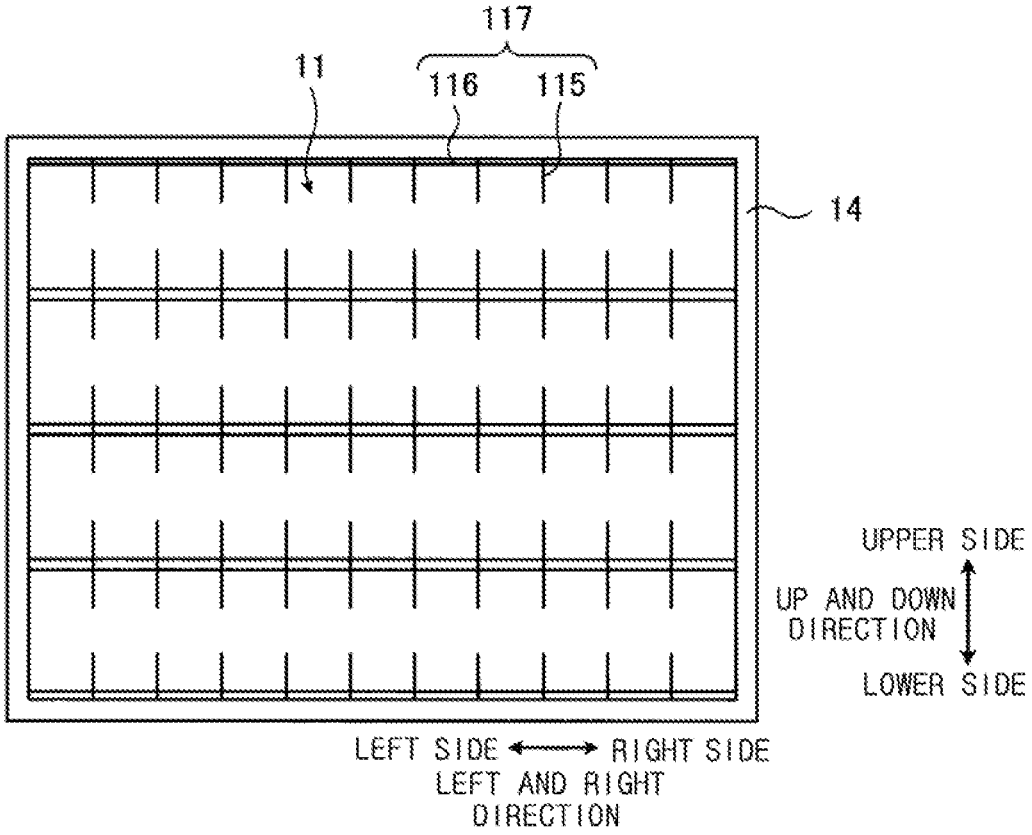
FIGS. 16A and 16B are views illustrating another modified example of the high voltage electrode of the charger in the electrostatic precipitator, particularly
Figure 16B:
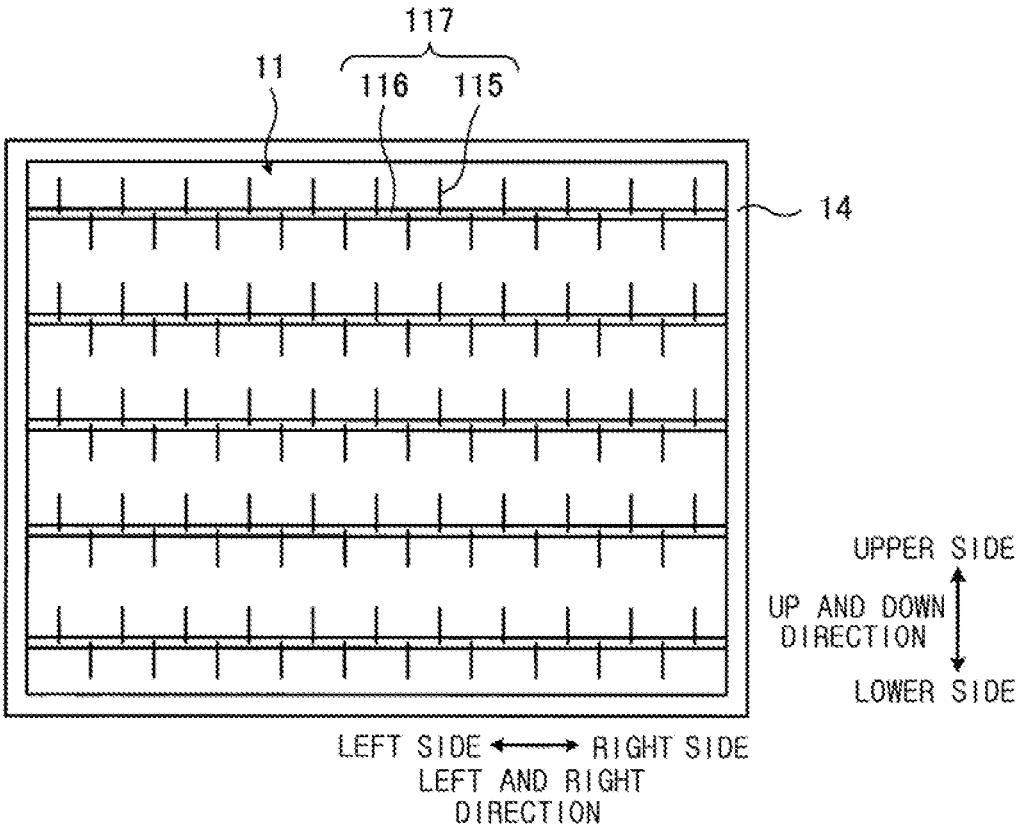

FIGS. 16A and 16B are views illustrating another modified example of the high voltage electrode 11 of the charger 10 in the electrostatic precipitator 1. FIG. 16A is a view illustrating a case in which the high voltage electrode 11 is configured with a plurality of needle rows 117 having a plurality of needles 115 and a leading end of the needle 115 faces to between adjacent needle rows. FIG. 16B is a view illustrating a case in which the high voltage electrode 11 is configured with a plurality of needle rows 117 having a plurality of needles 115 and a leading end of the needle 115 is arranged in a zigzag pattern between adjacent needle rows.

The needle 115 and/or the leading end thereof is an example of a portion generating an electric field concentration.

FIG. 16A illustrates that the tooth 111 of the high voltage electrode 11 illustrated in FIG. 2A is replaced with the needle 115. The needle 115 is a member in a needle shape having a pointed leading end. In the needle row 117, a connecting portion 116 to which the plurality of needles 115 is connected corresponds to a circuit board in which a wiring is formed, wherein the plurality of needles 115 is connected to the wiring.

FIG. 16B illustrates that the tooth 111 of the high voltage electrode 11 illustrated in FIG. 2A is replaced with the needle 115. Other components are the same as those illustrated in FIG. 10A and thus a description thereof will be omitted.

By applying the above mentioned high voltage electrode 11 to the electrostatic precipitator 1 in the examples 1, 3, and 4, it is possible to maintain the ozone concentration in the low level while acquiring a high collection efficiency.

It is allowed that the arrangement of the needle 115 illustrated in FIGS. 16A and 16B is changed into the arrangement of the tooth 111 illustrated in FIGS. 15A and 15B.

It is allowed that as for the high voltage electrode 11, a brush shape formed by a carbon wire having the conductivity is used instead of the tooth 111 or the needle 115 of the high voltage electrode 11. The brush shaped portion and/or a leading end thereof is an example of a portion generating an electric field concentration.

(A Modified Example of the Counter Electrode 12 in the Charger 10)

Figure 17:
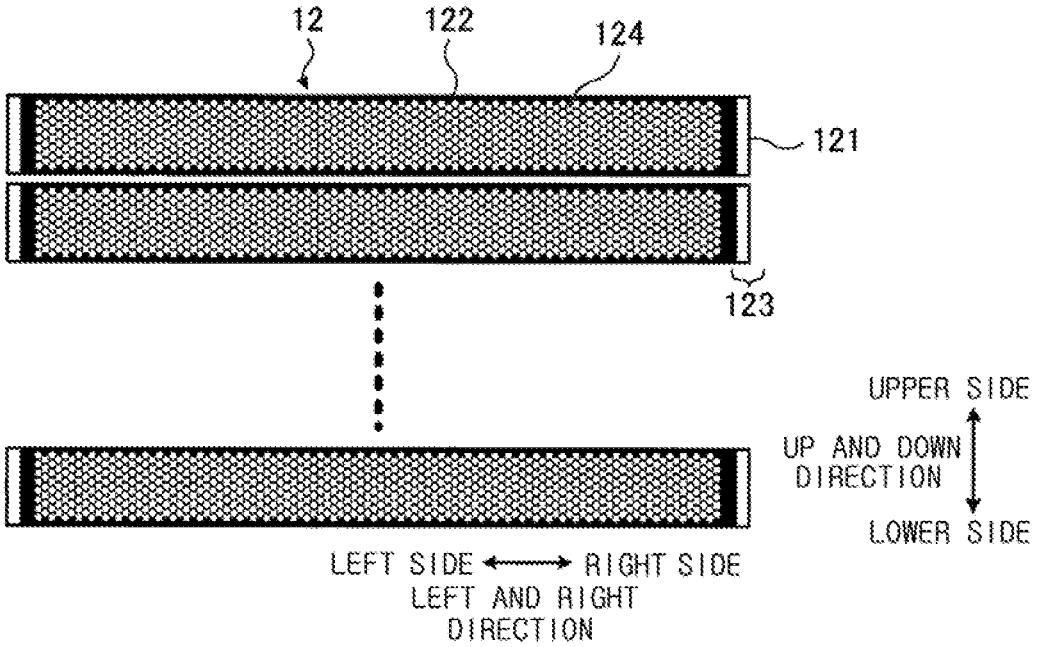
FIG. 17 is a view illustrating a modified example of the counter electrode of the charger in the electrostatic precipitator.

FIG. 17 is a view illustrating a modified example of the counter electrode 12 of the charger 10 in the electrostatic precipitator 1.

As illustrated in FIG. 17, the counter electrode 12 is provided with the conductor 121 formed by a plate formed of a conductive material in which a plurality of openings 124 is formed, and the resistor 122 formed on a surface of the conductor 121. The opening 124 is formed to pass through the plate that is the conductor 121. A portion of the conductor 121 (opposite end portions in the left and right direction) is configured with the conductor exposed area 123 in which the resistor 122 is not provided.

The counter electrode 12 is attached such that the conductor exposed area 123 is connected to the case 30, and an attached portion is connected to the ground terminal (E).

The resistor 122 is provided to prevent the discharge current between the high voltage electrode 11 and the counter electrode 12. Therefore, it is needed that the discharge current is not generated between the high voltage electrode 11 and the conductor 121 of the counter electrode 12 at least. Accordingly, the resistor 122 is provided to cover the surface of the conductor 121 (plate) in the side facing the high voltage electrode 11.

It is allowed that the above mentioned high voltage electrode 11 and counter electrode 12 are used in combination thereof.

The values illustrated in the examples from 1 to 5 are merely an example and is not limited thereto.

A Second Embodiment

According to a second embodiment, in a state in which the high voltage electrode 11 is provided with the plurality of the tooth rows 113 having the plurality of the teeth 111, conditions for setting an arrangement of the tooth 111 will be described. Between the tooth rows 113, leading ends of the tooth 111 is crossed with each other. For example, between the tooth rows 113, the leading end of the tooth 111 is arranged in a zigzag pattern.

Figure 18:
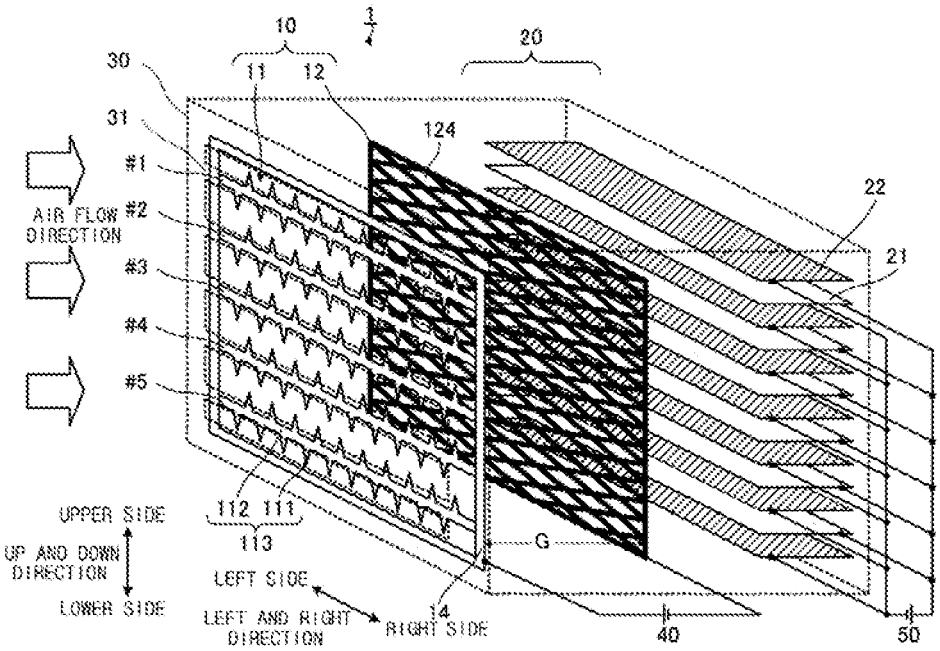
FIG. 18 is a view illustrating an example of an electrostatic precipitator in accordance with a second embodiment of the present disclosure.

FIG. 18 is a view illustrating an example of an electrostatic precipitator 1 in accordance with the second embodiment of the present disclosure. A case 30 is illustrated with a broken line, and thus a configuration of a charger 10 and a dust collector 20 provided in the case 30 is shown.

Components similar with those in the first embodiment will have the same reference numerals and thus a description thereof will be omitted. However, different component will be described.

(A Charger 10)

The charger 10 is provided with a high voltage electrode 11 and a counter electrode 12 facing the high voltage electrode 11.

The high voltage electrode 11 is provided with a plurality of the tooth row 113 (five rows from #1 to #5 in FIG. 18) in which the plurality of the teeth 111 having a pointed leading end is provided. Between the adjacent tooth rows 113, the tooth 111 is formed such that the leading end thereof is across each other with respect to the direction of the tooth row 113. In FIG. 18, between the adjacent tooth rows 113, the leading end of the tooth 111 in one side of the tooth row 113 is disposed in the center of the leading end of the tooth 111 in the other side of the tooth row 113. That is, between the adjacent tooth rows 113, each of the leading end of the tooth 111 is arranged in a zigzag pattern.

A length from the leading end of the tooth 111 to the connecting portion 112 is L (length; L), and a pitch between the tooth 111 in the tooth row 113 is P (pitch P). Between the tooth 111 and the tooth row 113 adjacent to the tooth 111, a space between the leading end of the tooth 111 in the direction perpendicular to the tooth row is S (space; S).

The counter electrode 12 is provided with the conductor 121 corresponding to an expandable metal formed of the conductive material and the resistor 122 covering the surface of the conductor 121.

The high voltage electrode 11 and the counter electrode 12 of the charger 10 according to the second embodiment is similar with FIGS. 10A and 10B according to the example 4 according to the first embodiment.

A distance between the high voltage electrode 11 and the counter electrode 12 is G.

As illustrated in FIG. 3A, the high voltage electrode 11 is attached to the case 30 via the insulating spacer 32 formed of the insulating material. The counter electrode 12 is attached such that the conductor exposed area 123 in which the conductor 121 is exposed is electrically connected, and the attached portion (electrical connection) is connected to the ground terminal (E).

(Collection Efficiency and Ozone Concentration)

A result of measuring the collection efficiency and ozone concentration in the electrostatic precipitator 1 to which the first embodiment is applied will be described. The electrostatic precipitator 1 described herein will be indicated by the electrostatic precipitator 1 according to an example 6.

An Example 6

As for the charger 10 of the electrostatic precipitator 1, the size of the supporting portion 14 of the high voltage electrode 11 has about 400 mm in the left and right direction and about 300 mm in the up and down direction with respect to the air flow direction.

In the charger 10, the tooth 111 and the connecting portion 112 of the high voltage electrode 11 is formed by a plate-shaped stainless steel (SUS) having a thickness of 0.5 mm. A length (L) of the tooth 111 is about 10 mm. As illustrated in FIGS. 10A, 10B and 18, five tooth rows 113 are provided.

In the charger 10, the conductor 121 of the counter electrode 12 is the expendable metal formed of the SUS having 4 mm×8 mm of the opening 124. The resistor 122 covering the surface of the conductor 121 is formed of polyimide resin having a thickness of about 50 μm. The polyimide resin has a relative dielectric constant of 3.3 and a volume resistivity of $10^{16}$ Ω·cm.

A distance (G) between the high voltage electrode 11 and the counter electrode 12 is about 5 mm.

As for the dust collector 20, the high voltage electrode 21 and the counter electrode 22 allow a width of the air flow direction to be about 20 mm and a distance perpendicular to the air flow direction to be about 400 mm. A distance between the high voltage electrode 21 and the counter electrode 22 is about 1.5 mm. A DC voltage of about 6 kV is applied to between the high voltage electrode 21 and the counter electrode 22.

As for the electrostatic precipitator 1 according to the example 6, the resin member forming the case 30 is not formed within about 5 mm (radius; r) of the leading end of the tooth 111.

The electricity is applied to the charger 10 and the counter electrode 12 and thus the air flows. A wind speed of the air flow direction is 1 m/s.

In this state, when a DC voltage of about 4 kV is applied between the high voltage electrode 11 and the counter electrode 12, ions are generated and then it is possible to charge the suspended particles.

Figure 19:
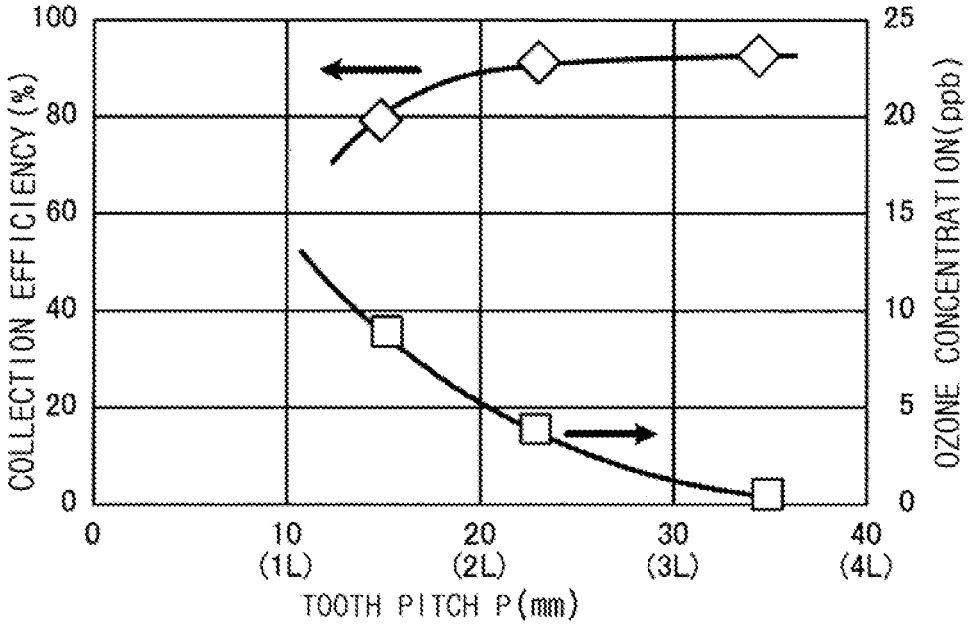
FIG. 19 is a graph illustrating the collection efficiency and the ozone concentration of the electrostatic precipitator about a pitch (P) of a tooth in a tooth row.

FIG. 19 is a graph illustrating the collection efficiency and the ozone concentration of the electrostatic precipitator 1 about the pitch (P) of the tooth 111 in the tooth row 113. The vertical axis in the left side in the drawing represents the collection efficiency (%) and the vertical axis in the right side represents the ozone concentration (ppb). The horizontal axis represents the pitch (P) of the tooth 111. The horizontal axis represents the pitch (P) of the tooth 111 with respect to the length (L) of the tooth 111.

The ozone concentration is obtained from an amount of ozone measured by an ozone concentration meter and an amount of air blowing into the ozone concentration meter. The collection efficiency is obtained by using a particle counter, wherein the particle counter counts the number of suspended particles in the upstream of the air flow direction (before entering the electrostatic precipitator 1) and the downstream of the air flow direction (after discharging from the electrostatic precipitator 1).

The collection efficiency and the ozone concentration are measured in a state in which the pitch (P) of the tooth 111 of the tooth row 113 is set as 1.5 mm (1.5 L), 22.5 mm (2.25 L), and 35 mm (3.5 L). A space (S) between leading ends of the tooth 111 between the tooth rows 113 is fixed to 20 mm (2 L).

As illustrated in FIG. 19, the collection efficiency is increased as the pitch (P) of the tooth 111 is large. When the pitch (P) of the tooth 111 is equal to or more that 2 L, the collection efficiency is equal to or more than 90%.

Meanwhile, the ozone concentration is reduced as the pitch (P) of the tooth 111 is large. The ozone concentration is equal to or less than 10 ppb in the measured range and it is sufficiently below the environment standard (0.05 ppm). When the pitch (P) of the tooth 111 is equal to or more than 2 L, the ozone concentration is equal to or less than 5 ppb, which detected by human.

Figure 20:
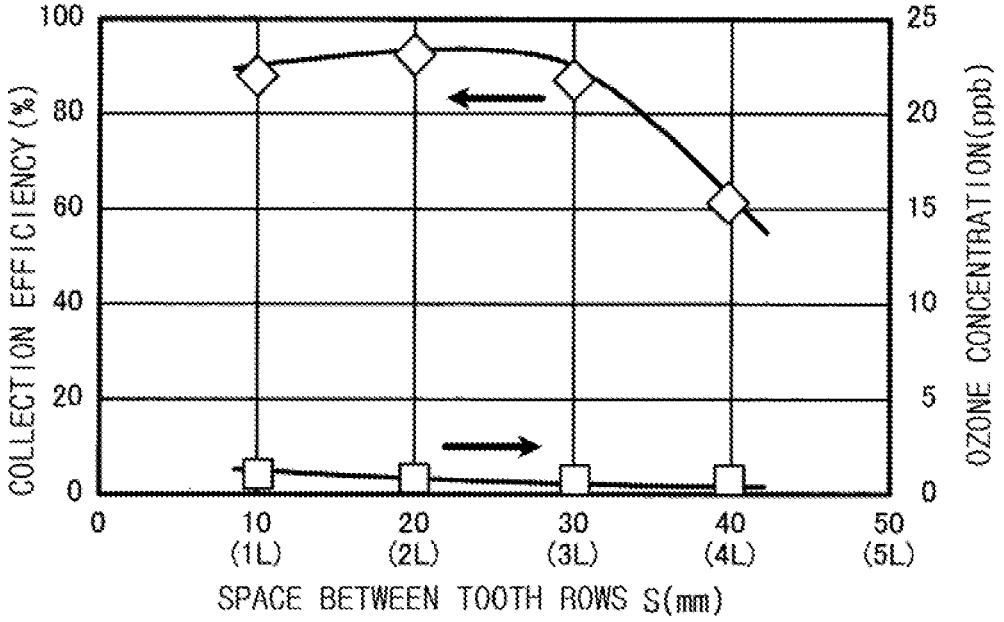
FIG. 20 is a graph illustrating the collection efficiency and the ozone concentration of the electrostatic precipitator about a space (S) between the tooth rows.

FIG. 20 is a graph illustrating the collection efficiency and the ozone concentration of the electrostatic precipitator 1 about the space (S) between the tooth rows 113. The vertical axis in the left side in the drawing represents the collection efficiency (%) and the vertical axis in the right side represents the ozone concentration (ppb). The horizontal axis represents the space (S) between the tooth rows 113. The horizontal axis indicates the space (S) between leading ends of the tooth 111 between the tooth rows with respect to the length (L) of the tooth 111.

The collection efficiency and the ozone concentration are measured in a state in which the space (S) between leading ends of the tooth 111 between the tooth row 113 is set as 10 mm (1 L), 20 mm (2 L), 30 mm (3 L), and 40 mm (4 L). A pitch (P) of the tooth 111 in the tooth row 113 is fixed to 35 mm (3.5 L).

As illustrated in FIG. 20, when the space (S) between the tooth rows 113 is equal to or less than 3 L, the collection efficiency is equal to or more than 90%. However, when the space (S) between the tooth rows 113 is more than 3 L, the collection efficiency is reduced.

The ozone concentration is reduced as the pitch (P) of the tooth 111 is large regardless of the space (S) between the tooth rows 113. In the measured range, the ozone concentration is equal to or less than 5 ppb, which detected by human.

(Discharge Area 13)

Figure 21A:
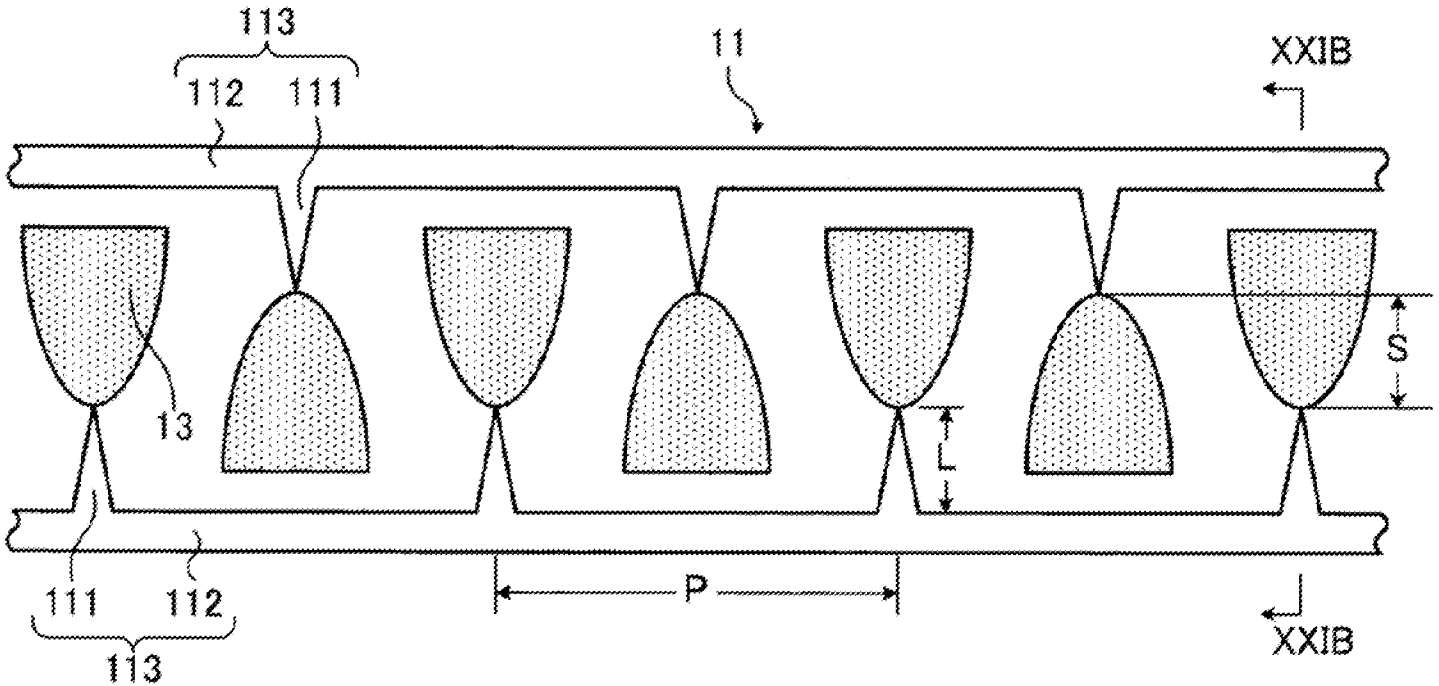
FIGS. 21A to 21D are views schematically illustrating a discharge in the charger, particularly.
Figure 21B:
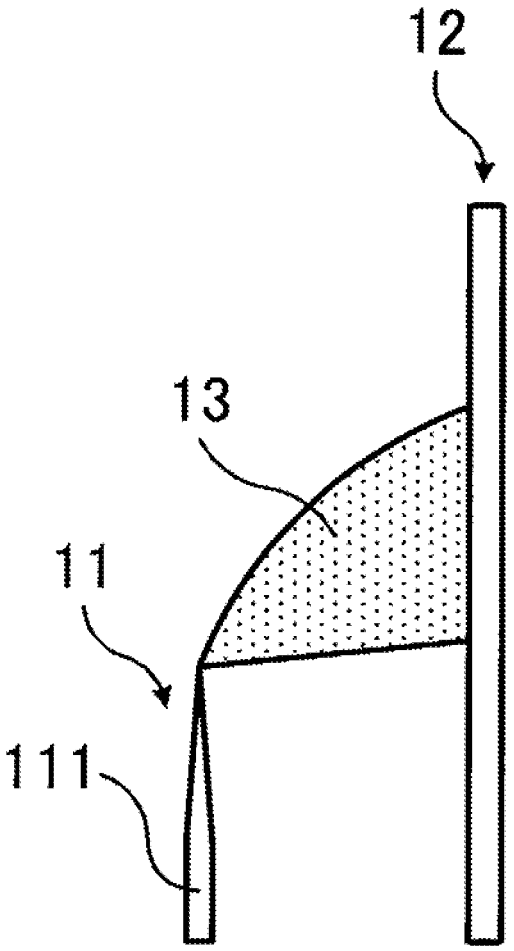
Figure 21C:
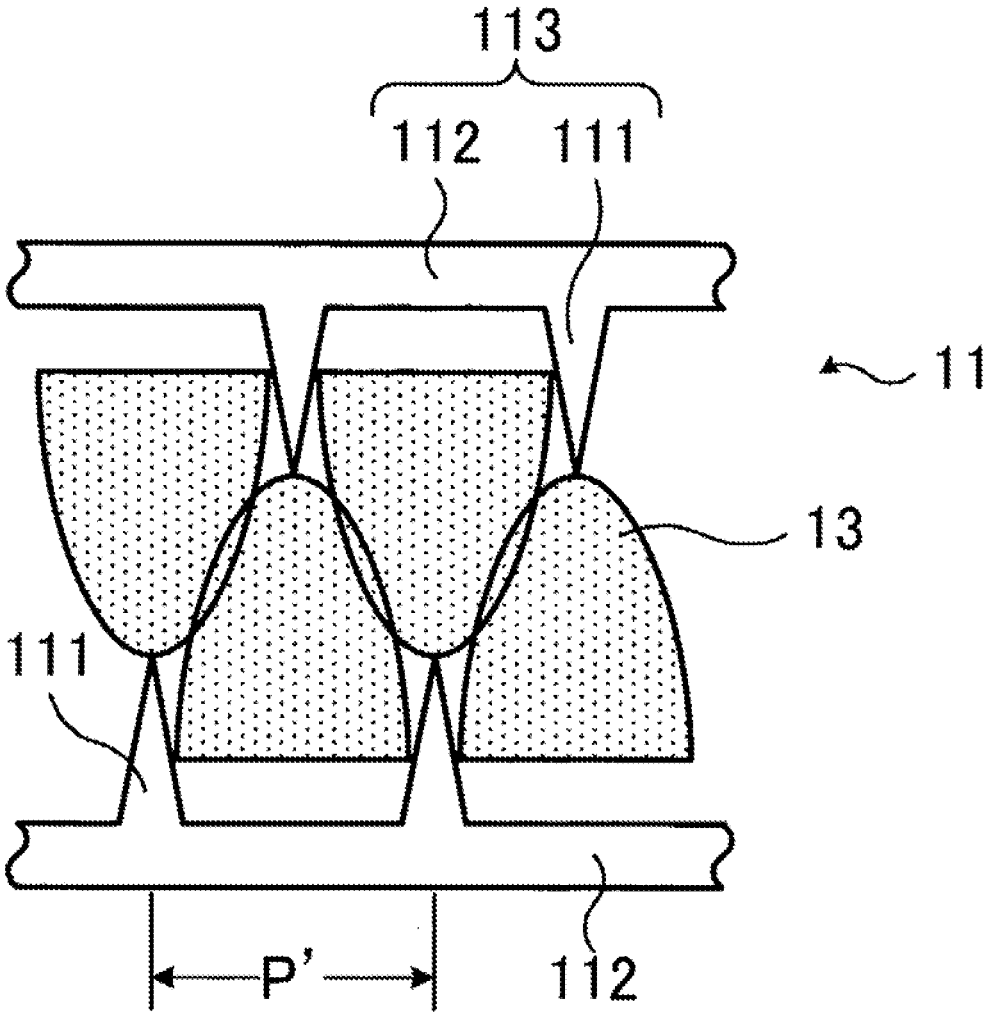
Figure 21D:
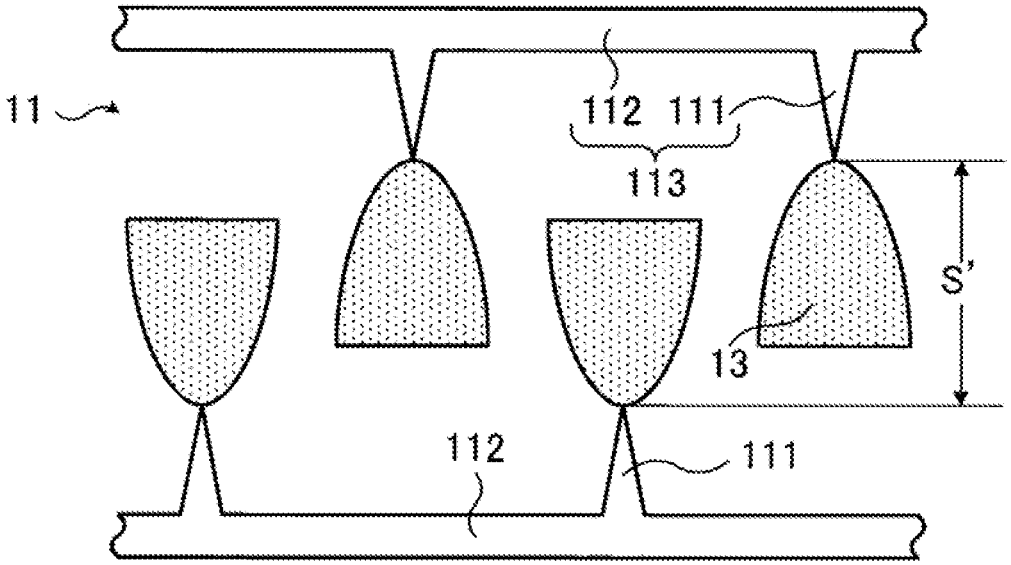

FIGS. 21A to 21D are views schematically illustrating a discharge in the charger 10. FIG. 21A is a top plane view when viewing from the high voltage electrode 11, FIG. 21B is a cross-sectional view taken along line XXIB-XXIB of FIG. 21A, FIG. 21C is a view illustrating a case in which the pitch (P) is P' that is narrower (smaller) than the pitch (P), and FIG. 21D is a view illustrating a case in which the space (S) is S' that is wider (larger) than the space (S).

As illustrated in FIGS. 21A and 21B, a discharge area 13 between the high voltage electrode 11 and the counter electrode 12 is wider from the leading end of the tooth 111 to the outside while diagonally moving to the counter electrode 12.

As illustrated in FIG. 18, the tooth 111 is arranged perpendicular to or inclined about the air flow direction (the counter electrode 12). Accordingly, it is impossible that a line of electric force is vertically directed to the counter electrode 12 from the leading end of the tooth 111. That is, the line of electric force becomes wider from the leading point of the tooth 111 to the outside that is far from the leading end, while diagonally moving to the counter electrode 12.

As illustrated in FIG. 21C, when the pitch of the tooth 111 in the tooth row 113 is set as the pitch (P') that is narrower (smaller) than the pitch (P) of FIG. 21A, the discharge area 13 of the tooth 111 is overlapped to a discharge area 13 of an adjacent tooth 111, and thus the interference may occur. Accordingly, as illustrated in FIG. 19, when the pitch (P) of the tooth 111 becomes small, the collection efficiency is reduced while the ozone concentration is increased.

As illustrated in FIG. 21D, when the space between the leading end of the tooth 111 between the tooth row 113 is set as the space (S') that is wider (larger) than the space (S) of FIG. 21A, a ratio of the discharge area 13 is reduced in the area of the high voltage electrode 11 (area in the direction perpendicular to the air flow direction). Accordingly, as illustrated in FIG. 20, when the space (S) between the tooth rows 113 becomes large, the collection efficiency is reduced.

As mentioned above, when the leading end of the tooth 111 is across each other in the direction of the tooth row 113, it is appropriate that the pitch (P) of the tooth 111 in the tooth row 113 is equal to or more than 2 L and the space (S) between the tooth rows 113 is equal to or less than 3 L.

As for the high voltage electrode 11, it is allowed that the tooth 111 is arranged as illustrated in FIG. 15B different from the FIG. 10A.

It is allowed that the tooth 111 illustrated in FIG. 10A is replaced with the needle 115 illustrated in FIG. 16B. In addition, it is allowed that the tooth 111 illustrated in FIG. 15B is replaced with the needle 115.

Even when the tooth 111 is replaced with the needle 115 and the length of the needle 115 is set as a length (L), it is possible to obtain the high collection efficiency while maintain the ozone concentration in the low level, by setting the pitch (P) of the needle 115 as 2 L or more and by setting the space (S) between the leading ends of the needle 115 between the needle row 117, as 3 L or less.

It is allowed that the counter electrode 12 is replaced with what mentioned so far.

As mentioned above, as for the electrostatic precipitator 1 to which the second embodiment is applied, the counter electrode 12 of the charger 10 is provided with the conductor 121 and the resistor 122 covering the surface of the conductor 121. Accordingly, the discharge current is suppressed to be smaller than that in the case where the resistor 122 is not formed and thus and the ozone concentration is suppressed to be low.

The high voltage electrode 11 of the charger 10 is fixed to the case 30 using the insulating spacer 32. The resin member forming the case 30 is not formed within a range of a predetermined distance (r) from the leading end of the tooth 111. In the counter electrode 12, the conductor exposed area 123 is electrically connected to the case 30 to be electrified. Accordingly, it is prevented that the case 30 is charged into the static electricity and thus the collection efficiency is improved.

As for the charger 10 of the electrostatic precipitator 1 to which the second embodiment is applied, the high voltage electrode 11 and the counter electrode 12 are disposed in the air flow direction. A portion configured to generate the discharge of the high voltage electrode 11 corresponds to the tooth 111, and the tooth 111 is disposed perpendicular to the air flow direction or diagonally disposed with respect to the air flow direction. Therefore, the distance (G) between the high voltage electrode 11 and the counter electrode 12 may be set to be short, e.g., about 5 mm. Accordingly, it may be possible to downsize the electrostatic precipitator 1.

The values illustrated in the second embodiment are merely an example and is not limited thereto.

A Third Embodiment

According to the second embodiment, as for the charger 10, the tooth 111 is arranged across each other between the tooth rows 113, with respect to the direction of the tooth row 113.

According to the third embodiment, the arrangement of the tooth 111 of the high voltage electrode 11 between the tooth rows 113 is different from that of the second embodiment. Hereinafter conditions for arranging the tooth 111 will be described.

Figure 22:
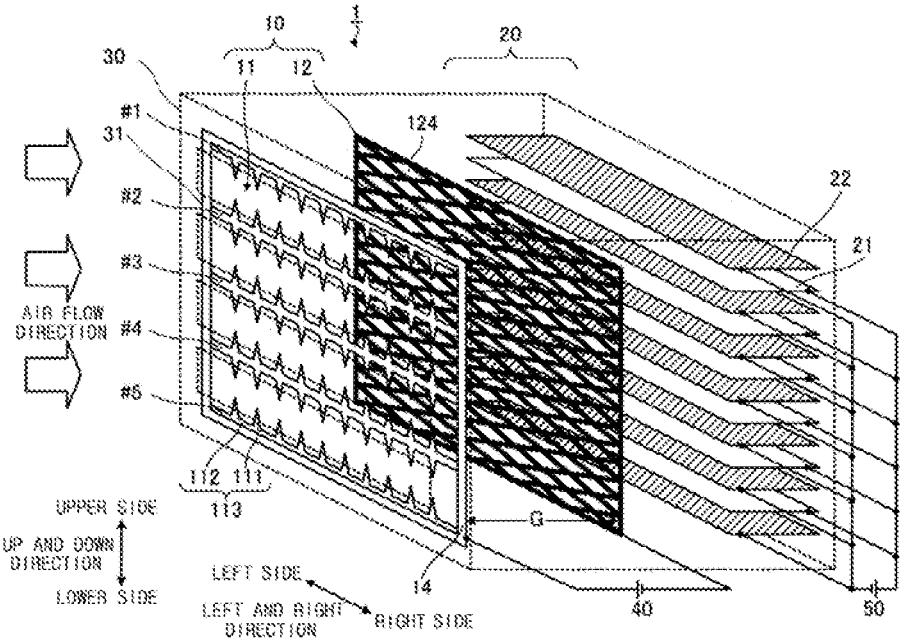
FIG. 22 is a view illustrating an example of an electrostatic precipitator in accordance with a third embodiment of the present disclosure.

FIG. 22 is a view illustrating an example of an electrostatic precipitator 1 in accordance with a third embodiment of the present disclosure. A case 30 is illustrated with a broken line and a configuration of a charger 10 and a dust collector 20 provided in the case 30 are shown.

Components similar with those in the first and second embodiment will have the same reference numerals and thus a description thereof will be omitted. However, different component will be described.

(Charger 10)

The charger 10 is provided with a high voltage electrode 11 and a counter electrode 12 facing the high voltage electrode 11.

The high voltage electrode 11 is provided with a plurality of the tooth rows 113 (#1 to #5 in FIG. 22) in which the plurality of the teeth 111 is provided. A longitudinal direction of the respective tooth row 113 is toward the right and left direction. The tooth row 113 in the most upper side (#1 in FIG. 22) is provided with the plurality of teeth 111 (10 teeth in FIG. 22) arranged toward the lower side. The tooth row 113 in the most lower side (#5 in FIG. 22) is provided with the plurality of teeth 111 (10 teeth in FIG. 22) arranged toward the upper side. The tooth row 113 (#2 to #4 in FIG. 22) is provided with the plurality of teeth 111 (10 teeth in FIG. 22) arranged toward the upper side and the plurality of teeth 111 (10 teeth in FIG. 22) arranged toward the lower side.

Between the adjacent tooth rows 113, the tooth 111 is formed such that the leading end thereof faces to each other.

As for the charger 10 according to the third embodiment, the high voltage electrode 11 is similar with that in FIG. 2A illustrated in the first embodiment.

The counter electrode 12 is similar with the counter electrode 12 according to the second embodiment. That is, as for the charger 10 according to the third embodiment, the counter electrode 12 is similar with FIG. 10B in the example 4 according to the first embodiment.

(Discharge Area 13)

Figure 23:
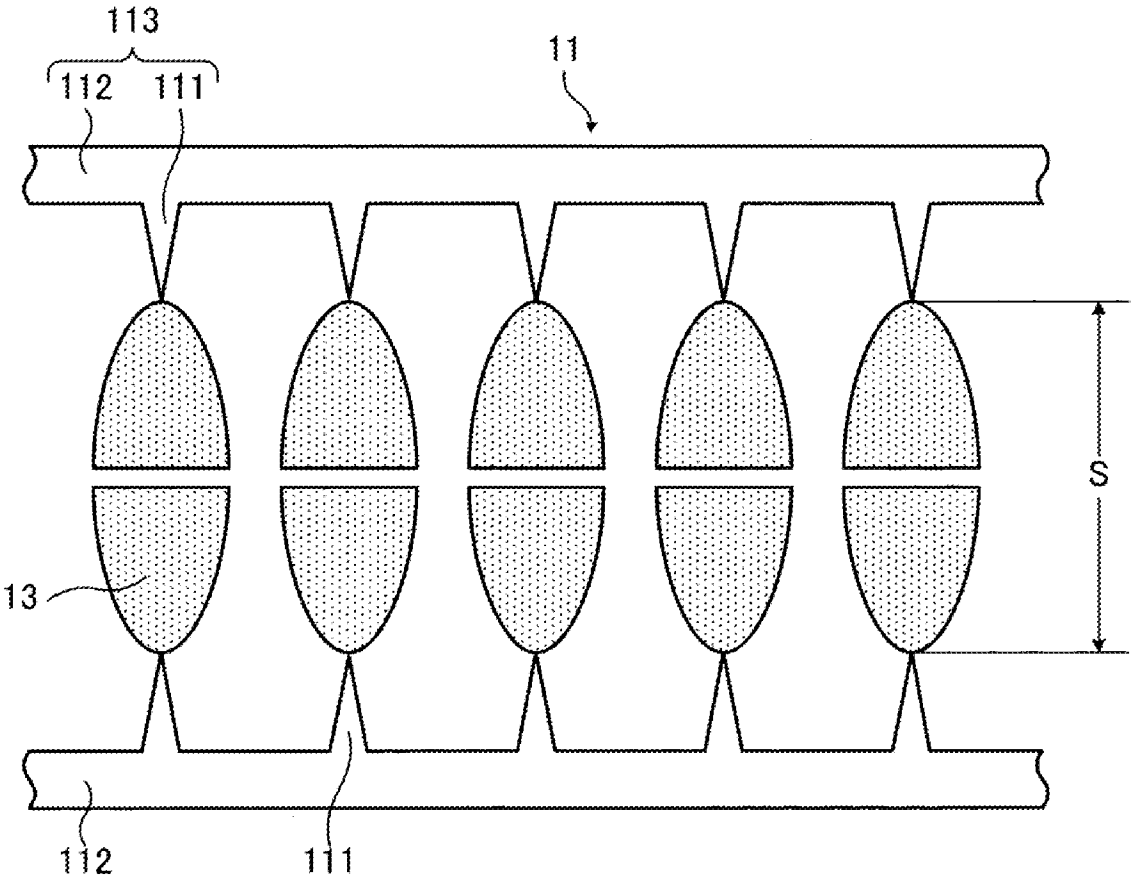
FIG. 23 is a view schematically illustrating a discharge in the charger.

FIG. 23 is a view schematically illustrating a discharge in the charger 10.

According to the third embodiment, as for the high voltage electrode 11 of the charger 10, the leading end of the tooth 111 faces to each other between the tooth rows 113. The discharge area 13 faces to each other between the tooth rows 113. Accordingly, when a space (S) between the tooth rows 113 is short (small), the discharge area 13 is overlapped with each other between the tooth 111 and the tooth 111 facing thereto.

Therefore, in a case in which the leading end of the tooth 111 faces to each other between the tooth rows 113, the space (S) between the leading ends of the tooth 111 is needed to be large between the tooth rows 113 in comparison with a case in which the leading end of the tooth 111 is arranged in a zigzag pattern between the tooth rows 113.

(Collection Efficiency and Ozone Concentration)

As similar with the electrostatic precipitator 1 according to the second embodiment, in the charger 10, the tooth 111 and the connecting portion 112 of the high voltage electrode 11 is formed by a plate-shaped stainless steel (SUS) having a thickness of 0.5 mm. A length (L) of the tooth 111 is about 10 mm. As illustrated in FIGS. 1 and 2A, five tooth rows 113 are provided.

In the charger 10, the conductor 121 of the counter electrode 12 is the expendable metal formed of the SUS having 4 mm×8 mm of the opening 124. The resistor 122 covering the surface of the conductor 121 is formed of polyimide resin having a thickness of about 50 μm. The polyimide resin has a relative dielectric constant of 3.3 and a volume resistivity of $10^{16}$ Ω·cm.

A distance (G) between the high voltage electrode 11 and the counter electrode 12 is about 5 mm.

The dust collector 20 according to the third embodiment is similar with the dust collector 20 according to the first embodiment.

The electricity is applied to the charger 10 and the counter electrode 12 and thus the air flows. A wind speed of the air flow direction is 1 m/s.

In this state, when a DC voltage of about 4 kV is applied between the high voltage electrode 11 and the counter electrode 12, ions are generated and then it is possible to charge the suspended particles.

The collection efficiency and the ozone concentration are measured in a state in which the space (S) between the leading ends of the tooth 111 between the tooth rows 113 is set as 50 mm (5 L), 60 mm (6 L), 70 mm (7 L), 80 mm (8 L), and 90 mm (9 L). A pitch (P) of the tooth 111 between the tooth rows 113 is fixed to 35 mm (3.5 L).

When the tooth 111 faces to each other between the tooth rows 113, it is appropriate that the space (S) between the leading ends of the tooth 111 is equal to or more than 6 L or equal to or less than 8 L between the tooth rows 113. In this range, the collection efficiency is equal to or more than 90% and the ozone concentration is equal to or less than 5 ppb, which detected by human.

When the space (S) between the leading end of the tooth 111 is less than 6 L, the electric fields interferes to each other between the tooth 111 facing to each other, and thus the discharge current easily flows. Therefore, the ozone concentration is increased.

When the space (S) between the leading ends of the tooth 111 is more than 8 L, a ratio of the discharge area 13 is reduced in the area of the high voltage electrode 11 and the collection efficiency is reduced.

The pitch (P) of the tooth 111 according to the direction of the tooth row 113 is similar with the first embodiment.

As for the high voltage electrode 11, it is allowed that the tooth 111 is arranged as illustrated in FIG. 15A that is different from the FIG. 2A.

It is allowed that the tooth 111 illustrated in FIG. 2A is replaced with the needle 115 illustrated in FIG. 16A. In addition, it is allowed that the tooth 111 illustrated in FIG. 15A is replaced with the needle 115.

Even when the tooth 111 is replaced with the needle 115 and the length of the needle 115 is set as a length (L), it is possible to obtain the high collection efficiency while maintain the ozone concentration in the low level, by setting the pitch (P) of the needle 115 as 2 L or more and by setting the space (S) between the leading ends of the needle 115 between the needle row 117, as 6 L or more and 8 L or less.

It is allowed that the counter electrode 12 is replaced with what mentioned so far.

As mentioned above, as for the electrostatic precipitator 1 to which the third embodiment is applied, the counter electrode 12 of the charger 10 is provided with the conductor 121 and the resistor 122 covering the surface of the conductor 121. Accordingly, the discharge current is suppressed to be smaller than that in the case where the resistor 122 is not formed, and the ozone concentration is suppressed to be low.

The high voltage electrode 11 of the charger 10 is fixed to the case 30 using the insulating spacer 32. The resin member forming the case 30 is not formed within a range of a predetermined distance (r) from the leading end of the tooth 111. In the counter electrode 12, the conductor exposed area 123 is electrically connected to the case 30 to be electrified. Accordingly, it is prevented that the case 30 is charged into the static electricity and thus the collection efficiency is improved.

As for the charger 10 of the electrostatic precipitator 1 to which the third embodiment is applied, the high voltage electrode 11 and the counter electrode 12 are disposed in the air flow direction. A portion configured to generate the discharge of the high voltage electrode 11 corresponds to the tooth 111, and the tooth 111 is disposed perpendicular to the air flow direction or diagonally disposed with respect to the air flow direction. Therefore, the distance (G) between the high voltage electrode 11 and the counter electrode 12 may be set to be short, e.g., about 5 mm. Accordingly, it may be possible to downsize the electrostatic precipitator 1.

The values illustrated in the third embodiment are merely an example and is not limited thereto.

A Fourth Embodiment

The fourth embodiment describes a current limit circuit preventing generation a current having a pulse shape caused by a random secondary electron emission from a high voltage electrode. The ozone generation is remarkable by generation of the current having a pulse shape caused by a random secondary electron emission from a high voltage electrode.

Figure 24:
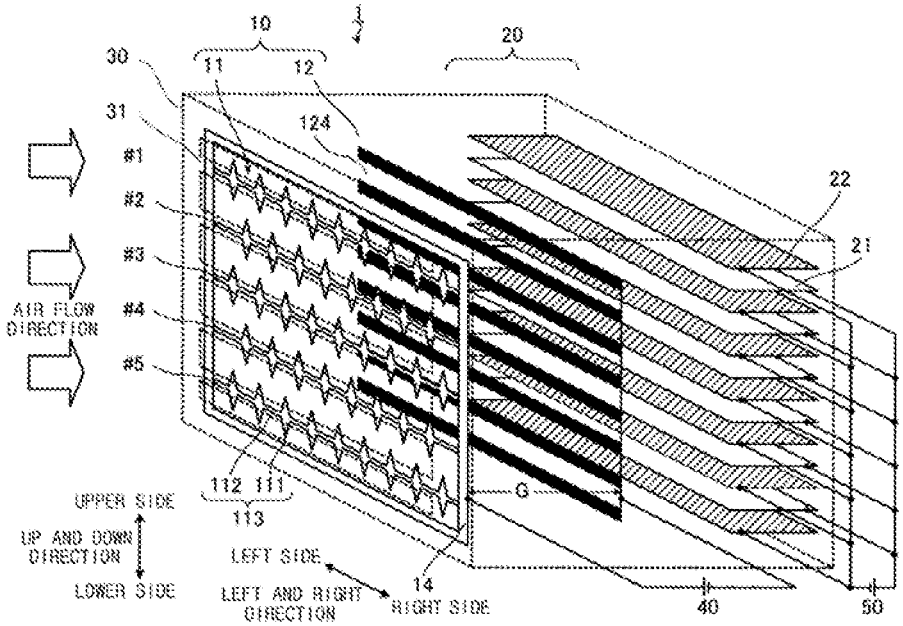
FIG. 24 is a view illustrating an example of an electrostatic precipitator in accordance with a fourth embodiment of the present disclosure.

FIG. 24 is a view illustrating an example of an electrostatic precipitator 1 in accordance with a fourth embodiment of the present disclosure. A case 30 is illustrated with a broken line and a configuration of a charger 10 and a dust collector 20 provided in the case 30 are shown.

Components of the electrostatic precipitator 1 similar with those in the first to third embodiment will have the same reference numerals and thus a description thereof will be omitted. However, different component will be described.

(A Charger 10)

The charger 10 is provided with a high voltage electrode 11 and a counter electrode 12 facing the high voltage electrode 11. The charger 10 and the counter electrode 12 face each other.

The high voltage electrode 11 is provided with a plurality of the tooth rows 113 (#1 to #5 in FIG. 24) in which the plurality of the teeth 111 having a pointed leading end is provided.

For example, the high voltage electrode 11 is provided with a plurality of tooth rows 113 (#1 to #5 in FIG. 24) in which a plurality of tooth shaped portions having a pointed leading end 111 (hereinafter referred to as "tooth" 111) is arranged. Each of the tooth rows 113 is arranged in the left and right direction. The tooth row 113 is provided with a plurality of teeth 111 arranged toward the upper side and a plurality of teeth 111 arranged toward the lower side.

The tooth 111 is arranged in a direction perpendicular to the air low direction. The tooth 111 is arranged such that the leading end thereof is across each other between the adjacent tooth rows 113, e.g., between #1 and #2 of the tooth row 113.

In FIG. 24, between the adjacent tooth rows 113, a leading end of the tooth 111 in the tooth row 113 in one side is arranged in the center of a leading end of the high voltage electrode 11 in the tooth row 113 in other side. That is, between the adjacent tooth rows 113, the leading end of the tooth 111 is arranged in a zigzag pattern.

It is allowed that the tooth 111 is arranged in the inclined direction with respect to the air flow direction. That is, the tooth 111 is formed in a direction perpendicular to the air flow direction.

The plurality of the teeth 111 in the tooth row 113 may be connected to a connecting portion 112. An end portion of each of the connecting portion 112 is connected to a wiring 17 formed in the circuit board 15 described later (refer to FIG. 26 described later). The wiring 17 is connected to a high voltage terminal 18 and an anode (high voltage supply terminal) of a high voltage generating circuit 40.

The plurality of the teeth 111 and the connecting portion 112 is integrally formed of a conductive material. The plurality of the teeth 111 and the connecting portion 112 is integrally indicated by the tooth row 113.

The tooth row 113 and the circuit board 15 are fixed to the supporting portion 14. It is allowed that the supporting portion 14 is a portion of the case 30.

The number of the tooth row 113 and the number of the tooth 111 in the tooth row 113 is set as a predetermined number.

To secure the air flow, the counter electrode 12 is provided with a member (conductor) formed of a conductive material having a through-opening (hole) 124, and a member (resistor) configured to cover the conductive material and formed of a resistant material functioning as a resistance against the current. The conductor of the counter electrode 12 is connected to a cathode (reference voltage supply terminal) of the high voltage generating circuit 40 of the charger 10.

The reason of forming the resistor is to suppress the discharge current and the ozone generation. Therefore, characteristics, e.g., the volume resistivity of the member formed of the resistant material may be set in consideration of the relationship between the collection efficiency and the ozone concentration. For example, it is appropriate that the member forming the resistant material has a relative dielectric constant of equal to or more than 3, a volume resistivity of equal to more than $10^{14}$ Ω·cm and equal to less than $10^{18}$ Ω·cm. A resistance value in the thickness direction may change in accordance with the thickness of the resistor. Accordingly, a value of the discharge current may be set according to the thickness of the resistor.

It is allowed that the resistor is not provided.

In FIG. 24, the counter electrode 12 is formed with a plurality of rectangular plate-shaped members, which are arranged in parallel. A space between the plate-shaped members functions as the opening 124. A width (size) of the rectangular plate-shaped member and a size of the opening 124 is set in accordance with a discharge generated between the high voltage electrode 11.

A distance between 11 and the counter electrode 12 is G.

As for the charger 10 of the electrostatic precipitator 1, the high voltage electrode 11 is attached to the supporting portion 14 via an insulating spacer formed of an insulating material (the insulating spacer 32 as illustrated in FIG. 3). The supporting portion 14 is attached to the case 30. Meanwhile, it is allowed that the supporting portion 14 is a portion of the case 30. It is allowed that the supporting portion 14 is the insulating spacer.

The counter electrode 12 forms a conductor exposed area in which the conductor is exposed and the conductor exposed area is attached to the case 30 to be electrically connected thereto.

(Current Limit Circuit 16)

The ozone generation is remarkable by generation of the current having a pulse shape caused by the random secondary electron emission from the high voltage electrode.

According to the fourth embodiment, the charger 10 of the electrostatic precipitator 1 forms the current limit circuit 16 configured to limit a current having a pulse shape. Accordingly, the ozone generation is further suppressed.

Figure 25:
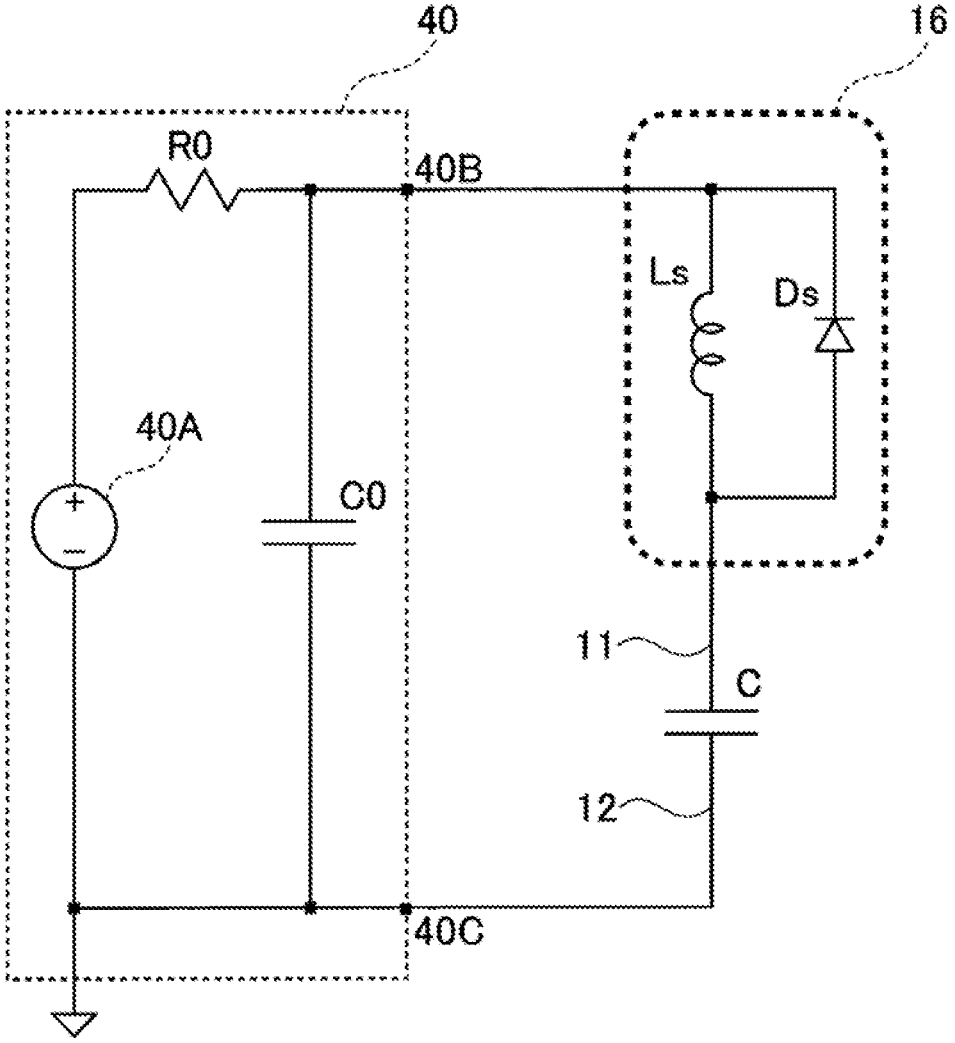
FIG. 25 is a view of an equivalent circuit about the charger of the electrostatic precipitator.

FIG. 25 is a view of an equivalent circuit about the charger 10 of the electrostatic precipitator 1.

A space (discharge space) in which the discharge occurs between the high voltage electrode 11 and the counter electrode 12 is replaced with a condenser (C). That is, one side terminal of the condenser (C) corresponds to the high voltage electrode 11 and the other terminal thereof corresponds to the counter electrode 12.

The current limit circuit 16 is formed in the side of the high voltage electrode 11 of the condenser (C).

The high voltage generating circuit 40 is provided with a voltage source 40A, a resistance R0, a condenser C0.

An anode of the voltage source 40A is connected to one terminal of the resistance R0. The other of the resistance R0 is connected to one terminal of the condenser C0. A cathode of the voltage source 40A is connected to the other terminal of the condenser C0. One terminal of the condenser C0 is connected to the anode 40B of the high voltage generating circuit 40 and the other terminal of the condenser C0 is connected to the cathode 40C of the high voltage generating circuit 40.

The resistance R0 limits the current from the high voltage generating circuit 40 and the condenser C0 stabilizes a high voltage DC (DC voltage) output from the high voltage generating circuit 40.

The current limit circuit 16 is provided with a parallel circuit of an inductor Ls and a diode Ds. One terminal of the parallel circuit of an inductor Ls and a diode Ds is connected to the anode 40B of the high voltage generating circuit 40 and the other thereof is connected to the cathode 40C of the high voltage generating circuit 40.

An anode of the diode Ds is connected to the high voltage electrode 11 and a cathode thereof is connected to the anode 40B of the high voltage generating circuit 40. That is, when in a normal state in which a potential of the anode 40B of the high voltage generating circuit 40 is higher (larger) than a potential of the high voltage electrode 11, the diode Ds is connected in a reverse direction in which the current does not flow.

An operation of the current limit circuit 16 will be described.

A voltage (inter-electrode voltage) between the high voltage electrode 11 and the counter electrode 12 varies according to a current flowing between the high voltage electrode 11 and the counter electrode 12. When the discharge is generated between the high voltage electrode 11 and the counter electrode 12, an electron generated by the discharge collides with the high voltage electrode 11 and thus the secondary electron is emitted. The amount of the secondary electron is changed according a discharge state. As the amount of the secondary electron is increased, the discharge current is more increased and the ozone generation is more increased.

Therefore, to suppress the ozone generation, it is required to prevent the discharge current that is increased according to the emission of the secondary electron. Accordingly, it is needed to lower the potential of the high voltage electrode 11 and to reduce the discharge current when the discharge current is increased. The discharge current that is increased caused by the emission of the secondary electron is a pulse-shaped current and the pulse-shaped current includes a high frequency component (high frequency current).

An impedance of the inductor Ls is increased by the high-frequency component, and thus the high-frequency current is limited by the inductor Ls.

According to the fourth embodiment, the charger 10 of the electrostatic precipitator 1 is provided with the current limit circuit 16 having the inductor Ls.

When the current does not flow in the inductor Ls, a counter electromotive force is generated to maintain a state in which the current flows. The counter electromotive force allows the potential of the high voltage electrode 11 to be higher (larger) than the potential of the anode 40B of the high voltage generating circuit 40. Therefore, the inter-electrode voltage between the high voltage electrode 11 and the counter electrode 12 becomes higher (larger) than a predetermined voltage. The discharge current becomes great and the ozone generation is increased.

The current limit circuit 16 is provided with a diode Ds connected in parallel with the inductor Ls. As mentioned above, the diode Ds is connected in a direction in which the current flows (forward direction) with respect to the counter electromotive force direction. Therefore, the diode Ds functions to remove the counter electromotive force generated in the inductor Ls.

When in the normal state in which a DC or a low frequency component current flows, the impedance of the inductor Ls is small. When in the normal state, the inductor Ls does not affect the operation of the charger 10.

When the counter electromotive force is not generated by the inductor Ls, i.e., in the normal state in which the potential of the anode 40B of the high voltage generating circuit 40 is higher (larger) than the potential of the high voltage electrode 11, the diode Ds is connected in the reverse direction. Therefore, when in the normal state, the diode Ds does not affect the operation of the charger 10.

As mentioned above, as for the current limit circuit 16, the inductor Ls limits the pulse-shaped current generated according to the emission of the secondary electron. The diode Ds connected in parallel to the inductor Ls limits the increase of the inter electrode voltage generated by the counter electromotive force by the inductor Ls. Accordingly, as for the charger 10, it is possible to prevent the increase in the ozone generation caused by the pulse-shaped current.

A detail operation of the current limit circuit 16 will be described.

An Example 7

Figure 26:
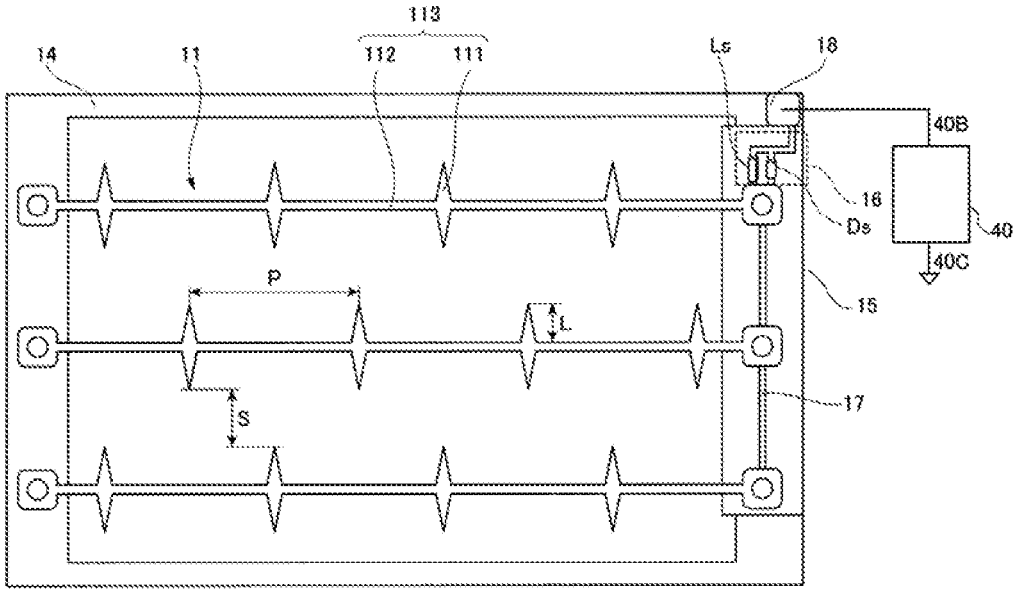
FIG. 26 is a view illustrating an example of the high voltage electrode to which the current limit circuit having a parallel circuit of an inductor Ls and a diode Ds is connected.

FIG. 26 is a view illustrating an example of the high voltage electrode 11 to which the current limit circuit 16 provided with a parallel circuit of an inductor Ls and a diode Ds is connected. FIG. 26 also illustrates the high voltage generating circuit 40. The electrostatic precipitator 1 provided with the high voltage electrode 11 having the current limit circuit 16 is indicated by the example 7.

The number of the tooth 111 and the tooth row 113 is simplified in the description.

The high voltage generating circuit 40 generates a DC voltage of 4~7 kV.

As for the high voltage electrode 11, the plurality of the teeth 111 and the tooth row 113 to which the plurality of the teeth 111 is connected are formed of the plate shape SUS having a thickness of 0.5 mm.

In the circuit board 15, the current limit circuit 16 and the wiring 17 are formed. The plurality of the tooth rows 113 is connected to the wiring 17 on the circuit board 15. One terminal of the parallel circuit of the inductor Ls and the diode Ds forming the current limit circuit 16 is connected to the wiring 17. The other terminal of the parallel circuit is connected to a high voltage terminal 18. The high voltage terminal 18 is connected to the anode 40B of the high voltage generating circuit 40. Meanwhile, the diode Ds is connected to the direction as illustrated in FIG. 25.

A length (L) between the leading end of the tooth 111 to the connecting portion 112 is set as 10 mm, and a pitch (P) between the teeth 111 in the tooth row 113 is set as 34.6 mm. Between the adjacent tooth rows 113, a space (S) between the leading end of the tooth 111 in the vertical direction about the tooth row 113 is set as 30 mm.

As for the current limit circuit 16, the inductor Ls has 100 μH or more. A breakdown voltage of the diode Ds is 7 kV or more. It is allowed that a plurality of diodes is connected in series to make the breakdown voltage be 7 kr or more.

As for the counter electrode 12, the conductor provided with a plurality of rectangular plate-shaped members is formed of the SUS having a thickness of 10 mm. The resistor 122 is formed of polyimide resin having a thickness of 50 μm.

A distance between 11 and the counter electrode 12 is G.

A Comparative Example 3

An electrostatic precipitator 1 in the comparative example 3 to which the fourth embodiment is not applied, will be described.

The electrostatic precipitator 1 in the comparative example 3 is provided with a current limit circuit 16 having a resistance R1.

Figure 27:
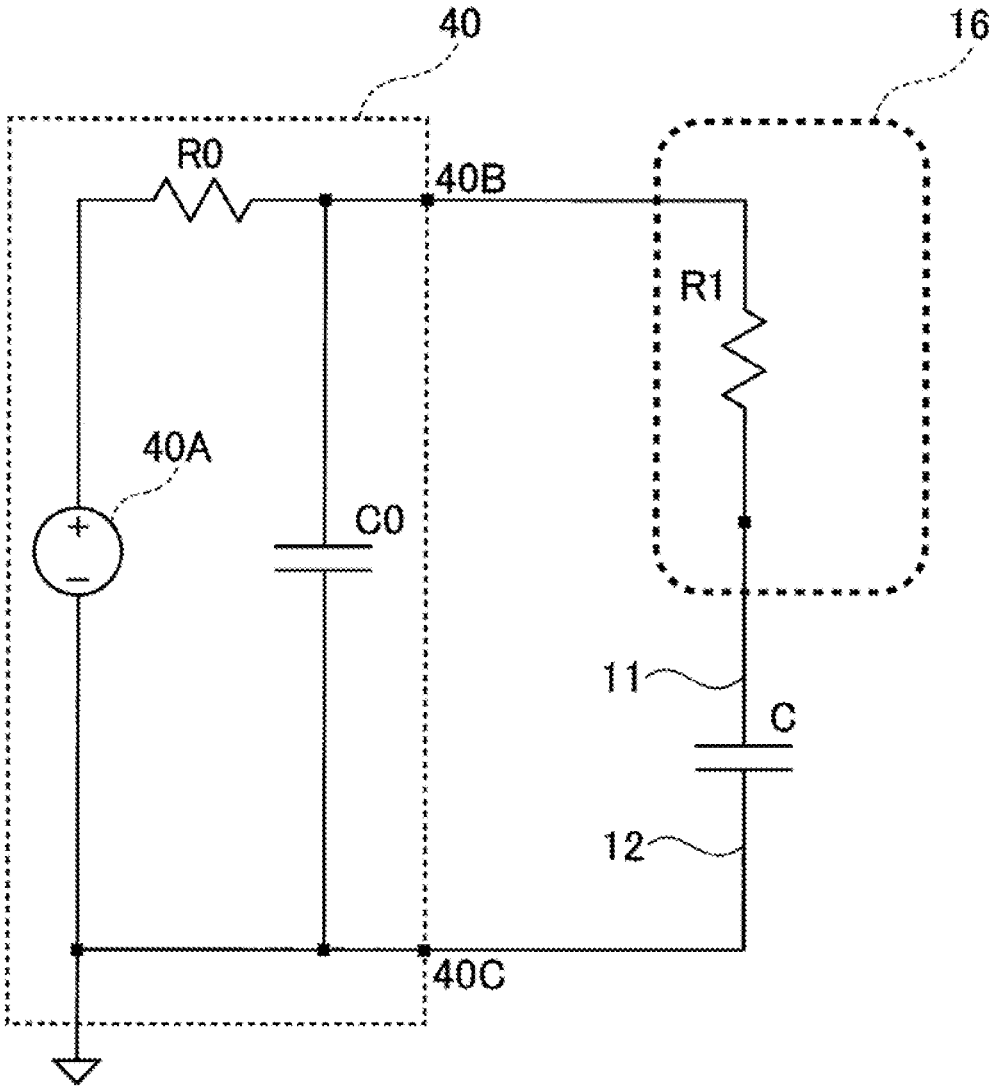
FIG. 27 is a view illustrating an equivalent circuit of the charger including the current limit circuit having a resistance.

FIG. 27 is a view illustrating an equivalent circuit of the charger 10, including the current limit circuit 16 having a resistance.

As illustrated in FIG. 27, as for the current limit circuit 16 of the charger 10, the parallel circuit of the inductor Ls and the diode Ds is replaced with a resistance R1. Components similar with those in FIG. 25 will have the same reference numerals and thus a description thereof will be omitted.

A resistance is set as 1 MΩ.

Comparison Between an Example 7 and the Comparative Example 3

The electrostatic precipitator 1 according to the example 7 and the electrostatic precipitator 1 according to the comparative example 3 are operated by applying the electricity to the charger 10 and the dust collector 20 of the electrostatic precipitator 1.

When a DC voltage of about 4 kV is applied to the charger 10 from the high voltage generating circuit 40, the ion generation is started and then it is possible to charge the suspended particles.

When a DC voltage of 5 kV or more is applied to the charger 10 from the high voltage generating circuit 40, the current having a pulse shape is generated caused by the emission of the secondary electron emission.

However, in any electrostatic precipitator 1 in the example 7 and the comparative example 3, the current limit circuit 16 is functioned and thus the ozone generation caused by the pulse-shaped current is limited.

Figure 28A:
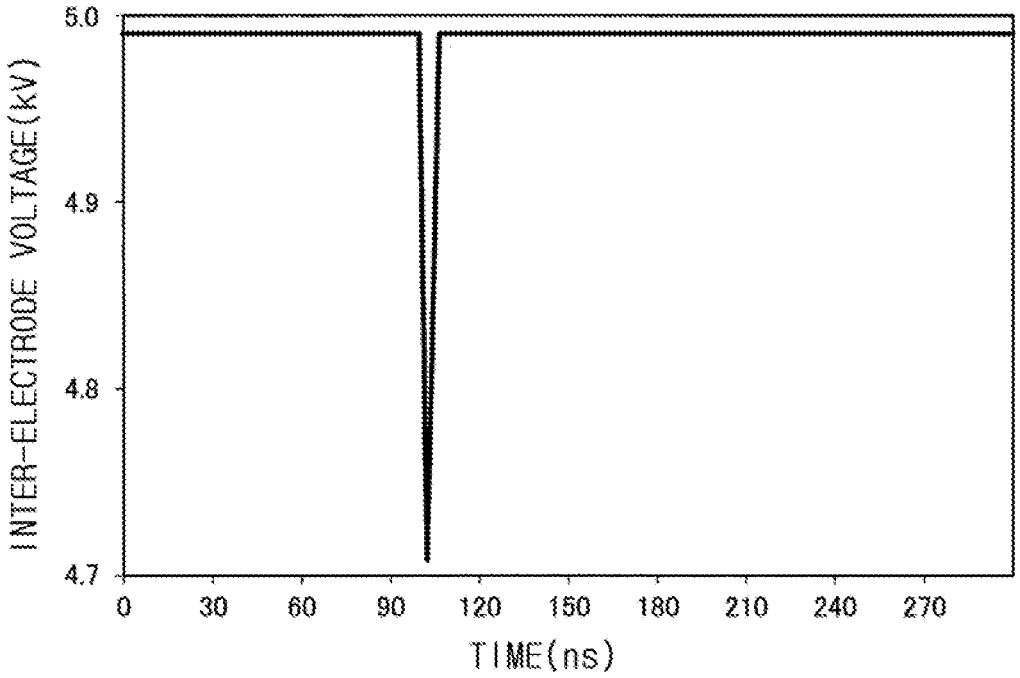
FIGS. 28A and 28B are graphs illustrating a time variation in the inter-electrode voltage in the charger of the electrostatic precipitator according to an example 7 and a comparative example 3, particularly.
Figure 28B:
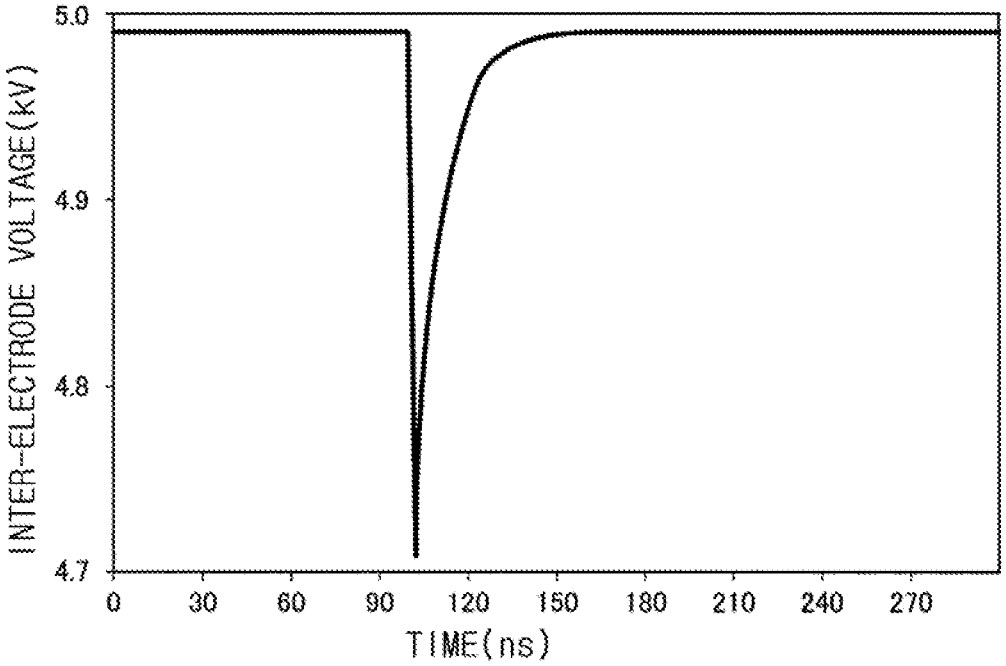

FIGS. 28A and 28B are graphs illustrating a time variation in the inter-electrode voltage in the charger 10 of the electrostatic precipitator 1 according to the example 7 and the comparative example 3. FIG. 28A illustrates the charger 10 of the electrostatic precipitator 1 according to the example 7, and FIG. 28B illustrates the charger 10 of the electrostatic precipitator 1 according to the comparative example 3. The horizontal axis represents a time (ns) and the vertical axis represents an inter-electrode voltage (kV).

As for the electrostatic precipitator 1 according to the example 7, when the pulse-shaped current caused by the emission of the secondary electron is generated around 100 ns, a voltage drop of about 270 v occurs. That is, the inductor Ls of the current limit circuit 16 is operated and then the inductor Ls reduces the potential of the high voltage electrode 11. When the pulse-shaped current is stopped, the high voltage electrode 11 returns to an original voltage within 10 ns.

In the inter-electrode voltage, a high voltage (overshoot) toward a high voltage side due to the counter electromotive force of the inductor Ls is not shown. This is because the counter electromotive force is removed by the diode Ds.

Meanwhile, as for the electrostatic precipitator 1 in the comparative example 3, when the pulse-shaped current caused by the emission of the secondary electron is generated around 100 ns, a voltage drop of about 270 v occurs. That is, the resistance R1 of the current limit circuit 16 is operated and then the resistance R1 reduces the potential of the high voltage electrode 11. However, when the pulse-shaped current is stopped, the high voltage electrode 11 returns to an original voltage within 50 ns or more. This is because a time constant by the condenser (refer to the condenser C of FIG. 25) and the resistance R1 formed between the high voltage electrode 11 and the counter electrode 12 is large.

That is, in comparison with the resistance R1, the inductor Ls allows a period of time for returning to the original voltage to be short (small) since the impedance about a DC or a low frequency current is small.

Accordingly, a ratio of a period of time in which the electrostatic precipitator 1 performs the dust collecting is increased and thus it is possible to prevent the reduction of the collection efficiency.

When the high voltage generating circuit 40 supplies a DC voltage of 4~7 kV, it is appropriate that the inductor Ls allows a potential drop of 200~300V.

Figure 29:
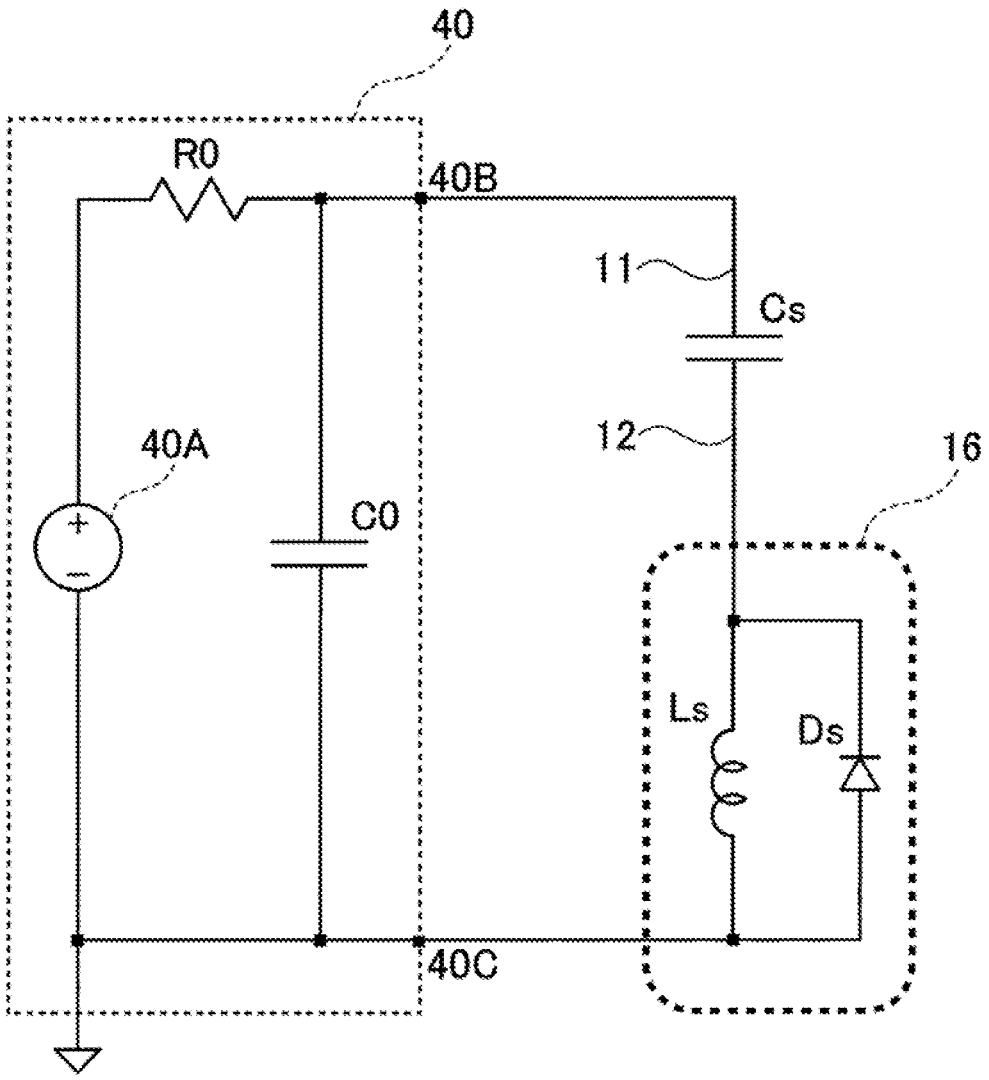
FIG. 29 is a view of another equivalent circuit about the charger having the current limit circuit.

FIG. 29 is a view of another equivalent circuit about the charger 10 provided with the current limit circuit 16.

FIG. 25 illustrates that the current limit circuit 16 is connected to a path of the high voltage electrode 11, but FIG. 29 illustrates that the current limit circuit 16 is connected to a path of the counter electrode 12.

Although the current limit circuit 16 is connected to the path of the counter electrode 12, the equivalent circuit is operated in the same manner as FIG. 25.

An Example 8

As for the charger 10 of the electrostatic precipitator 1 in the example 7, a single current limit circuit 16 is provided about the high voltage electrode 11. Alternatively, as for the charger 10 of the in the example 8, the current limit circuit 16 is provided in the tooth row 113 of the high voltage electrode 11, respectively.

Figure 30:
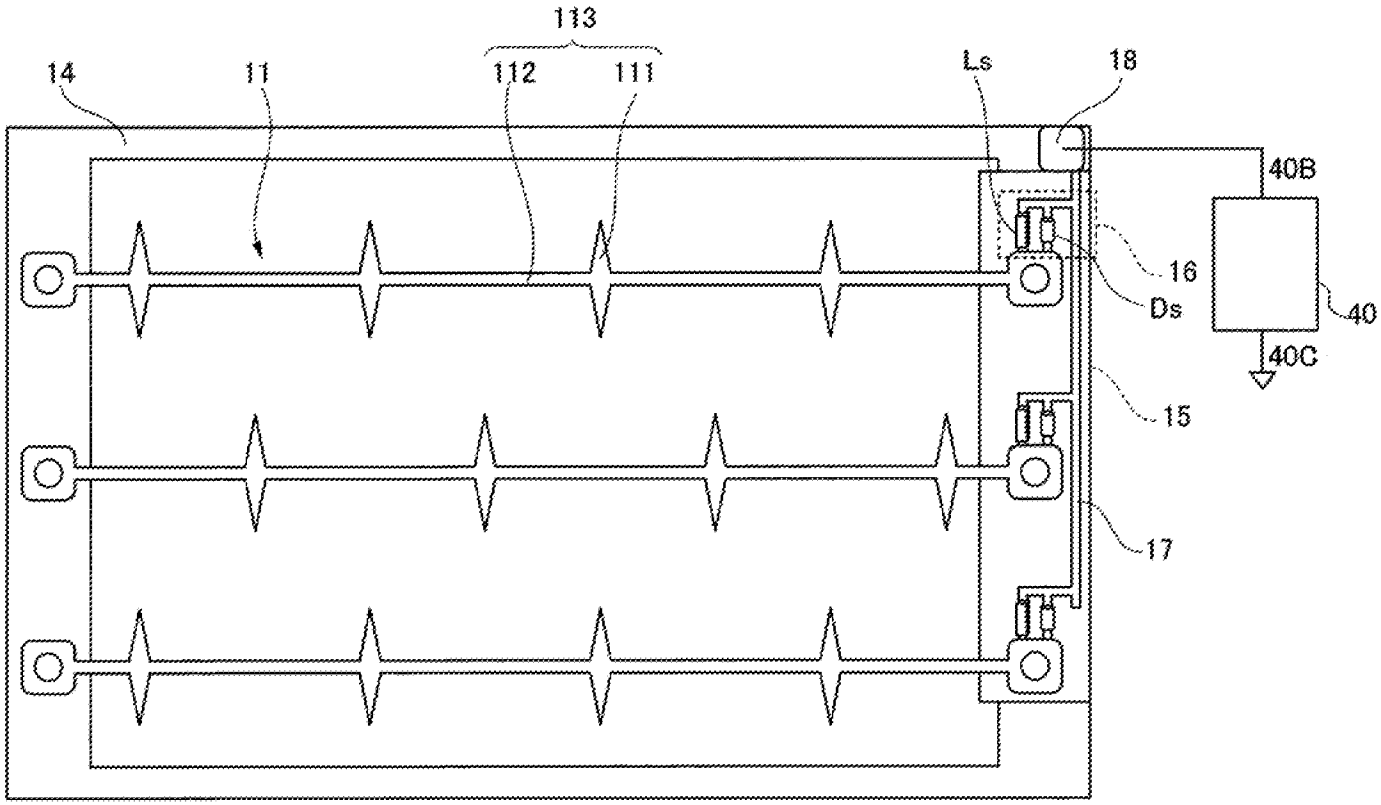
FIG. 30 is a view illustrating an example in which the current limit circuit is connected to each of the tooth row in the high voltage electrode of the charger in the electrostatic precipitator according to an example 8.

FIG. 30 is a view illustrating an example in which the current limit circuit 16 is connected to each of the tooth row 113 in the high voltage electrode 11 of the charger 10 in the electrostatic precipitator 1 according to the example 8.

The high voltage electrode 11 is provided with the plurality of the tooth rows 113. In the circuit board 15, the current limit circuit 16 provided with the parallel circuit of the inductor Ls and the diode Ds is formed to correspond to each the tooth row 113. Each the tooth row 113 is connected to the current limit circuit 16. The plurality of the current limit circuit 16 is connected to the wiring 17 connected to the high voltage terminal 18. The high voltage terminal 18 is connected to the anode 40B of the high voltage generating circuit 40.

That is, as for the electrostatic precipitator 1 in the example 8, the high voltage electrode 11 of the charger 10 is divided and the current limit circuit 16 is formed in the divided portion of the high voltage electrode 11. In this case, the tooth row 113 is an example of sub high voltage electrode which is the divided high voltage electrode 11.

As mentioned above, although in the single tooth row 113, a potential drop is generated due to the pulse-shaped current caused by the emission of the secondary electron, the potential drop is not generated in other tooth row 113.

That is, as illustrated in FIG. 28, the inter-electrode voltage drop (potential drop) is generated in the inductor Ls of the current limit circuit 16, and thus the inter electrode voltage drop (potential drop) does not affect the potential of the anode 40B of the high voltage generating circuit 40. Therefore, the other tooth row 113 is kept in the normal state. Accordingly, it is possible to prevent the reduction of the collection efficiency of the electrostatic precipitator 1.

Meanwhile, FIG. 30 illustrates that the current limit circuit 16 is formed in the tooth row 113, respectively, but alternatively, the current limit circuit 16 may be formed in a group of the tooth row 113 including the plurality of the tooth row 113.

An Example 9

As for the charger 10 of the electrostatic precipitator 1 according to the example 8, the current limit circuit 16 is formed in each of the plurality of the tooth row 113 of the high voltage electrode 11. As for the charger 10 of the electrostatic precipitator 1 according to the example 9, the current limit circuit 16 is formed in each of the plurality of the teeth 111 in the tooth row 113.

Figure 31:
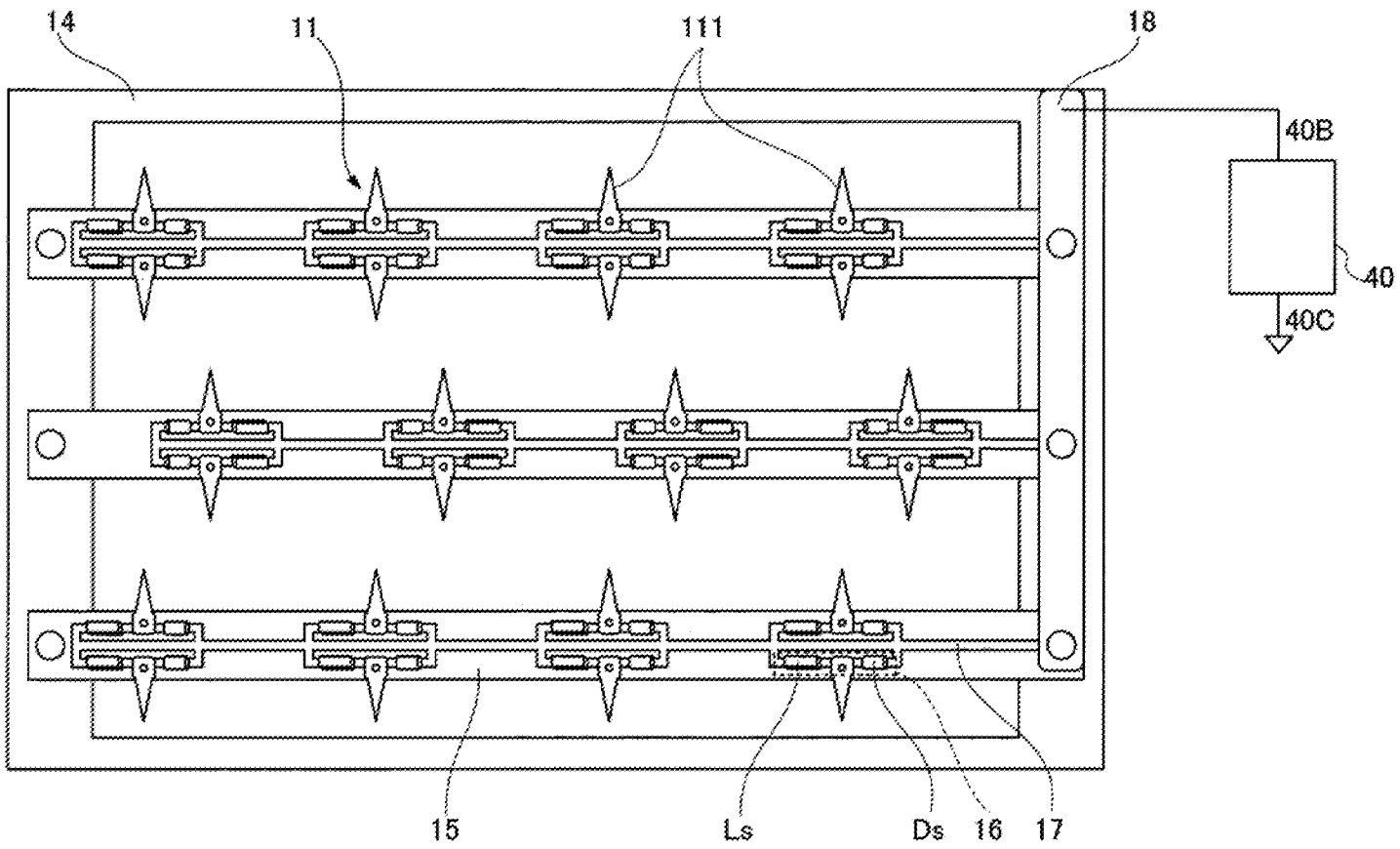
FIG. 31 is a view illustrating is a view illustrating an example of the high voltage electrode in which the current limit circuit is connected to each tooth in the charger of the electrostatic precipitator according to an example 9.

FIG. 31 is a view illustrating is a view illustrating an example of the high voltage electrode 11 in which the current limit circuit 16 is connected to each tooth 111 in the charger 10 of the electrostatic precipitator 1 according to the example 9.

The current limit circuit 16 is a parallel circuit of the inductor Ls and the diode Ds.

As illustrated in FIG. 31, the high voltage electrode 11 is provided with the plurality of the tooth rows 113 having the plurality of the teeth 111. A portion of the tooth 111 is indicated by the high voltage electrode 11.

As for the tooth row 113, the plurality of the teeth 111 is fixed to the circuit board 15 while being connected to the wiring 17 on the circuit board 15. The current limit circuit 16 formed in the circuit board 15 is connected to each the tooth 111. The current limit circuit 16 is provided with the parallel circuit of the inductor Ls and the diode Ds.

As for the plurality of the tooth rows 113, one end portion of the circuit board 15 is fixed to the high voltage terminal 18. The wiring 17 on the circuit board 15 is connected to the high voltage terminal 18. The high voltage terminal 18 is connected to the anode 40B of the high voltage generating circuit 40.

For example, the circuit board 15 is a base member of the PCB and a printed wiring may correspond the wiring 17. The high voltage terminal 18 is formed of a conductive material, e.g., a copper plate.

Accordingly, although in the single tooth 111, a potential drop is generated due to the pulse-shaped current caused by the emission of the secondary electron, the potential drop is not generated in other tooth 111. Therefore, the other tooth 111 is kept in the normal state. Accordingly, it is possible to prevent the reduction of the collection efficiency of the electrostatic precipitator 1.

That is, as for the electrostatic precipitator 1 according to the example 9, the high voltage electrode 11 of the charger 10 is divided and the current limit circuit 16 is formed in each of the divided portion, wherein the tooth 111 is another example of a sub high electrode that is divided from the high voltage electrode 11.

For example, the entire distance (D) of the tooth 111 may be 10 mm, a length (L) from the leading end of the tooth 111 to the circuit board 15 may be 5 mm, and a pitch (P) between the teeth 111 in the tooth row 113 may be 30 mm. A space (S) between the leading ends of the tooth 111 in the tooth row 113 may be 30 mm.

FIG. 31 illustrates that the current limit circuit 16 is formed in each the tooth 111, but alternatively the tooth 111 is grouped and the current limit circuit 16 is formed in each group.

According to the fourth embodiment, the high voltage electrode 11 is provided with the plurality of the tooth rows 113 having the plurality of the teeth 111. As for the high voltage electrode 11, the tooth 111 may be replaced with a needle having a pointed tip. As for the high voltage electrode 11, the tooth row 113 may be replaced with a linear wire formed of a conductive material.

It is allowed that the counter electrode 12 is replaced with what mentioned so far.

The values illustrated in the fourth embodiment are merely an example and is not limited thereto.

A Fifth Embodiment

According to the fourth embodiment, the current limit circuit 16 is provided with the parallel circuit of the inductor Ls and the diode Ds, and the current limit circuit 16 prevents generation a current having a pulse shape current caused by a random secondary electron emission from a high voltage electrode.

According to the fifth embodiment, the current limit circuit 16 is further provided with a circuit configured to prevent a short current when the high voltage electrode 11 and the counter electrode 12 is disconnected.

Other component is the similar with the component in the fourth embodiment and thus a description thereof will be omitted.

Figure 32:
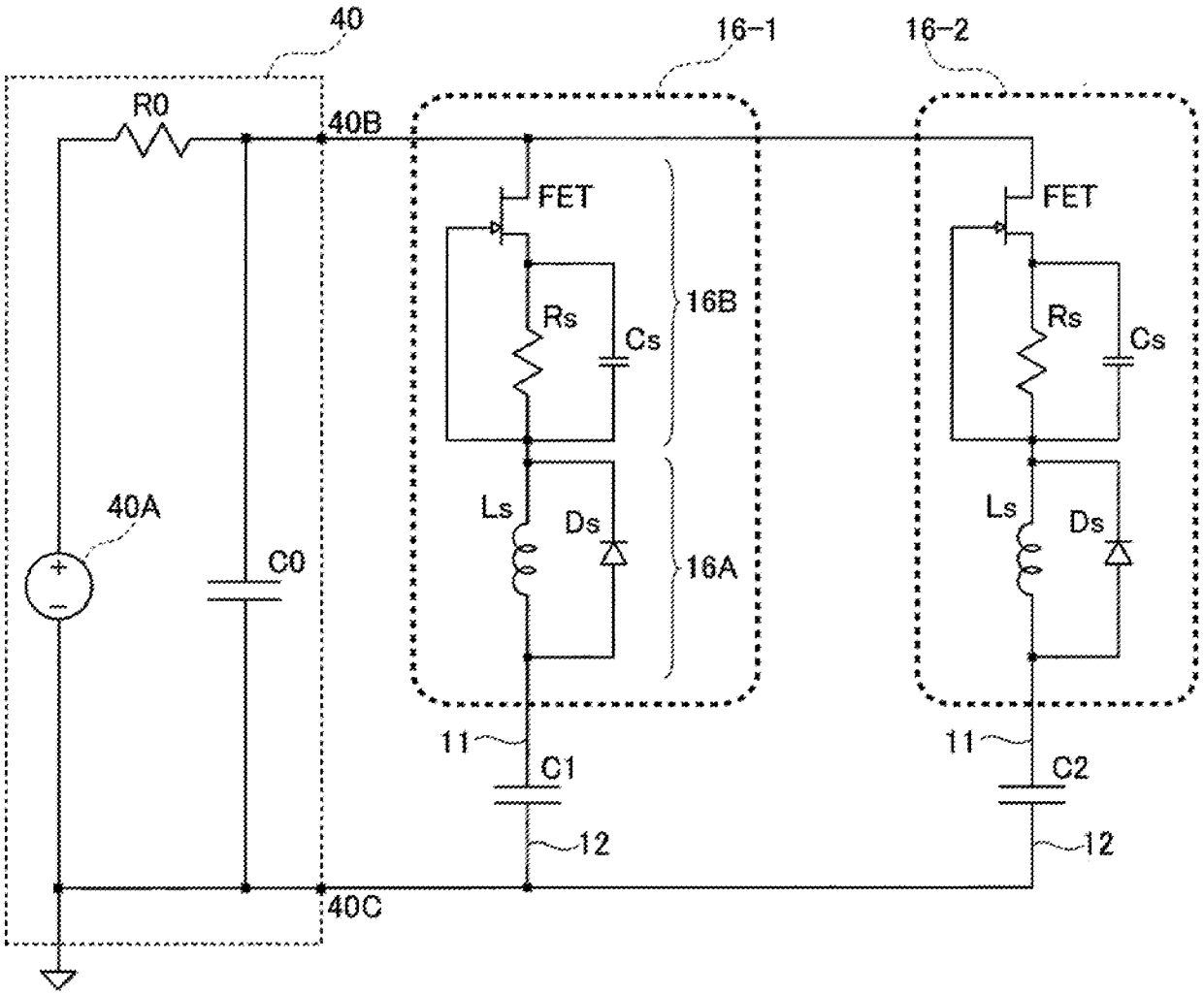
FIG. 32 is a view of an equivalent circuit about the charger of an electrostatic precipitator according to a fifth embodiment.

FIG. 32 is a view of an equivalent circuit about the charger 10 of an electrostatic precipitator 1 according to the fifth embodiment.

As illustrated in example 8 or 9, the high voltage electrode 11 is divided into a plurality of portions (the tooth row 113, and the tooth 111) and the current limit circuit 16 is formed in each portion. Two current limit circuits 16 (current limit circuit 16-1 and 16-2 in FIG. 32) is described. The current limit circuits 16-1 and 16-2 have the same configuration and thus when it does not required to distinguish the current limit circuit 16-1 and 16-2, the current limit circuit 16-1 and 16-2 will be referred to as the current limit circuit 16.

The current limit circuit 16-1 is connected to a condenser (C1) formed by substituting a space in which a discharge is generated (discharge space) and the current limit circuit 16-2 is connected to a condenser (C2) formed by substituting other discharge space. The component except for the current limit circuit 16 is the similar with the component of FIG. 25 according to the fourth embodiment. Therefore, the components similar with those in the fourth embodiment will have the same reference numerals and thus a description thereof will be omitted.

The current limit circuit 16 will be described using the current limit circuit 16-1. The current limit circuit 16 is provided with a secondary electron current limit section 16A and a short current limit section 16B. The secondary electron current limit section 16A corresponds to the parallel circuit of the inductor Ls and the diode Ds preventing the increase in the discharge current due to the pulse shaped current caused by the random secondary electron emission, which is described in the fourth embodiment.

The short current limit section 16B is provided with a field effect transistor (FET), a resistance (resistance element: Rs), and a condenser (Cs). A drain of the FET corresponds to one terminal of the short current limit section 16B. A source of the FET is connected to one terminal of the parallel circuit of the resistance (Rs) and the condenser (Cs). A gate of the FET is connected to the other terminal of the parallel circuit of the resistance (Rs) and the condenser (Cs). The gate of the FET and one terminal of the parallel circuit of the resistance (Rs) and the condenser (Cs) corresponds to one terminal of the short current limit section 16B. The resistance (Rs) is connected to between the source and the gate of the FET.

In the short current limit section 16B, the FET and the resistance (Rs) form a serial circuit.

The secondary electron current limit section 16A and the short current limit section 16B are connected in serial. FIG. 32 illustrates that one terminal of the short current limit section 16B (an anode side of the FET) is connected to the cathode 40B of the high voltage generating circuit 40. The other terminal of the short current limit section 16B (the gate side of the FET) is connected to one terminal (far from the condenser (C1)) of the parallel circuit of the inductor (Ls) and the diode (Ds) of the short current limit section 16B. The other terminal of (far from the condenser (C1)) of the parallel circuit of the inductor (Ls) and the diode (Ds) is connected to the high voltage electrode 11.

A n-type junction field effect transistor (JFET) that is normally on type JFET or a normally on type MOSFET may be used as the FET. As for the normally on type FET, a current flows between the source and the drain although a potential (gate voltage) about the source of the gate becomes the same (i.e. the gate voltage is 0V). By the potential (gate voltage), the conductivity between the source terminal and the drain terminal is changed. That is, as the gate voltage is increased, the conductivity is increased and the current flowing between the source and the drain is increased. As for the normally on type FET, as the potential of the gate is lowered than the potential of the source (i.e. the gate voltage becomes negative (−)), the current flowing between the source and the drain is reduced.

Hereinafter a motion of the current limit circuit 16 will be described.

The secondary electron current limit section 16A has been described in the fourth embodiment and thus the short current limit section 16B will be described.

A case in which a short circuit does not occur between the high voltage electrode 11 and the counter electrode 12 is referred to as "a normal state". In the normal state, the discharge current flows from the anode 40B of the high voltage generating circuit 40 to the cathode 40C of the high voltage generating circuit 40 by passing through the high voltage electrode 11, the condenser (C: discharge space), and the counter electrode 12.

Due to the potential drop of the resistance (Rs), the gate of the FET has a value slightly lower than the potential of the source. However, since the current value is small, the potential drop of the resistance (Rs) is small. Therefore, the discharge current continuously flows.

When the short circuit occurs between the high voltage electrode 11 and the counter electrode 12, i.e., a short circuit current greater than a discharge current in the normal state, flows, the large potential drop occurs by the resistance (Rs). Accordingly, the potential of the gate of the FET moves to the side which is lower than the potential of the source. Therefore, the conductivity of the FET is reduced and thus the current flowing the FET is reduced by which the short circuit current is limited.

In this time, in the condenser (Cs), a charge having a voltage corresponding to the potential drop caused by the resistance (Rs) is accumulated. That is, the condenser (Cs) maintains the potential of the gate.

The state in which the condenser (Cs) maintains the potential of the gate is maintained until the short circuit is eliminated.

When the short circuit is eliminated, the current flowing the resistance (Rs) is reduced and thus the potential drop caused by the resistance (Rs) is reduced. Accordingly, the charge accumulated in the condenser (Cs) that is connected in the parallel manner is consumed and the potential of the gate of the FET is similar to the potential of the source. Accordingly, the conductivity between the source and the drain of the FET is increased (enlarged) and the potential of the high voltage electrode 11 is increased to reach the value of the anode 40B of the high voltage generating circuit 40.

Meanwhile, since the current having a pulse shape caused by the secondary electron emission includes the high-frequency component, the current in the current limit circuit 16 flows to the high voltage electrode 11 by passing the FET condenser (Cs) and the inductor (Ls). Therefore, the resistance (Rs) has no effect on the pulse shaped current. That is, the secondary electron current limit section 16A is operated without the effect of the short current limit section 16B.

The resistance (Rs) leads the potential drop by the current flowing when the short circuit, and limits the conductivity of the FET. Therefore, it is allowed that the value of the resistance (Rs) is set by corresponding to the current, which is to flow when the short circuit.

Hereinafter the change in the voltage in the inter-electrode voltage in the electrostatic precipitator 1 (the electrostatic precipitator 1 in the example 10), which is provided with the charger 10 having the current limit circuit 16 as illustrated in the equivalent circuit of FIG. 32, will be described.

Figure 33:
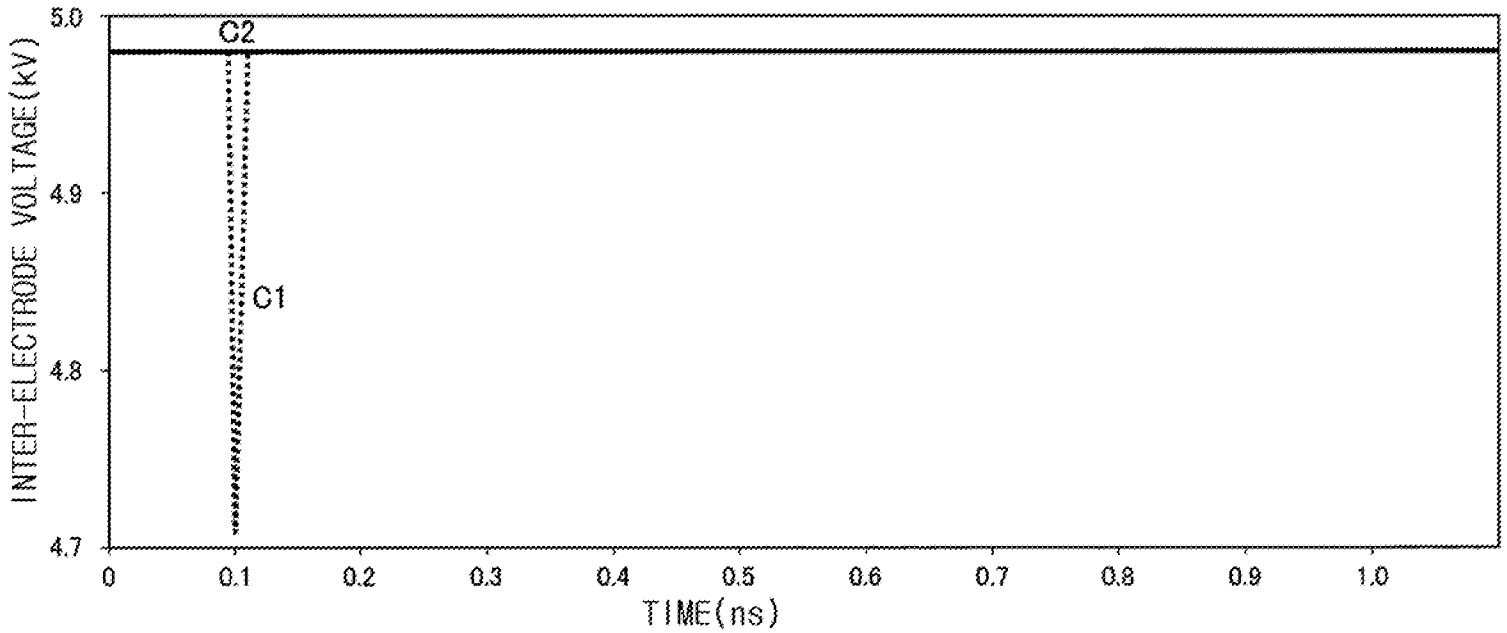
FIG. 33 is a view illustrating a time variation of the inter-electrode voltage in the charger of the electrostatic precipitator according to an example 10.

FIG. 33 is a view illustrating a time variation of the inter-electrode voltage in the charger 10 of the electrostatic precipitator 1 according to the example 10. The horizontal axis is time (u s), and the vertical axis is the inter-electrode voltage (kV). Time variation of the inter-electrode voltage in the charger 10 is obtained by simulation.

In the discharge space (corresponding to the condenser (C1)) in one side, the pulse-shaped current caused by the secondary electron emission is generated. As illustrated "C1" in FIG. 33, the inter-electrode voltage is lowered by about 270V by the inductor (Ls) of the current limit circuit 16.

However, in the discharge space (corresponding to the condenser (C2)) in the other side, as illustrated "C2" in FIG. 33, the inter-electrode voltage is not changed.

That is, although the pulse-shape current is generated by the secondary electron emission, the effect of the pulse-shape current has no effect on other discharge space. Therefore, it may be prevented that the collection efficiency of the electrostatic precipitator 1 is reduced by the pulse-shape current.

Figure 34:
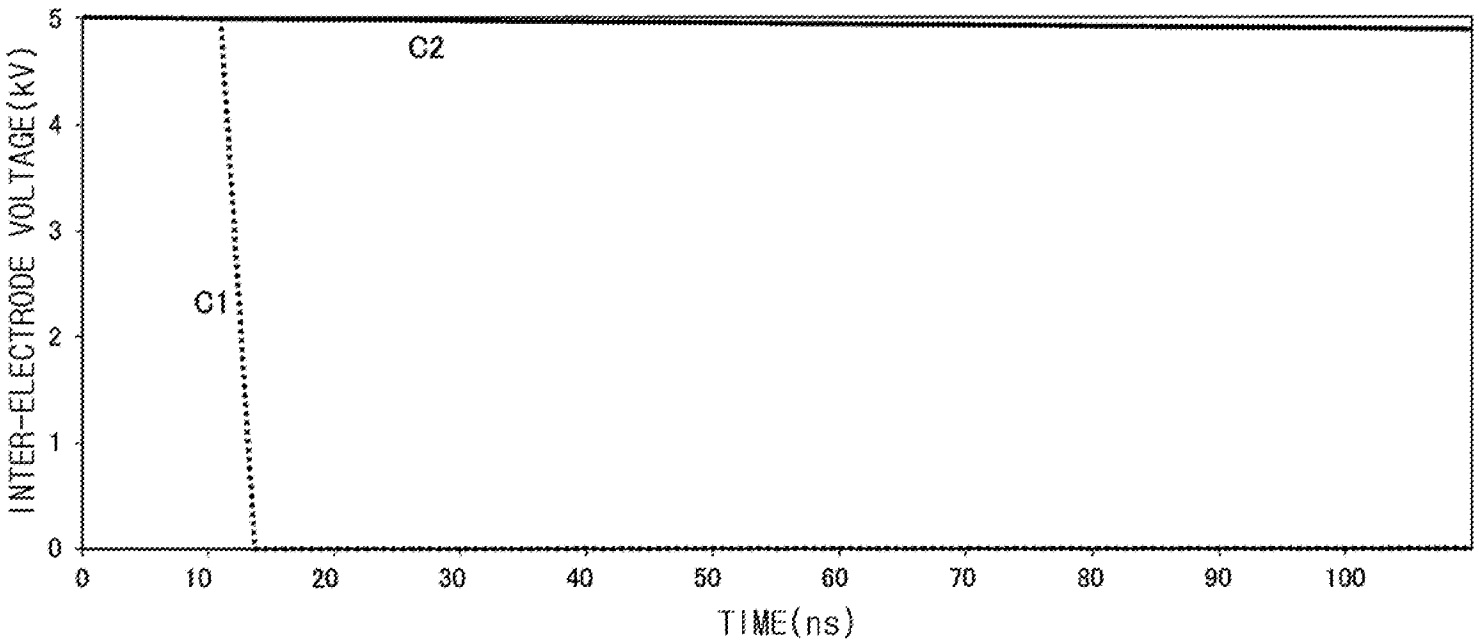
FIG. 34 is a view illustrating a time variation of the inter-electrode voltage caused by the short circuit, in the charger of the electrostatic precipitator according to the example 10.

FIG. 34 is a view illustrating a time variation of the inter-electrode voltage caused by the short circuit, in the charger 10 of the electrostatic precipitator 1. The horizontal axis is time (μs), and the vertical axis is the inter-electrode voltage (kV). Time variation of the inter-electrode voltage in the charger 10 is obtained by simulation.

In the discharge space (corresponding to the condenser (C1)) in one side, the short circuit occurs between the high voltage electrode 11 and the counter electrode 12. As illustrated "C2" in FIG. 34, the inter-electrode voltage is lowered to 0 (zero) V in the discharge space.

However, in the discharge space (corresponding to the condenser (C2)) in the other side, as illustrated "C2" in FIG. 34, the inter-electrode voltage is not changed.

That is, although the short circuit occurs in one discharge space, the effect of the short circuit has no effect on the other discharge space. It is possible that the electrostatic precipitator 1 is used although the short circuit occurs in one discharge space.

Figure 35:
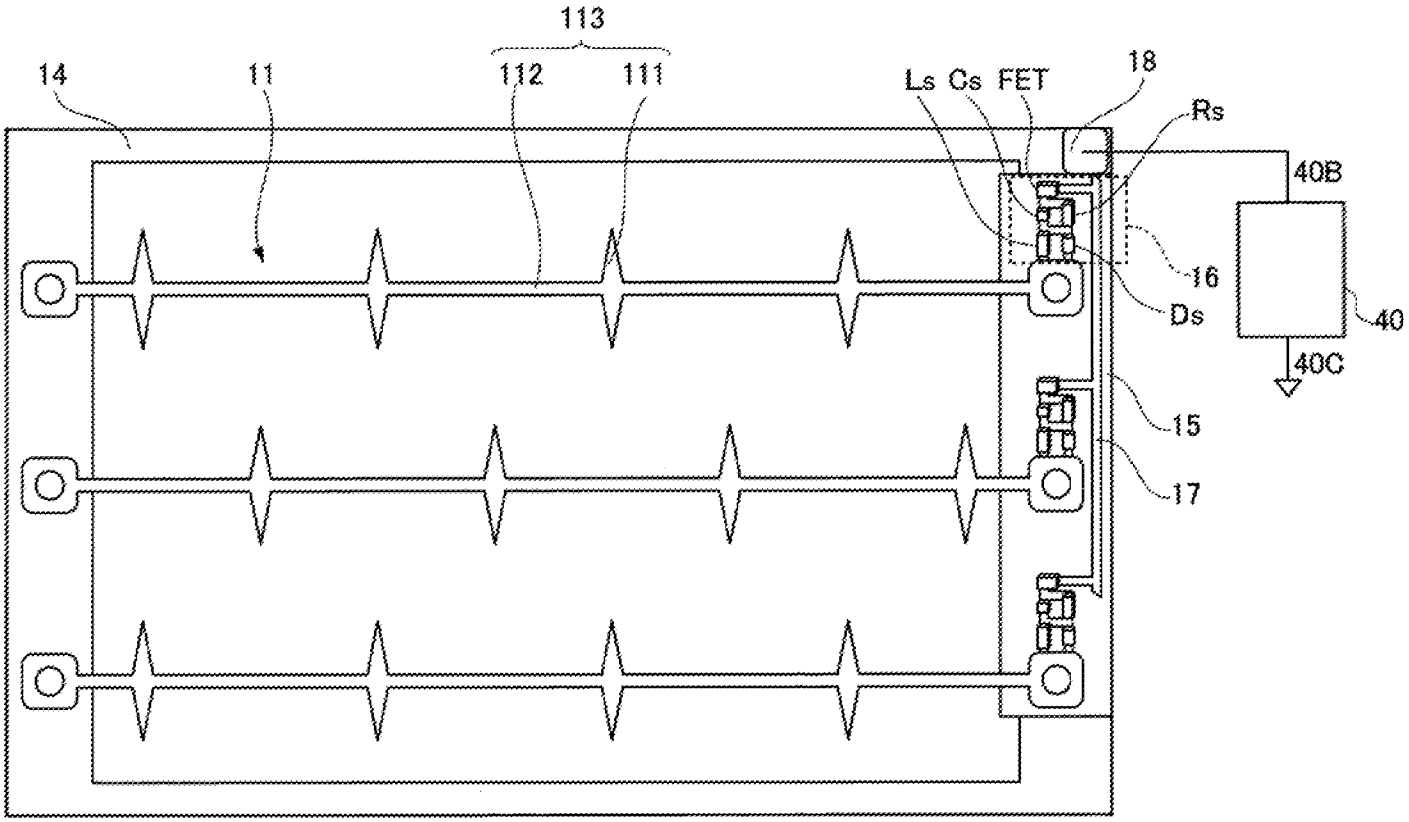
FIG. 35 is a view illustrating an example of the high voltage electrode to which the current limit circuit is connected.

FIG. 35 is a view illustrating an example of the high voltage electrode 11 to which the current limit circuit 16 is connected. In FIG. 35, the high voltage generating circuit 40 is also illustrated.

As illustrated in FIG. 35, the high voltage electrode 11 is provided with the plurality of the tooth rows 113 having the plurality of the teeth 111.

As the same as the example 8 according to the fourth embodiment, the plurality of the current limit circuit 16 corresponding to the plurality of the tooth row 113 is formed on the circuit board 15. Meanwhile, other component except for the current limit circuit 16 is similar with the example 8 according to the fourth embodiment and thus a description thereof will be omitted.

The current limit circuit 16 includes the secondary electron current limit section 16A provided with the inductor (Ls) and the diode (Ds); and the short current limit section 16B provided with the FET, the resistance (Rs) and the condenser (Cs).

Accordingly, it is prevented that the ozone generation is increased by the pulse shape current caused by the secondary electron emission, and although the short circuit occurs between the high voltage electrode 11 and the counter electrode 12, the operation of the electrostatic precipitator 1 is maintained. In addition, in a state in which the short circuit between the high voltage electrode 11 and the counter electrode 12 is temporarily, when the short circuit is eliminated, it is possible that the state returns to the original state and the operation of the electrostatic precipitator 1 is maintained.

Figure 36A:
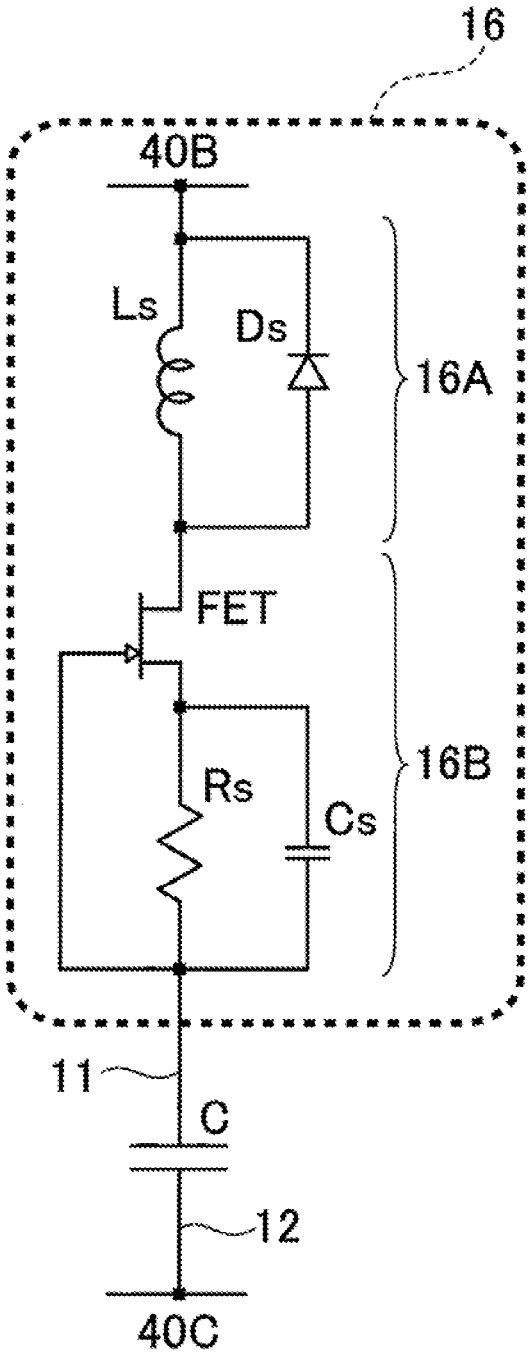
FIGS. 36A to 36C are views illustrating another equivalent circuit of the charger having the current limit circuit, particularly.
Figure 36B:
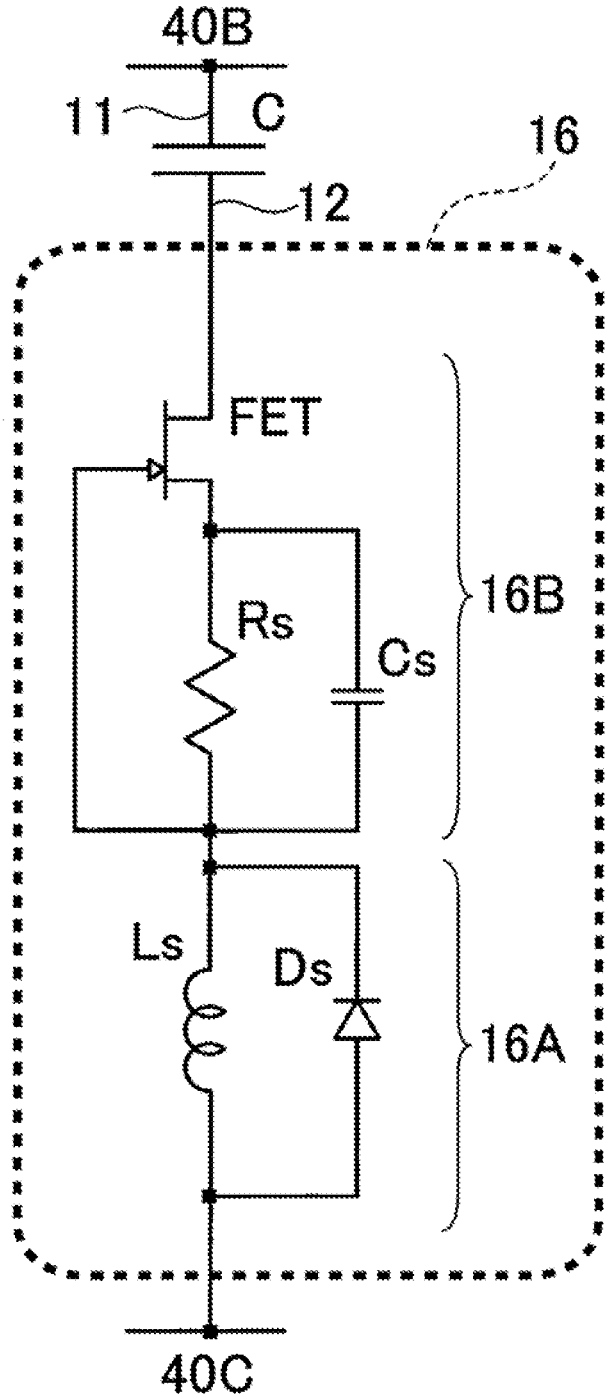
Figure 36C:
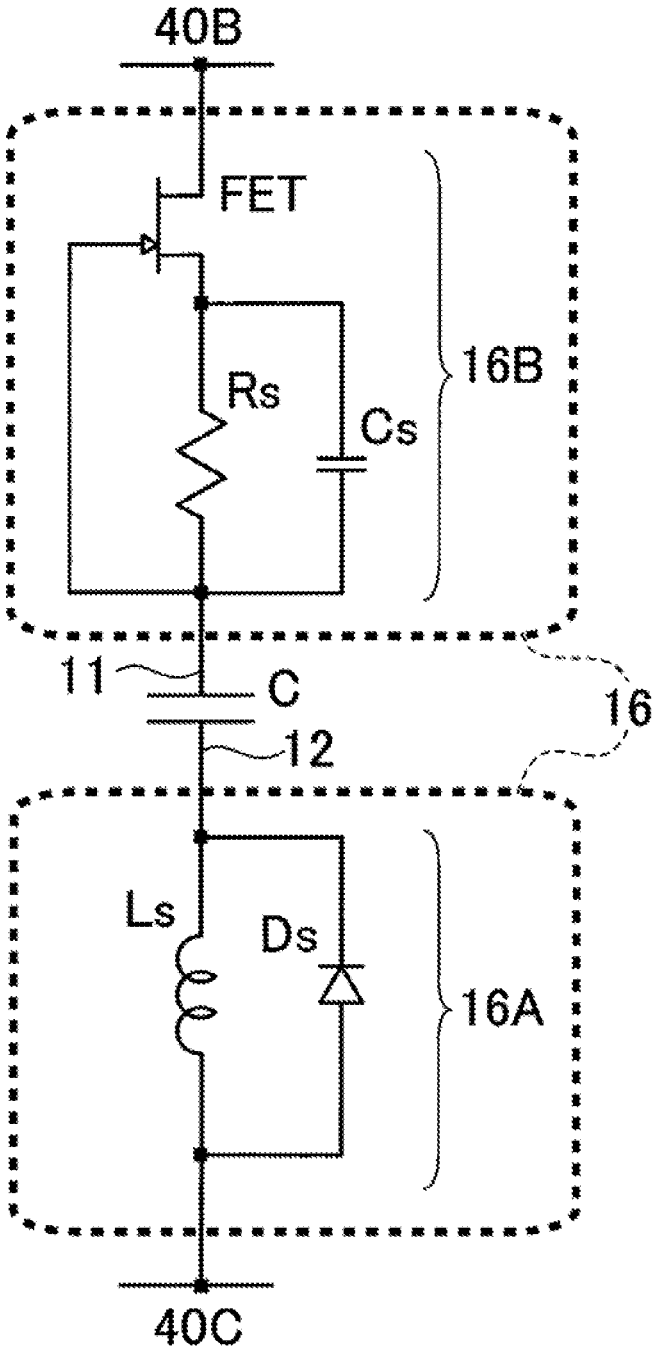

FIGS. 36A to 36C are views illustrating another equivalent circuit of the charger 10 having the current limit circuit 16. FIG. 36A illustrates that a connection order of the secondary electron current limit section 16A and the short current limit section 16B in the current limit circuit 16 of FIG. 32 is switched. FIG. 36B illustrates that the current limit circuit 16 is connected to the counter electrode 12. FIG. 36C illustrates that the high voltage electrode 11 and the counter electrode 12 are formed between the secondary electron current limit section 16A and the short current limit section 16B in the current limit circuit 16.

Meanwhile, in FIGS. 36A to 36C, the high voltage generating circuit 40 is omitted and a single discharge space is illustrated.

As illustrated in FIG. 36A, although the connection order of the secondary electron current limit section 16A and the short current limit section 16B in the current limit circuit 16 of FIG. 32 is switched, the current limit circuit 16 is operated as illustrated in FIG. 32.

As illustrated in FIG. 36B, the current limit circuit 16 is connected to the counter electrode 12, the current limit circuit 16 is operated as illustrated in FIG. 32. In this case, it is allowed that the position of the secondary electron current limit section 16A is switched to the position of the short current limit section 16B.

As illustrated in FIG. 24, when the counter electrode 12 is formed with a plurality of rectangular plate-shaped members, the current limit circuit 16 may be formed on each of the rectangular plate-shaped members. The rectangular plate-shaped member is an example of the sub counter electrode.

As illustrated in FIG. 36C, although the high voltage electrode 11 and the counter electrode 12 are formed between the secondary electron current limit section 16A and the short current limit section 16B in the current limit circuit 16, the current limit circuit 16 is operated as illustrated in FIG. 32. In this case, it is allowed that the position of the secondary electron current limit section 16A is switched to the position of the short current limit section 16B.

According to the fifth embodiment, as for the high voltage electrode 11, the tooth 111 may be replaced with a needle having a pointed tip. As for the high voltage electrode 11, the tooth row 113 may be replaced with a linear wire formed of a conductive material.

It is allowed that the counter electrode 12 is replaced with the counter electrode 12 which is mentioned so far.

A Sixth Embodiment

According to from the first embodiment to the fifth embodiment, as for the electrostatic precipitator 1, the counter electrode 12 of the charger 10 is provided with the conductor 121 and the resistor 122. The resistor 122 is configured to cover the conductor 121 facing the high voltage electrode 11. Accordingly, the discharge current between the high voltage electrode 11 and the counter electrode 12 is limited and thus the ozone concentration is prevented.

According to the sixth embodiment, the counter electrode 12 is further provided with an insulator 125 between the conductor 121 and the resistor 122.

A volume resistivity of the resistor 122 that is an example of the second member may be smaller than a volume resistivity of the insulator 125 that is an example of the first member.

Figure 37:
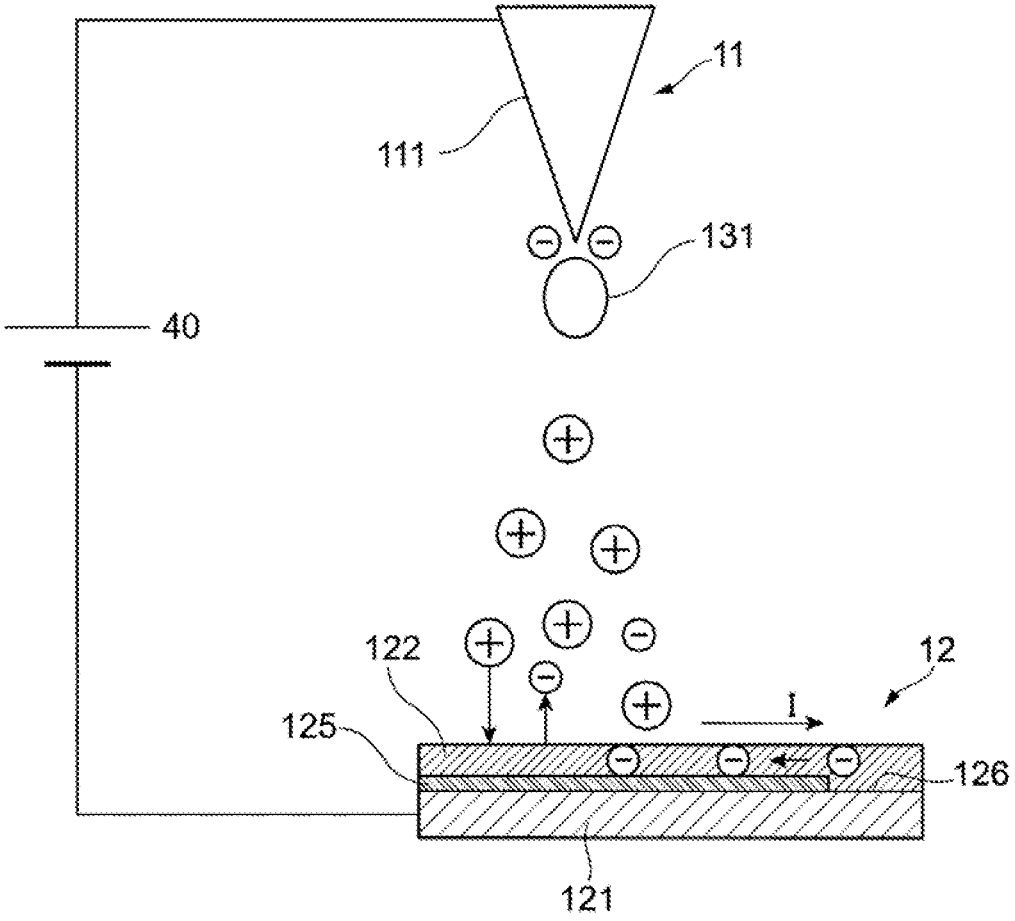
FIG. 37 is a schematic diagram illustrating a charger of an electrostatic precipitator according to a sixth embodiment.

FIG. 37 is a schematic diagram illustrating the charger 10 of the electrostatic precipitator 1 according to the sixth embodiment. The charger 10 is provided with the high voltage electrode 11 and the counter electrode 12 facing the high voltage electrode 11.

In FIG. 37, the high voltage electrode 11 is illustrated as the tooth 111 in which a leading end thereof is directed to the side of the counter electrode 12 (a lower side in the drawings). The high voltage electrode 11 is connected to the anode of the high voltage generating circuit 40.

The high voltage electrode 11 may be replaced with a wire formed of a conductive material or a needle having a pointed tip, as well as the tooth 111. In this case, the tooth 111 and the needle may be disposed to face the counter electrode 12 and disposed in parallel with the counter electrode 12.

The counter electrode 12 is formed such that the conductor 121, the insulator 125, and the resistor 122 are stacked in order. The conductor 121 and the resistor 122 are directly connected to each other in a predetermined connection region 126.

As for the counter electrode 12, the resistor 122 is directed to the high voltage electrode 11. The conductor 121 is connected to the cathode of the high voltage generating circuit 40.

A discharge generated between the high voltage electrode 11 and the counter electrode 12 will be described with reference to FIG. 37. As a voltage between the high voltage electrode 11 and the counter electrode 12 is increased by using the high voltage generating circuit 40, the corona discharge is generated from the vicinity of the leading end of the high voltage electrode 11. In this time, in the corona region 131 in the vicinity of the leading end of the high voltage electrode 11, the light emission may be detected.

The corona discharge is generated by the non-uniform electric field generated in the vicinity of the pointed leading end of the high voltage electrode 11. That is, when the voltage applied to the high voltage electrode 11 is increased, an electron (indicated by '−' on the drawings) is emitted from the pointed leading end of the high voltage electrode 11. The emitted electron is accelerated and then collided with the air molecules around the leading end. The air molecules are ionized and then positive and negative ions are generated.

Meanwhile, the positive and negative ions are attached to the suspended particle to charge the suspended particle.

However, the positive ions are attracted toward the counter electrode 12 and then collide with the counter electrode 12. In this time, electrons neutralizing the positive ions are supplied via the resistor 122. When the positive ions collide to the counter electrode 12, the counter electrode 12 emits the secondary electron.

That is, the current flowing between the high voltage electrode 11 and the counter electrode 12 is determined by the movement of the positive and negative ions generated such that the air molecules are ionized, and the secondary electron generated by the collision between electrons neutralizing the positive ions and the positive ions.

According to the sixth embodiment, the secondary electron, which is generated by the collision between electrons neutralizing the positive ions and the positive ions, flows the resistor 122 of the counter electrode 12 (current (I)). However, since the counter electrode 12 is provided with the insulator 125, the current (I) does not flow in a direction perpendicular to the thickness direction of the resistor 122, but flows in a transverse direction of the resistor 122 (the right direction in the drawings) as illustrated by an arrow in FIG. 37. The current (I) flows to the conductor 121 via the connection region 126.

The current (I) flowing the resistor 122 causes the voltage drop. The voltage applied between the high voltage electrode 11 and the counter electrode 12 is lowered (drop). Accordingly, the current of the corona discharge (discharge current) is limited and it is prevented that the corona discharge is changed to the arc discharge (spark).

Since the discharge current is limited, the ozone generation is suppressed. That is, the insulator 125 is disposed between the conductor 121 and the resistor 122 so that the ozone generation is minimized.

The current (I) is determined by the resistance in the transverse direction of the resistor 122. With respect to FIG. 37, a distance (length) from the left end to the connection region 126 in the right end in the transverse direction is set to be 100 times to 1000 times longer than a distance (width) in the vertical direction. Therefore, when a resistance having a predetermined resistance value is formed between the high voltage electrode 11 and the conductor 121 of the counter electrode 12 by the resistor 122, it may be possible to select a material having a relatively small volume resistivity in comparison with a case the insulator 125 is not provided. That is, when the insulator 125 is provided, it is possible to wide a range of a material of the resistor 122.

As for the counter electrode 12, the voltage drop generated in the resistor 122 is generated in the transverse direction with respect to FIG. 1. Therefore, the electric field generated in the surface of the resistor 122 in the transverse direction is relatively small than the electric field generated in the thickness direction of the resistor 122 in a state in which the insulator 125 is not provided. Accordingly, when the insulator 125 is provided, the breakdown rarely occurs in the resistor 122 in comparison with a case the insulator 125 is not provided.

As for the counter electrode 12, the discharge between the high voltage electrode 11 and the counter electrode 12 may be stopped by the voltage drop of the resistor 122. However, when the voltage applied the space between the high voltage electrode 11 and the counter electrode 12 is restored, the discharge is restarted. The discharge may be stopped by the voltage drop of the resistor 122 of the counter electrode 12. As mentioned above, the discharge is repeatedly stopped and restarted. That is, the high voltage generating circuit 40 applies a DC voltage between the high voltage electrode 11 and the counter electrode 12 but the discharge may be repeatedly stopped and restarted in an AC manner.

Meanwhile, as the charge is slowly accumulated in the resistor 122, the discharge is gradually weakened and then finally the discharge is stopped. Therefore, it is needed that the current (I) flows from the resistor 122 to the conductor 121 to prevent the charge from being accumulated in the resistor 122.

An Example 11

An effect of electric connection between the conductor 121 and the resistor 122 when the counter electrode 12 of the charger 10 is provided with the conductor 121, the insulator 125 covering the conductor 121 and the resistor 122 covering the insulator 125, will be described.

The electrostatic precipitator 1 having the counter electrode 12 in which the conductor 121 and the resistor 122 are electrically connected will be described as the electrostatic precipitator 1 according to the example 11. The electrostatic precipitator 1 having the counter electrode 12 in which the conductor 121 and the resistor 122 are not electrically connected, will be described as the electrostatic precipitator 1 according to a comparative example 4.

Figure 38A:
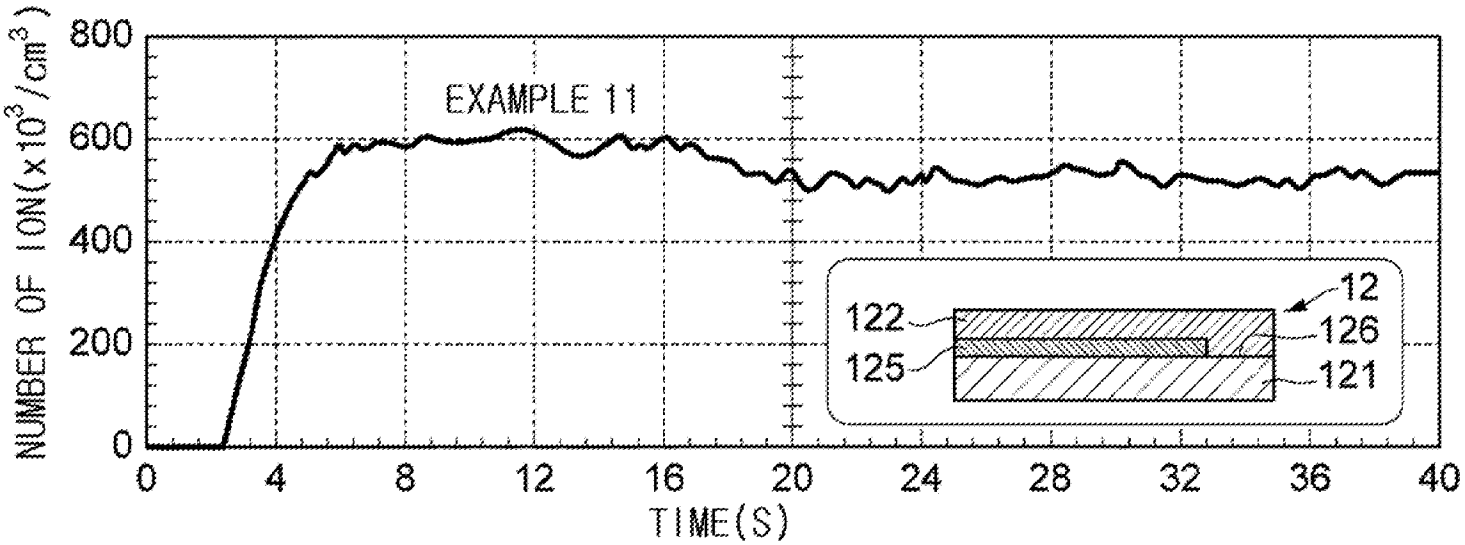
FIGS. 38A and 38B are views illustrating the number of ions generated in the charger of the electrostatic precipitator according to an example 11, and the charger of the electrostatic precipitator according to a comparative example 4, particularly.
Figure 38B:
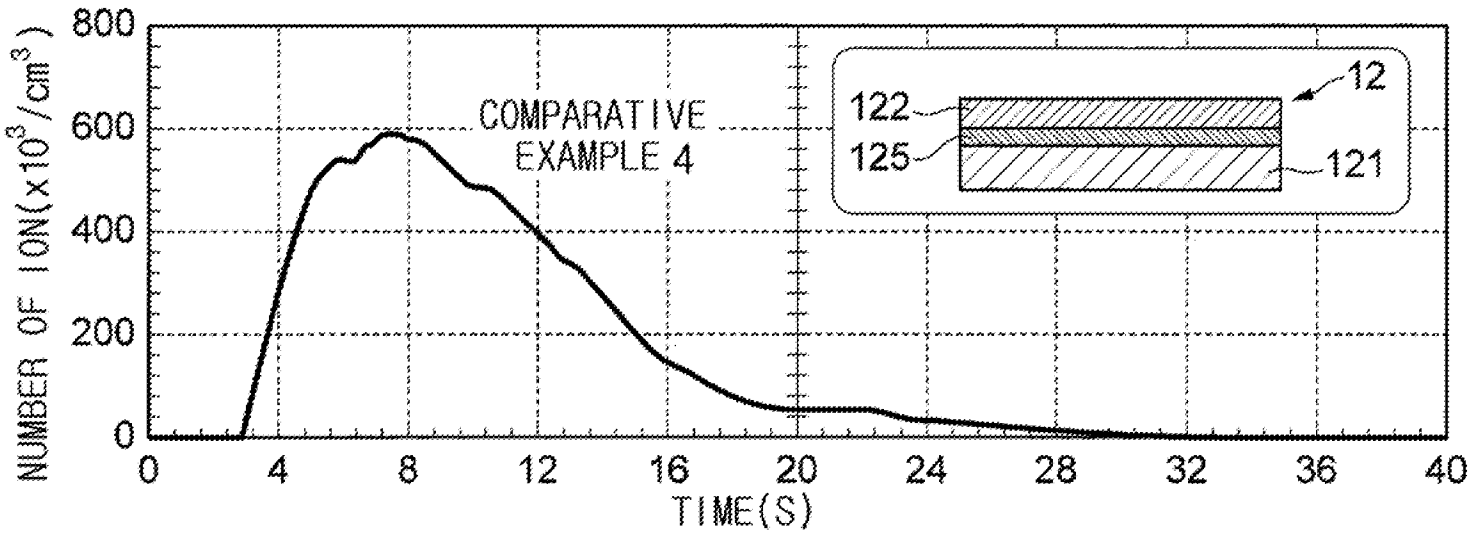

FIGS. 38A and 38B are views illustrating the number of ions generated in the charger 10 of the electrostatic precipitator 1 according to the example 11, and the charger 10 of the electrostatic precipitator 1 according to the comparative example 4. FIG. 38A is related to the example 11 and FIG. 38B is related to the comparative example 4. The horizontal axis is time (s) and the vertical axis is the number of ion ($\times 10^3/cm^3$).

As illustrated in FIG. 38A, as for an end portion of the counter electrode 12, when the conductor 121 and the resistor 122 are connected to each other in the connection region 126, the generation of the ion is started at about 2.4 s and then the generation of the ion is maintained.

This is because the charge is not accumulated in the resistor 122 since the conductor 121 and the resistor 122 are electrically connected. That is, the voltage applied the space between the high voltage electrode 11 and the counter electrode 12 is maintained and the discharge is also maintained.

Meanwhile, as illustrated in FIG. 38B, as for the counter electrode 12, when the conductor 121 and the resistor 122 are not electrically connected, the generation of the ion is started at about 2.8 s and then the number of ions is reduced after about 8 s. After about 28 s, the ozone generation does not occur.

This is because the charge is accumulated in the resistor 122 since the conductor 121 and the resistor 122 are not electrically connected. That is, the voltage applied the space between the high voltage electrode 11 and the counter electrode 12 is reduced and the discharge is stopped.

An Example 12

Figure 39A:
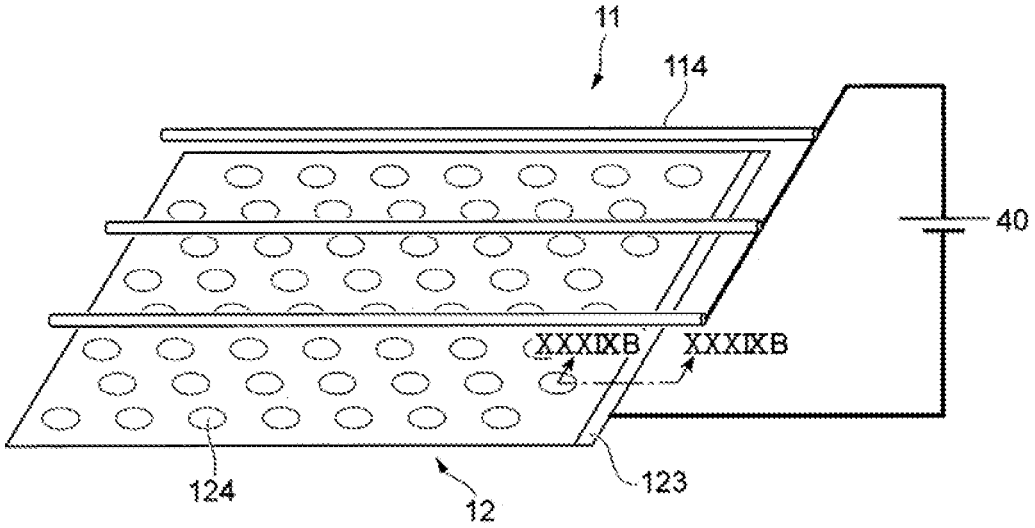
FIGS. 39A and 39B are views illustrating a charger of an electrostatic precipitator according to an example 12, particularly.
Figure 39B:
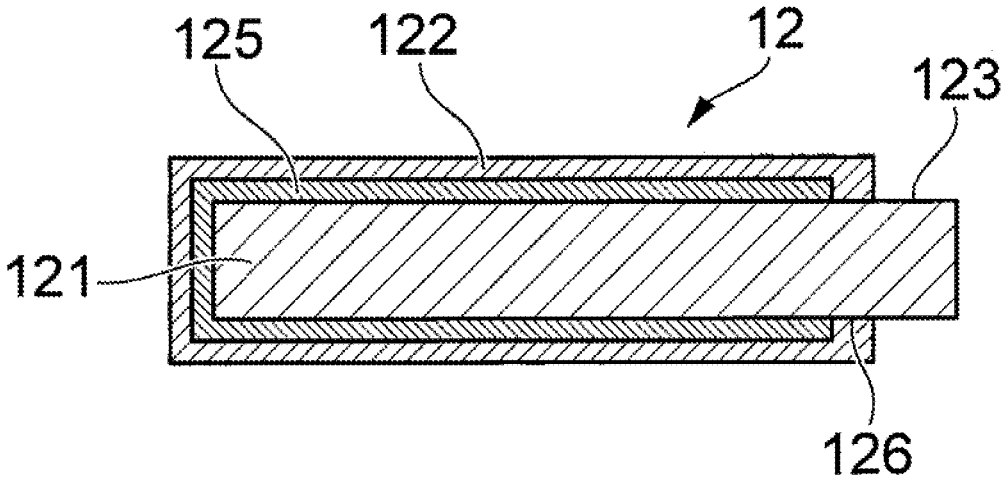

FIGS. 39A and 39B are views illustrating the charger 10 of the electrostatic precipitator 1 according to the example 12. FIG. 39A is a perspective view of the charger 10, and FIG. 39B is a cross-sectional view taken along line XXXIXB-XXXIXB of the counter electrode 12.

As illustrated in FIG. 39A, as for the charger 10 of the electrostatic precipitator 1 according to the example 12, the high voltage electrode 11 is formed with a wire 114. The conductor 121 of the counter electrode 12 corresponds to a plate-shaped member (punching metal) which is formed of a conductive material and in which a plurality of openings 124 is formed in a zigzag pattern. On the surface of the conductor 121, the insulator 125 and the resistor 122 are formed in order. In one portion of the conductor 121, the insulator 125 is not formed but the connection region 126 connecting the conductor 121 to the resistor 122 is formed. An end portion of the conductor 121, the conductive exposed area 123 in which the surface of the conductor 121 is exposed is formed. The conductor exposed area 123 is connected to the cathode of the high voltage generating circuit 40.

The wire 114 is an example of a portion generating the electric field concentration.

The wire 114 corresponding to the high voltage electrode 11 is formed by a stainless steel (SUS) having a diameter of 0.2 mm.

Meanwhile, the counter electrode 12 is provided with the conductor 121 formed by a 30 mm wide aluminum plate in which the circular opening 124 having an inner diameter of 3 mm is arranged in the zigzag pattern. An anodizing (alumilite process) is performed on the aluminum of the conductor 121 and thus the insulator 125 formed of alumina is formed on the surface of the conductor 121. The resistor 122 is formed such that a polyimide having a thickness of 50 μm is covered on the insulator 125.

The high voltage electrode 11 is attached to the case 30 using the insulating spacer 32 formed of an insulating material. The counter electrode 12 is attached to the case 30 by the conductor exposed area 123 in which the conductor 121 is exposed so that the counter electrode 12 is electrically connected to the case 30. Accordingly, it is possible to prevent the case 30 from charging by the static electricity.

An Example 13

Figure 40A:
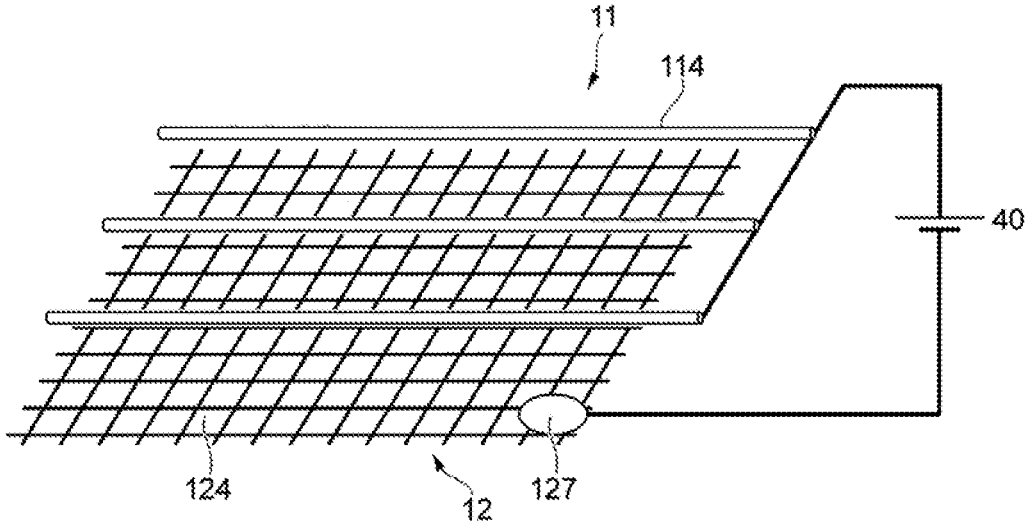
FIGS. 40A and 40B are views illustrating a charger of an electrostatic precipitator according to an example 13, particularly.
Figure 40B:
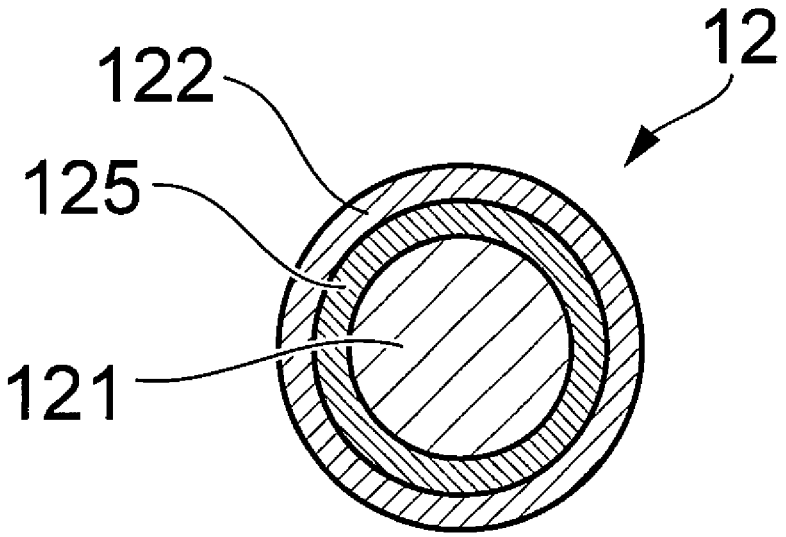

FIGS. 40A and 40B are views illustrating the charger 10 of the electrostatic precipitator 1 according to the example 13. FIG. 40A is a perspective view of the charger 10, and FIG. 40B is a cross-sectional view illustrating a portion of the counter electrode 12.

As illustrated in FIG. 40A, as for the charger 10 of the electrostatic precipitator 1 according to the example 13, the high voltage electrode 11 is formed with a wire 114 in the same manner as the example 11.

The conductor 121 of the counter electrode 12 is a wire mesh (mesh) formed of the conductive material. The counter electrode 12 is formed by the conductor 121 formed by a square SUS 304 with a side length of 100 mm.

The cross-sectional view of the portion of the counter electrode 12 as illustrated in FIG. 40B illustrates a cross-sectional view of a single wire of the mesh forming the conductor 121 of the counter electrode 12. The polyimide resin applied to cover the conductor 121 corresponds to the insulator 125 and the acrylic resin applied to cover the insulator 125 corresponds to the resistor 122.

A portion of the counter electrode 12 is caulked and then used as an electric contact 127. The electric contact 127 is connected to the cathode of the high voltage generating circuit 40.

The portion of the counter electrode 12 is caulked and thus the insulator 125 and the resistor 122 which are applied to the conductor 121 are broken. Therefore, the resistor 122 is electrically connected to the conductor 121 while a portion of the conductor 121 is exposed. That is, in the example 12, the connection region 126 and the conductor exposed area 123 as illustrated in FIGS. 39A and 39B are formed at the same time by the caulking.

An Example 14

Figure 41A:
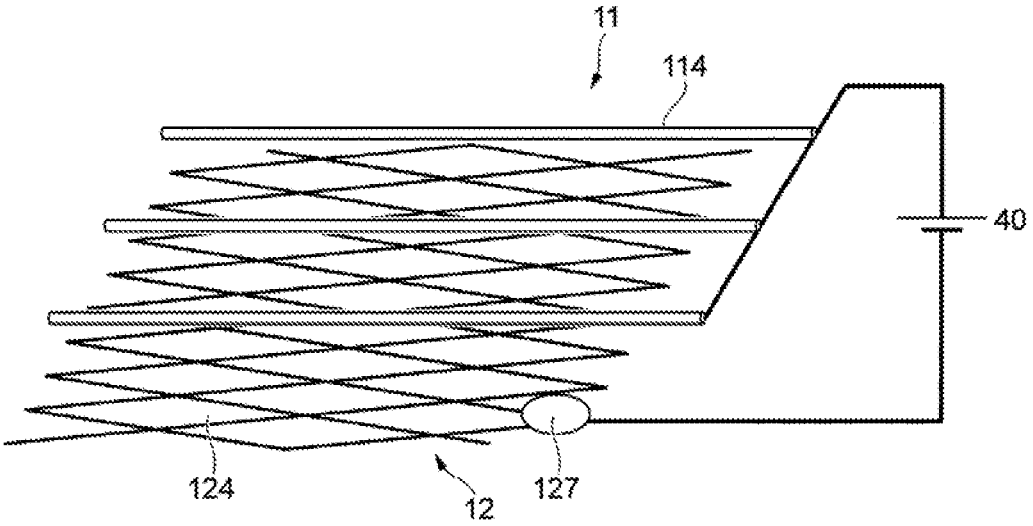
FIGS. 41A and 41B are views illustrating a charger of an electrostatic precipitator according to an example 14.
Figure 41B:
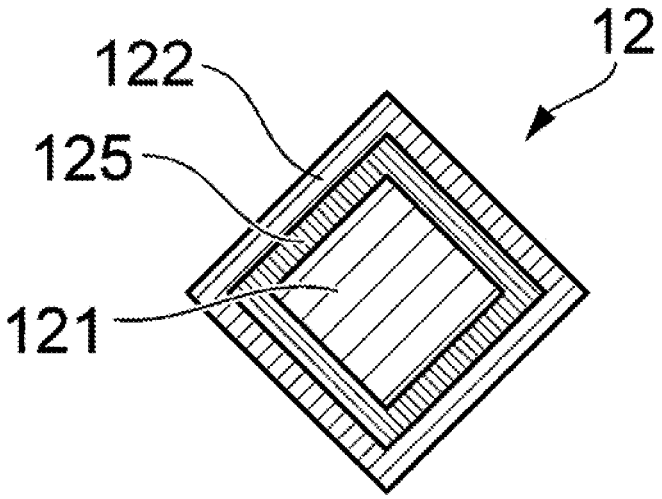

FIGS. 41A and 41B are views illustrating the charger 10 of the electrostatic precipitator 1 according to the example 14. FIG. 41A is a perspective view of the charger 10, and FIG. 41B is a cross-sectional view illustrating a portion of the counter electrode 12.

As illustrated in FIG. 41A, as for the charger 10 of the electrostatic precipitator 1 according to the example 14, the high voltage electrode 11 is formed with a wire 114 in the same manner as the examples 12 and 13.

The conductor 121 of the counter electrode 12 is an expandable metal formed of the conductive material. As for the counter electrode 12, the conductor 121 is formed by expandable metal formed by a square aluminum with a side length of 100 mm.

The cross-sectional view of the portion of the counter electrode 12 as illustrated in FIG. 41B illustrates a cross-sectional view of a single wire of the expandable metal forming the counter electrode 12. Alumina generated by anodizing the conductor 121 corresponds to the insulator 125 and the polyimide resin applied to cover the insulator 125 corresponds to the resistor 122.

A portion of the counter electrode 12 is caulked and then used as the electric contact 127. The electric contact 127 is connected to the cathode of the high voltage generating circuit 40.

The portion of the counter electrode 12 is caulked and thus the insulator 125 and the resistor 122 which are applied to the conductor 121 are broken. Therefore, the resistor 122 is electrically connected to the conductor 121 while a portion of the conductor 121 is exposed. That is, in the example 12, the connection region 126 and the conductor exposed area 123 as illustrated in FIGS. 39A and 39B are formed at the same time by the caulking.

An Example 15

Figure 42A:
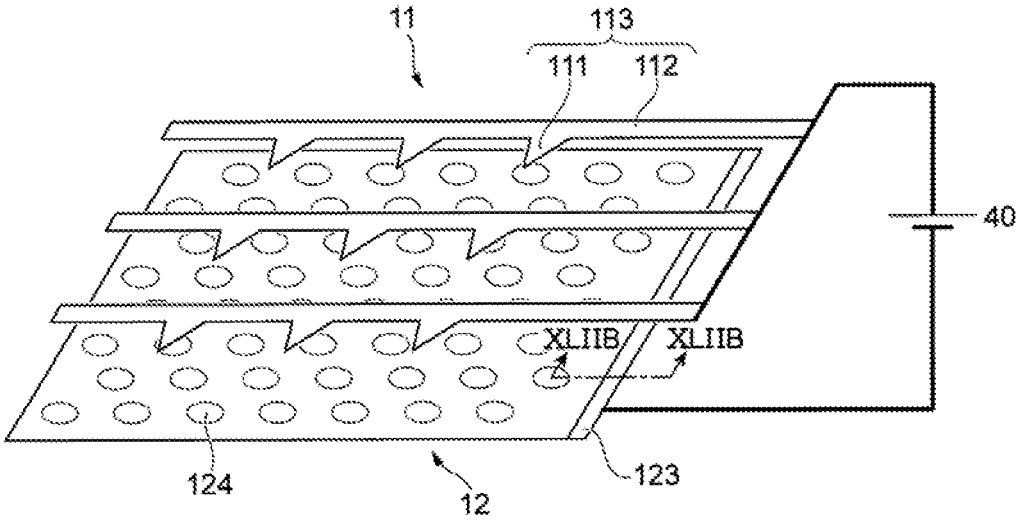
FIGS. 42A and 42B are views illustrating a charger 10 of an electrostatic precipitator according to an example 15, particularly.
Figure 42B:
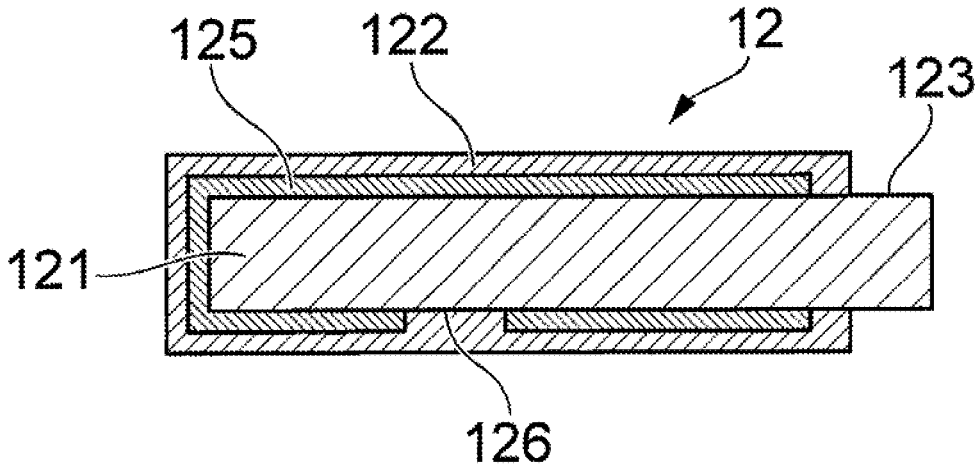

FIGS. 42A and 42B are views illustrating the charger 10 of the electrostatic precipitator 1 according to the example 15. FIG. 42A is a perspective view of the charger 10, and FIG. 42B is a cross-sectional view taken along line XLIIB-XLIIB of FIG. 42A.

As illustrated in FIG. 42A, as for the charger 10 of the electrostatic precipitator 1 according to the example 15, the high voltage electrode 11 is provided with the plurality of the tooth rows 113 having the plurality of the teeth 111. The tooth row 113 of the high voltage electrode 11 is formed by a stainless steel (SUS) having a thickness of 0.5 mm. Each the tooth 111 of the tooth row 113 is disposed in a direction perpendicular to the air flowing direction.

The conductor 121 of the counter electrode 12 corresponds to a plate-shaped member (punching metal) which is formed of a conductive material and in which a plurality of openings 124 is formed in a zigzag pattern. The counter electrode 12 is provided with the conductor 121 formed by 200 mm×400 mm aluminum plate in which the circular opening 124 having an inner diameter of 3 mm is arranged in the zigzag pattern. An anodizing (alumilite process) is performed on the aluminum of the conductor 121 and the insulator 125 formed of alumina is formed on the surface of the conductor 121. The resistor 122 is formed such that a polyimide resin is covered on the insulator 125.

As for the high voltage electrode 11, the connection region 126 electrically connecting the conductor 121 to the resistor 122 is formed in a portion corresponding to a back side of the conductor 121.

The conductor exposed area 123 in which the insulator 125 and the resistor 122 are not formed but the conductor 121 is exposed is formed, is formed in one end portion of the conductor 121. The conductor exposed area 123 is connected to the cathode of the high voltage generating circuit 40.

A distance (G) between the high voltage electrode 11 and the counter electrode 12 is about 5 mm.

Figure 43:
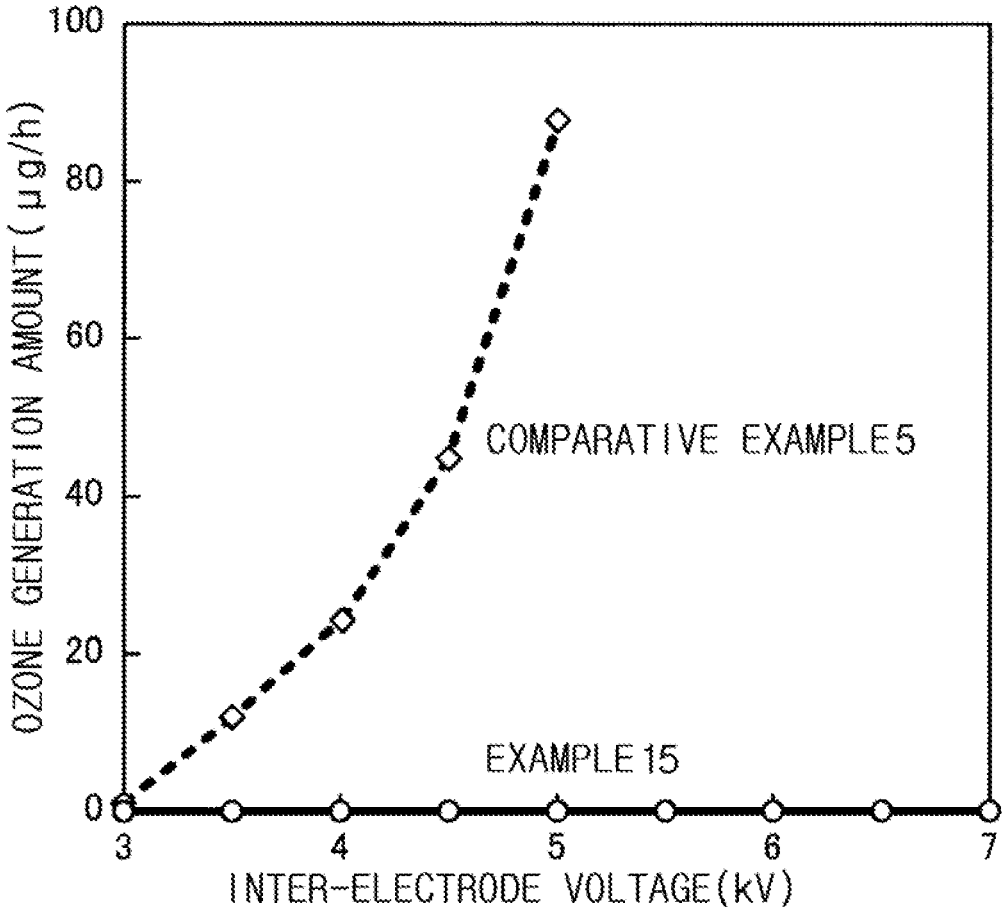
FIG. 43 is a view illustrating the relationship between an inter-electrode voltage (kV) applied to between the high voltage electrode and the conductor of the counter electrode and an ozone generation amount per one the tooth (μg/h)

FIG. 43 is a view illustrating a relationship between an inter-electrode voltage (kV) applied to between the high voltage electrode 11 and the conductor 121 of the counter electrode 12, and an ozone generation amount per one the tooth 111 (μg/h). FIG. 43 illustrates that the electrostatic precipitator 1 according to the example 15 and the electrostatic precipitator 1 according to a comparative example 15 in which the counter electrode 12 of the charger 10 is not provided with the insulator 125 formed of alumina and the resistor 122 formed of polyimide resin. In the comparative example 5, the counter electrode 12 is formed by a punching aluminum.

As illustrated in FIG. 43, in the example 15, although an inter-electrode voltage is 7 kV, the ozone generation amount is almost 0 (zero). However, in the comparative example 5, as the inter-electrode voltage is increased, the ozone generation amount is also increased.

That is, since the counter electrode 12 is provided with the conductor 121, the insulator 125, and the resistor 122, the ozone generation amount is suppressed.

It is appropriate that a surface resistivity of the resistor 122 is equal to or more than 1 GΩ/cm when a voltage (inter-electrode voltage) applied between the high voltage electrode 11 and the counter electrode 12 is 5 kV. In this case, the ozone generation amount may be suppressed to 1 μg/h or less. Meanwhile, since the surface resistivity of the resistor 122 is changed according to the inter-electrode voltage, this example illustrates the surface resistivity of the resistor 122 when the inter-electrode voltage is 5 kV.

Table 1 illustrates the comparison of the breakdown voltage. The breakdown voltage represents a voltage shaft from the corona discharge to the arc discharge.

Table 1 illustrates the example 15, the comparative example 5 and an example 16. In the example 16, as for the electrostatic precipitator 1, the conductor 121 of the counter electrode 12 is formed of a punching aluminum and the resistor 122 is formed by applying the polyimide resin on a surface of the conductor 121. That is, the electrostatic precipitator 1 according to the example 6 is the same as the electrostatic precipitator 1 according to the first embodiment.

As illustrated in table 1, in the charger 10 of the electrostatic precipitator 1 according to the example 15, the breakdown voltage is equal to or more than 10 kV. The electrostatic precipitator 1 according to the example 16 in which the insulator 125 is not provided, the breakdown voltage is 8 kV.

However, in the electrostatic precipitator 1 according to the comparative example 5 in which the resistor 122 and the insulator 125 are not provided, the breakdown voltage is low as 5.5 kV That is, since the counter electrode 12 is provided with the resistor 122, the breakdown is increased. Since the insulator 125 is provided, the breakdown is more increased.

TABLE 1

| | Example 15 | Comparative example 15 | Example 16 |
|---|---|---|---|
| Conductor | Punching aluminum | Punching aluminum | Punching aluminum |
| Insulator | Alumina | — | — |
| Resistor | Polyimide resin | — | Polyimide resin |
| Breakdown voltage | 10 kV or more | 5.5 kV | 8 kV |

An Example 17

Figure 44A:
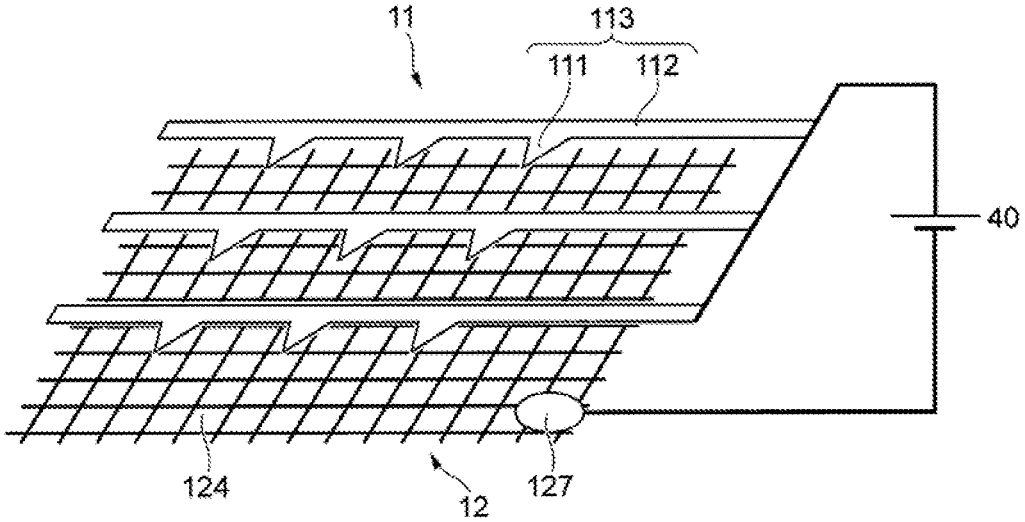
FIGS. 44A and 44B are views illustrating a charger of an electrostatic precipitator according to an example 17, particularly.
Figure 44B:
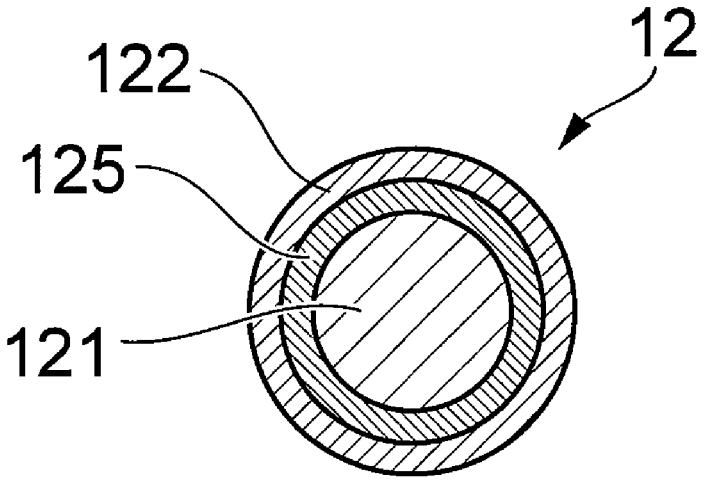

FIGS. 44A and 44B are views illustrating the charger 10 of the electrostatic precipitator 1 according to the example 17. FIG. 44A is a perspective view of the charger 10, and FIG. 44B is a cross-sectional view illustrating a portion of the counter electrode 12.

As illustrated in FIG. 44A, as for the charger 10 of the electrostatic precipitator 1 according to the example 17, the high voltage electrode 11 is provided with the plurality of the tooth rows 113 having the plurality of the teeth 111 as the same as the example 15. Therefore, a description thereof will be omitted.

The conductor 121 of the counter electrode 12 is a wire mesh formed of a conductive material. As the same as the example 13, the conductor 121 of the counter electrode 12 is formed by a square SUS 304 with a side length of 100 mm. Therefore, a description thereof will be omitted.

An Example 18

Figure 45A:
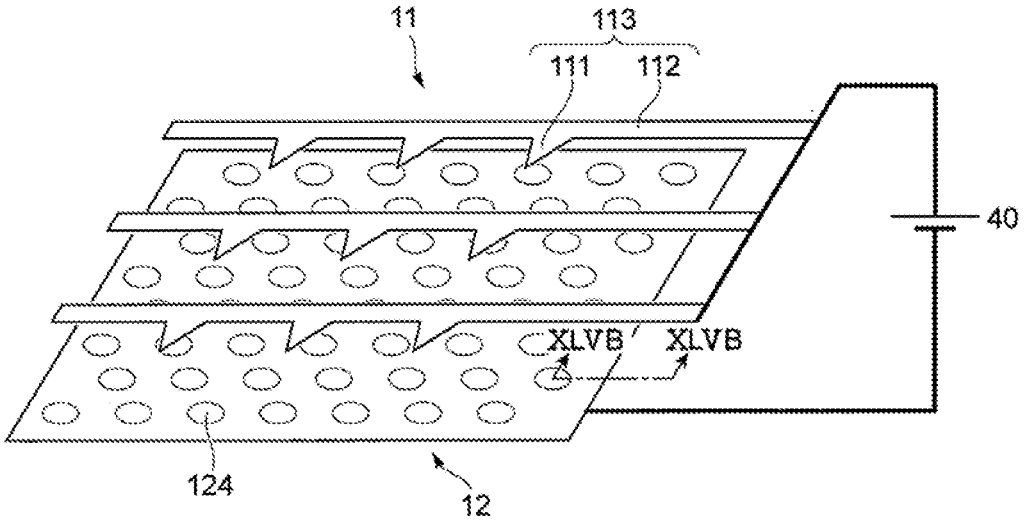
FIGS. 45A and 45B are views illustrating a charger of an electrostatic precipitator according to an example 18, particularly.
Figure 45B:
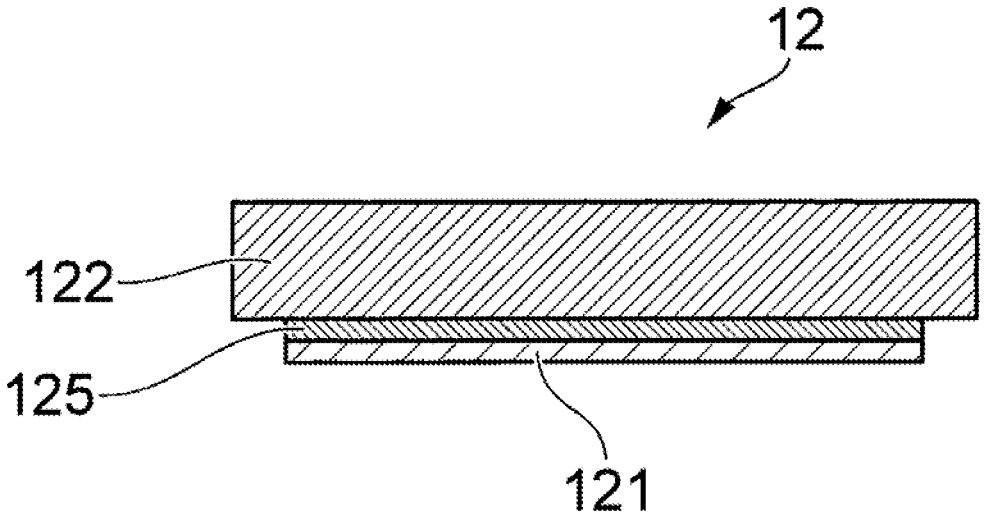

FIGS. 45A and 45B are views illustrating the charger 10 of the electrostatic precipitator 1 according to the example 18. FIG. 45A is a perspective view of the charger 10, and FIG. 45B is a cross-sectional view taken along line XLVB-XLVB of the counter electrode 12 of FIG. 45A.

As illustrated in FIG. 45A, as for the charger 10 of the electrostatic precipitator 1 according to the example 18, the high voltage electrode 11 is provided with the plurality of the tooth rows 113 having the plurality of the teeth 111 as the same as the example 15. The tooth row 113 of the high voltage electrode 11 is formed by a stainless steel (SUS) having a thickness of 0.5 mm. Each the tooth 111 of the tooth row 113 is disposed in a direction perpendicular to the air flowing direction.

The resistor 122 of the counter electrode 12 is formed by a plate-shaped resin member (punching board) in which a plurality of openings 124 is formed in a zigzag pattern. The resistor 122 of the counter electrode 12 is formed by an acrylic resin plate having a size of 200 mm×400 mm and a thickness of 2 mm. In the resistor 122 of the counter electrode 12 that is the acrylic resin plate, the circular opening 124 having an inner diameter of 3 mm is arranged in the zigzag pattern. A conductive film including an adhesive layer having thickness 20 μm and a conductive layer formed of a conductive material, is adhered on a surface of the acrylic resin plate corresponding to the resistor 122 of the counter electrode 12, wherein the surface is placed in an opposite side of the high voltage electrode 11.

The conductive layer of the conductive film corresponds to the conductor 121. The adhesive layer of the conductive film corresponds to the insulator 125. The conductive layer of the conductive film of the conductor 121 is connected to the anode of the high voltage generating circuit 40.

The resistor 122 is an example of a substrate, the insulator 125 is an example of a first member and the conductor 121 is an example of a second member.

On the conductive film, an opening having a larger inner diameter (e.g., 3.5 mm) than the opening 124 formed in the acrylic resin plate is formed to face the opening 124 formed in the acrylic resin plate. That is, as illustrated in FIG. 45B, when viewed from the side of the high voltage electrode 11, the adhesive layer and the conductive layer of the conductive film is not protruded from the opening formed in the acrylic resin plate.

When the conductive layer of the conductive film is protruded toward the inside of the opening 124 of the resistor 122, the discharge occurs between the high voltage electrode 11 and the conductive layer of the conductive film, and thus a function to limit the discharge current of the resistor 122 may fail.

An Example 19

Figure 46A:
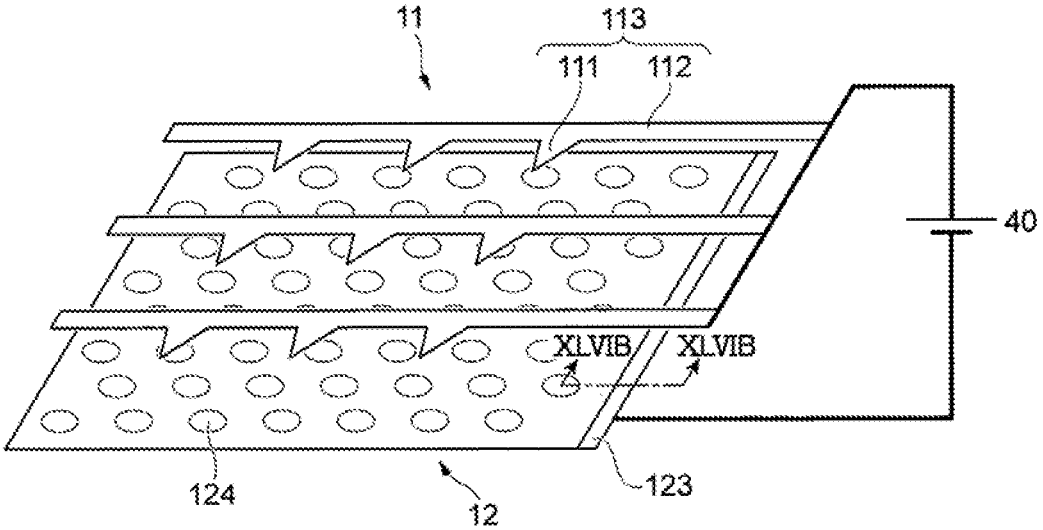
FIGS. 46A and 46B are views illustrating a charger of an electrostatic precipitator according to an example 19, particularly.
Figure 46B:
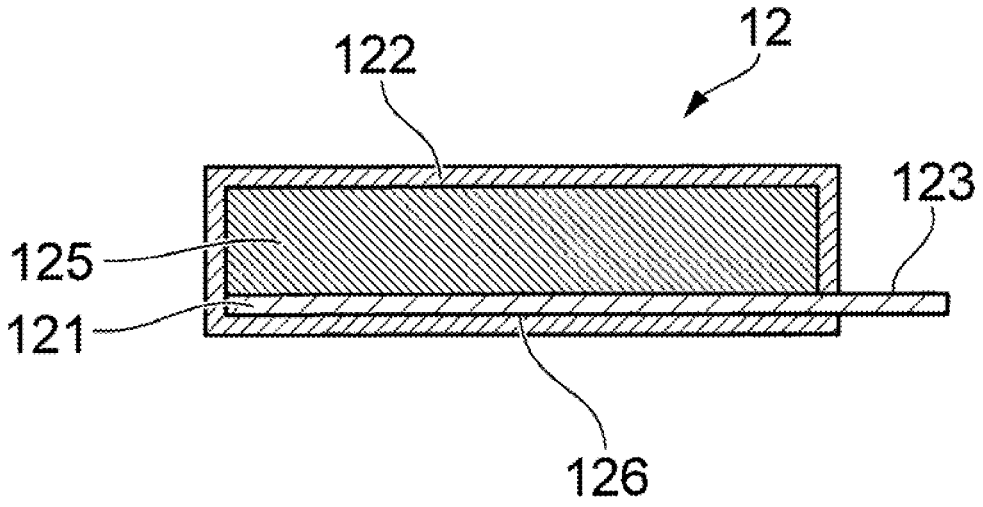

FIGS. 46A and 46B are views illustrating the charger 10 of the electrostatic precipitator 1 according to the example 19. FIG. 46A is a perspective view of the charger 10, and FIG. 46B is a cross-sectional view taken along line XLVIB-XLVIB of the counter electrode 12 of FIG. 46A.

As illustrated in FIG. 45A, as for the charger 10 of the electrostatic precipitator 1 according to the example 19, the high voltage electrode 11 is provided with the plurality of the tooth rows 113 having the plurality of the teeth 111 as the same as the example 15. The tooth row 113 of the high voltage electrode 11 is formed by a stainless steel (SUS) having a thickness of 0.5 mm. Each the tooth 111 of the tooth row 113 is disposed in a direction perpendicular to the air flowing direction.

The insulator 125 of the counter electrode 12 is formed by a plate-shaped conductive member (punching board) in which a plurality of openings 124 is formed in a zigzag pattern. The insulator 125 of the counter electrode 12 is formed by a ceramic plate having a size of 200 mm×400 mm and a thickness of 2 mm. In the insulator 125 of the counter electrode 12 that is the ceramic plate, the circular opening 124 having an inner diameter of 3 mm is arranged in the zigzag pattern.

The conductor 121 formed of a conductive material, e.g., copper plate is adhered to a surface of the ceramic plate corresponding to the insulator 125 of the counter electrode 12, wherein the surface is placed in an opposite side of the high voltage electrode 11. In correspondence with the opening 124 formed on the ceramic plate, an opening is formed on the copper plate corresponding to the conductor 121.

The resistor 122 is formed such that the surround of the ceramic plate corresponding to the insulator 125 is covered with the polyimide resin. The resistor 122 formed of the polyimide resin covers the copper plate corresponding to the conductor 121, and the opening 124. That is, except for the conductor exposed area 123 of the conductor 121, the surface of the counter electrode 12 is coated with the resistor 122 formed of the polyimide resin.

The insulator 125 is an example of a substrate, the resistor 122 is an example of a first member and the conductor 121 is an example of a second member.

As mentioned above, it is allowed that any one of the conductor 121, the insulator 125, and the resistor 122 is a rigid member (base member) and others are a film adhered to the base member or a layer applied thereto. Two or more of the conductor 121, the insulator 125, and the resistor 122 are a rigid member (base member), wherein it is allowed that the rigid members are stacked.

The conductor 121 may be formed of a conductive material, i.e., a good conductor. The insulator 125 may be formed of a material configured to prevent the electron flow of the resistor 122 from being directly directed to the conductor 121. The resistor 122 may be formed of material to prevent the ozone generation by limiting the discharge current.

A Seventh Embodiment

According to from the first embodiment to the sixth embodiment, as for the charger 10 of the electrostatic precipitator 1, the high voltage electrode 11 is disposed in the upstream side and the counter electrode 12 is the downstream side of the air flow direction.

It is allowed that the position of the high voltage electrode 11 and the counter electrode 12 is reversed with respect to the air flow direction.

Figure 47:
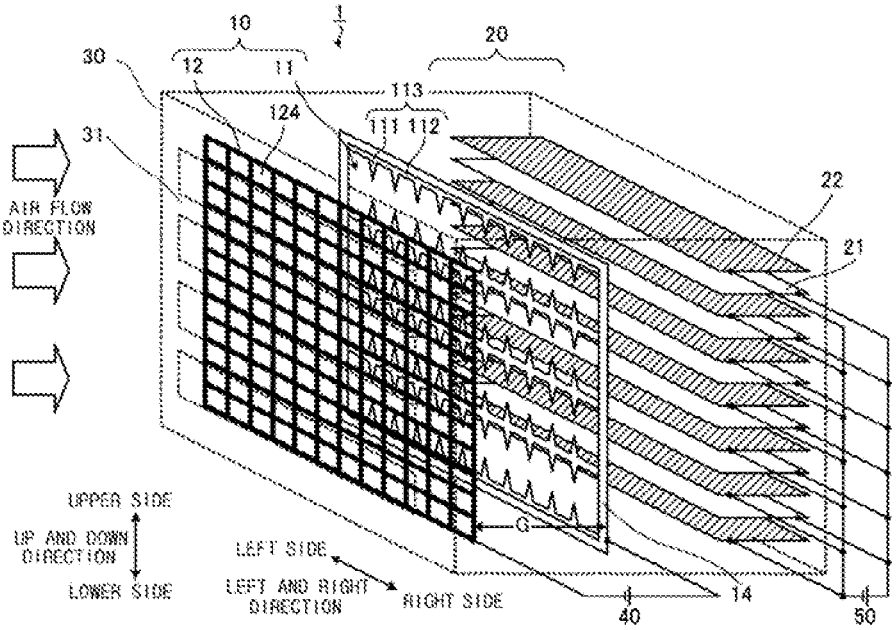
FIG. 47 is a view illustrating an example of an electrostatic precipitator according to a seventh embodiment.

FIG. 47 is a view illustrating an example of the electrostatic precipitator 1 according to the seventh embodiment.

As illustrated in FIG. 1, as for the charger 10 of the electrostatic precipitator 1, the position of the high voltage electrode 11 and the counter electrode 12 is reversed with respect to the air flow direction. That is, the counter electrode 12 is disposed in the upstream side and the high voltage electrode 11 is the downstream side in the air flow direction Since other components are the same as those in the first embodiment, the same reference numerals are given and a description thereof is omitted.

Although in the charger 10, the high voltage electrode 11 and the counter electrode 12 are disposed as mentioned above, the electrostatic precipitator 1 is operated as the same as the electrostatic precipitator 1 according to the first embodiment.

An Eighth Embodiment

According to the first embodiment to the seventh embodiment, as for the charger 10 of the electrostatic precipitator 1, the high voltage electrode 11 and the counter electrode 12 are disposed in the air flow direction.

For example, according to the first embodiment as illustrated in FIG. 1, the high voltage electrode 11 provided with the tooth 111 is disposed in the upstream side of the air flow direction and the counter electrode 12 is the downstream side of the air flow direction.

In comparison with this, according to the eighth embodiment, as for the charger 10 of the electrostatic precipitator 1, the high voltage electrode 11 and the counter electrode 12 are disposed in a vertical direction with respect to the air flow direction.

The high voltage electrode 11 is provided with a master high voltage electrode 11A and a slave high voltage electrode 11B.

Figure 48:
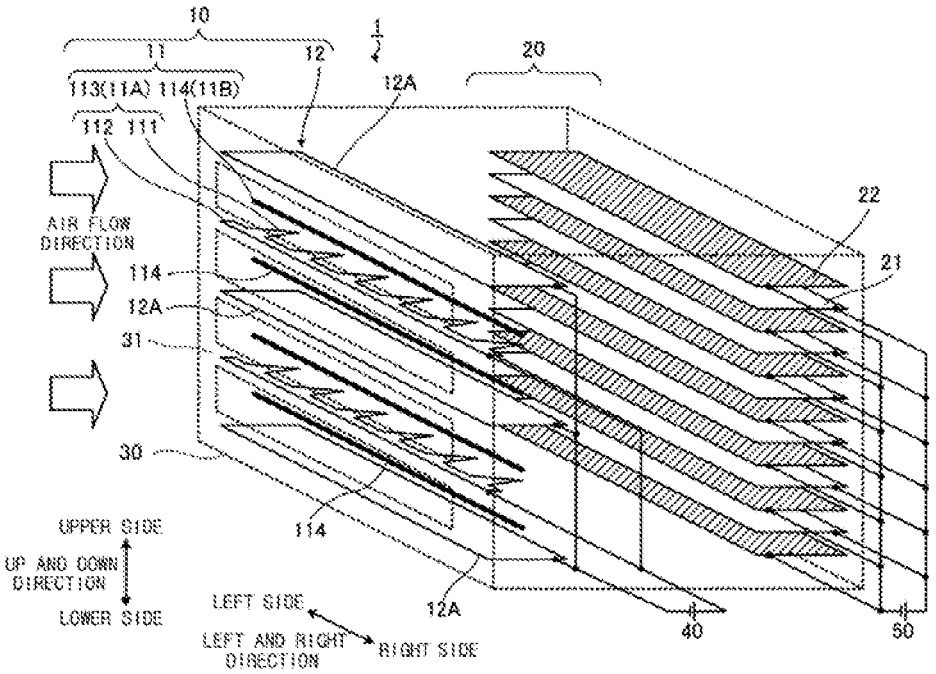
FIG. 48 is a view illustrating an example of an electrostatic precipitator according to an eighth embodiment.

FIG. 48 is a view illustrating an example of the electrostatic precipitator 1 according to the eighth embodiment.

In the charger 10, the high voltage electrode 11 is provided with a plurality of the master high voltage electrodes 11A and a plurality of the slave high voltage electrodes 11B. The counter electrode 12 is provided with a plurality of sub counter electrodes 12A. The high voltage electrode 11 and the counter electrode 12 are disposed to cross the air flow direction ("perpendicular" in FIG. 48)

The dust collector 20 is the same as the dust collector 20 of the electrostatic precipitator 1 according to the first embodiment to the seventh embodiment, and thus a description thereof will be omitted.

The arrangement of the electrostatic precipitator 1 is not limited to FIG. 48, but the electrostatic precipitator 1 is disposed in any direction as long as securing the air flow.

For example, the master high voltage electrode 11A of the high voltage electrode 11 is provided with the plurality of the teeth 111, as illustrated in FIG. 48. Each the tooth 111 is connected to the connecting portion 112 and forms the tooth row 113. For example, the slave high voltage electrode 11B of the high voltage electrode 11 is provided with the wire 114 as illustrated in FIG. 48.

The sub counter electrode 12A of the counter electrode 12 is omitted in FIG. 48. However, the sub counter electrode 12A according to the eighth embodiment is the same as the counter electrode 12 of the charger 10 in the electrostatic precipitator 1 according to the sixth embodiment, and the counter electrode 12 is provided with a plate-shaped conductor, the insulator coating the both surfaces of the conductor, and the resistor coating the surface of the insulator. That is, the sub counter electrode 12A is formed such that the insulator and the resistor are formed on the surface of the conductor in order. The sub counter electrode 12A has the plate-shaped.

As illustrated in FIG. 48, in the counter electrode 12, the plurality of the sub counter electrodes 12A is formed to be parallel with each other in a direction perpendicular to the air flow direction ("perpendicular" in FIG. 48) so that each surface thereof is arranged along the air flow direction. Alternatively, it is allowed that the surface of the counter electrode 12 is not parallel with the air flow direction. In addition, the surface of the counter electrode 12 may be inclined with respect to the air flow direction as long as having a predetermined air flow.

As for the high voltage electrode 11, the master high voltage electrode 11A is disposed between two sub counter electrodes 12A adjacent to the master high voltage electrode 11A, and the slave high voltage electrode 11B is disposed between the master high voltage electrode 11A and the sub counter electrode 12A.

Meanwhile, as for a surface of the sub counter electrode 12A, which does not face the master high voltage electrode 11A and the slave high voltage electrode 11B, it is allowed that a surface of a conductor is not coated with an insulator and/or a resistor.

The tooth 111 of the master high voltage electrode 11A is disposed such that a leading end of the tooth 111 faces the air flow direction (the downstream side of the air flow direction).

The wire 114 corresponding to the slave high voltage electrode 11B is formed to follow the tooth row 113 formed by the tooth 111 of the master high voltage electrode 11A. It is allowed that the wire 114 corresponding to the slave high voltage electrode 11B is formed to along the tooth row 113 in the periphery of the leading end of the tooth 111 of the master high voltage electrode 11A.

Meanwhile, FIG. 48 illustrates that the charger 10 of the electrostatic precipitator 1 is provided with two master high voltage electrodes 11A of the high voltage electrode 11, four the slave high voltage electrodes 11B and three the sub counter electrodes 12A of the counter electrode 12, but the number of the master high voltage electrode 11A, the slave high voltage electrode 11B and the sub counter electrode 12A is not limited thereto.

Figure 49A:
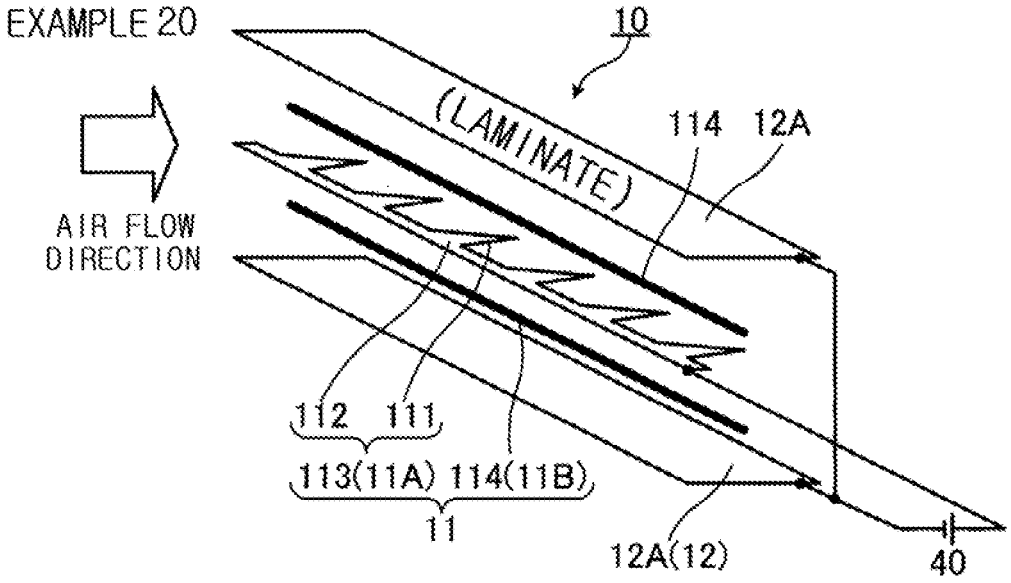
FIGS. 49A to 49C are perspective views illustrating a main portion of a charger of an electrostatic precipitator according to an example 20, and comparative examples 6 and 7, particularly.
Figure 49B:
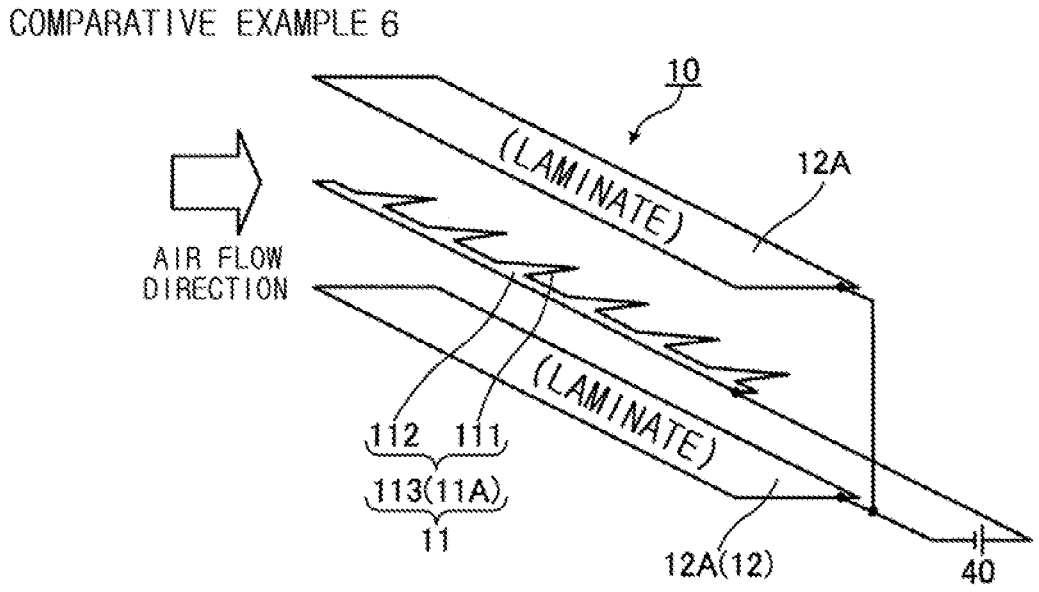
Figure 49C:
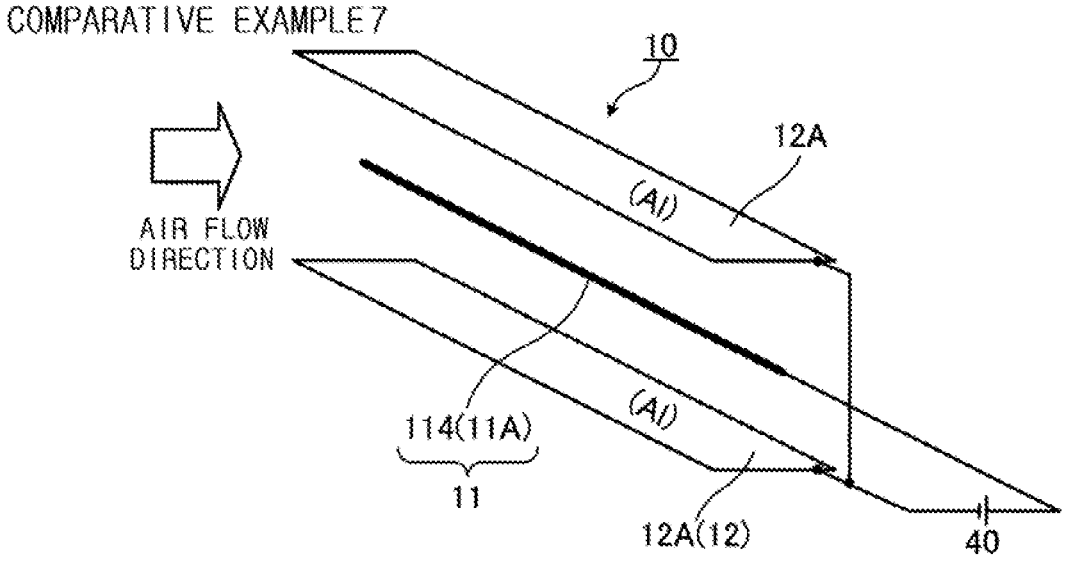

FIGS. 49A to 49C are perspective views illustrating a main portion of the charger 10 of the electrostatic precipitator 1 according to an example 20, and comparative examples 6 and 7. FIG. 49A illustrates the example 20, FIG. 49B illustrates the comparative example 6, and FIG. 49C illustrates the comparative example 7.

FIGS. 49A to 49C illustrate that a single master high voltage electrode 11A, and two sub counter electrodes 12A disposed to face the master high voltage electrode 11A are provided.

As illustrated in FIG. 49A, the electrostatic precipitator 1 according to the example 20 is the same as the electrostatic precipitator 1 according to the example 8. In the example 20, the slave high voltage electrode 11B is disposed between the sub counter electrode 12A and the master high voltage electrode 11A.

As mentioned above, the master high voltage electrode 11A is provided with the tooth row 113, which is formed such that the tooth 111 is connected to the connecting portion 112. A leading end of the tooth 111 is disposed to be directed to the downstream side of the air flow direction.

The slave high voltage electrode 11B is the wire 114. For example, a tungsten (W) wire having a diameter of 0.2 mm is used as the slave high voltage electrode 11B.

The sub counter electrode 12A corresponds to a laminate in which the insulator and the resistor are laminated in order on a surface of the conductor.

A distance between the master high voltage electrode 11A and the sub counter electrode 12A is 20 mm.

The slave high voltage electrode 11B is in a floating state to which a voltage is not applied.

As illustrated in FIG. 49B, the electrostatic precipitator 1 according to the comparative example 6 has a configuration in which the slave high voltage electrode 11B is excluded from the electrostatic precipitator 1 according to the example 20. That is, the tooth row 113 corresponds to the master high voltage electrode 11A (the high voltage electrode 11). In this case, a distance between the master high voltage electrode 11A (the high voltage electrode 11) and the sub counter electrode 12A is 20 mm.

As illustrated in FIGS. 49A and 49B, "laminate" is written on the sub counter electrode 12A.

As illustrated in FIG. 49C, according to the comparative example 7, the electrostatic precipitator 1 is configured such that the tooth row 113 corresponding to the master high voltage electrode 11A (the high voltage electrode 11) in the comparative example 6 is replaced with the wire 114. The sub counter electrode 12A is a conductor in which the insulator and the resistor are not provided. The conductor is A1 and thus "A1" is written on the sub counter electrode 12A.

A distance between the master high voltage electrode 11A (the high voltage electrode 11) and the sub counter electrode 12A is 20 mm.

FIG. 50 is a table illustrating an ozone concentration and collection efficiency by a particle diameter according to the example 20, and the comparative examples 6 and 7. In FIG. 50, the sub counter electrode 12A is indicated by "laminate" in the example 20 and the comparative example 6.

In the comparative example 7, the sub counter electrode 12A is indicated by "A1".

In this case, the electrostatic precipitator 1 is installed in a wind tunnel test, a wind speed is set to 1 m/s by a fan, and wind is passed through from the charger 10 to the dust collector 20 by one time (one pass).

The collection efficiency is estimated such that a sampling port is installed in the upstream side and the downstream side of the wind tunnel test and Scanning Mobility Particle Sizer (SMPS) measures and estimates the number of the suspended particles via the sampling port.

The ozone concentration is obtained from a difference between the upstream side and the downstream side through the sampling port formed in the upstream side and the downstream side of the wind tunnel test using an ozone meter.

In the example 20 in which the slave high voltage electrode 11B is provided, when 8.0 kV-8.2 kV is applied to the master high voltage electrode 11A, a voltage of 1.8 kV-2.5 kV is generated in the slave high voltage electrode 11B in the floating state.

When 300 μA flows in the master high voltage electrode 11A, the ozone concentration is 9.2 ppb. In this case, the collection efficiency is 97% when a particle diameter is 20 nm, and the collection efficiency is 99% or more when a particle diameter is 50 nm, 100 nm or 300 nm.

In the comparative example 6 in which the slave high voltage electrode 11B is excluded from the configuration of the example 20, when 300 μA flows in the master high voltage electrode 11A as the example 20, the ozone concentration is 22.9 ppb. In this case, the collection efficiency is 76% when a particle diameter is 20 nm, and the collection efficiency is from 80% to 89% when a particle diameter is 50 nm, 100 nm or 300 nm.

In a case in which the slave high voltage electrode 11B is not provided (the comparative example 6), the ozone concentration is increased and also the collection efficiency is reduced. Particularly, the collection efficiency of the ultrafine particles having a small diameter is reduced.

In the comparative example 7 in which the wire 114 is used as the master high voltage electrode 11A and A1 is used as the sub counter electrode 12A, the collection efficiency is increased regardless of the particle diameter, by increasing the current flowing the wire 114 of the master high voltage electrode 11A. For example, when 5000 μA flows in the master high voltage electrode 11A, the collection efficiency of the ultrafine particle having a particle diameter of 20 nm is 93%, which is increased from 75% when the current is 440 μA. That is, the collection efficiency becomes 90% or more. Meanwhile, the ozone concentration is 190 ppb, which is significantly increased from 9.2 ppb when the current is 440 μA.

As mentioned above, since a laminate, which is formed such that the insulator and the resistor are formed in order on the surface of the conductor, is used as the sub counter electrode 12A, using the slave high voltage electrode 11B, it may be possible to maintain the low ozone concentration, and to improve the collection efficiency of the ultrafine particle having a diameter of 0.1 μm or less.

Figure 51:
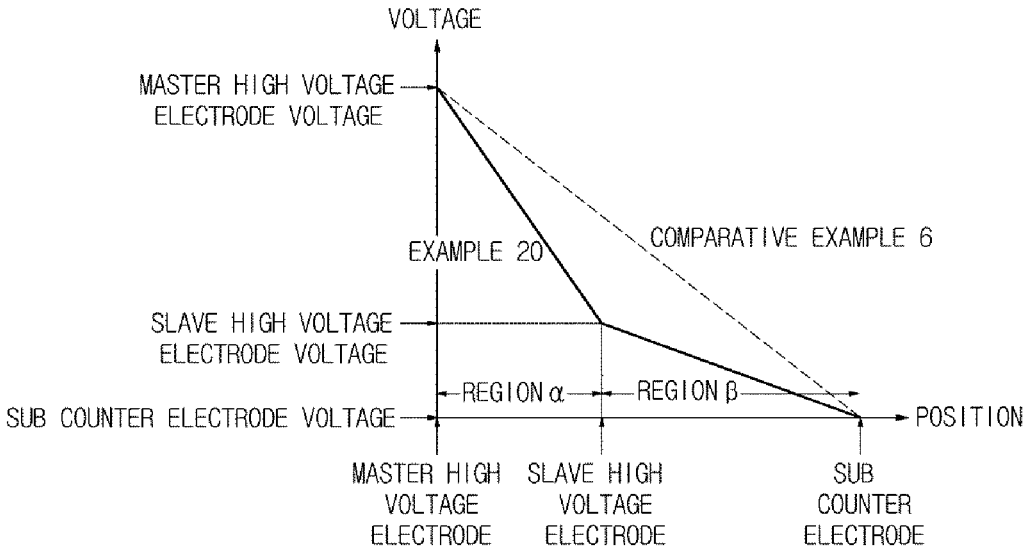
FIG. 51 is a graph illustrating an operation of the slave high voltage electrode.

FIG. 51 is a graph illustrating an operation of the slave high voltage electrode 11B. In this graph, the voltage is in the vertical axis, and the position of the master high voltage electrode 11A, the slave high voltage electrode 11B, and the sub counter electrode 12A are schematically illustrated in the horizontal axis.

As mentioned above, when the voltage of 8.0 kV~8.2 kV is applied to the master high voltage electrode 11A, the voltage of 1.8 kV~2.5 kV is generated in the slave high voltage electrode 11B in the floating state. Accordingly, the potential gradient from the master high voltage electrode 11A to the sub counter electrode 12A is not uniform and becomes two levels. That is, a high potential gradient region α in which a potential difference from the master high voltage electrode 11A to the slave high voltage electrode 11B is 5.7 kV~6.2 kV and a low potential gradient region β in which a potential difference from the slave high voltage electrode 11B to the sub counter electrode 12A is 1.8 kV~2.5 kV are generated.

It is assumed that the ultrafine particles having a particle diameter of 0.1 μm or less is efficiently charged because the discharge space is increased (widened) since the discharge is generated step by step, using the slave high voltage electrode 11B. That is, the potential gradient in the high potential gradient region α is larger than a potential gradient when the slave high voltage electrode 11B is not provided (a potential gradient illustrated by a broken line in the comparative example 6). Accordingly, the discharge is easily started. By the discharge, the discharge between the slave high voltage electrode 11B and the sub counter electrode 12A is generated. As mentioned above, by gradually generating the discharge, it is possible to expand the discharge space (increased).

It is assumed that the ozone concentration is suppressed because the resistance of the discharge space (space resistance) is high and the electric field concentration on the sub counter electrode 12A (the counter electrode 12) is relieved. That is, since the laminate, which is formed such that the insulator and the resistor are formed in order on the surface of the conductor, is used as the sub counter electrode 12A, the surface resistance is increased and the resistance of the discharge space (space resistance) is increased. In addition, by forming the slave high voltage electrode 11B, the electric field concentration between the slave high voltage electrode 11B and the sub counter electrode 12A (the counter electrode 12) is relieved. Accordingly, a ratio of the balance between the supply of the charge and the destruction of the charge is increased by ionization, and the amount of the electron generation which is the start point of the ozone generation is suppressed.

As mentioned above, since the slave high voltage electrode 11B is provided and the regions having a different potential gradient (the regions α, β of FIG. 51) are provided, the collection efficiency of the ultrafine particles is improved. Therefore, it is allowed that the master high voltage electrode 11A is provided with a needle-shaped portion, instead of the toothed shape portion, and the master high voltage electrode 11A is provided with other shapes, e.g., a wire shape and a brush shape. Likewise, it is allowed that the slave high voltage electrode 11B is provided with the toothed shape portion or the needle-shaped portion, instead of the wire 114.

The number of the region having a different potential gradient is not limited to two, as illustrated in FIG. 51. For example, another sub high voltage electrode may be formed between the master high voltage electrode 11A and the slave high voltage electrode 11B, and three or more regions having a different potential gradient may be provided.

The ozone concentration is limited because the resistance of the discharge space (space resistance) is high and the electric field concentration on the counter electrode 12 (the counter electrode 12A) is relieved. Therefore, it is allowed that the counter electrode 12 (the sub counter electrode 12A) is provided such that the insulator is formed on the surface of the conductor, instead of that the counter electrode 12 (the sub counter electrode 12A) is provided such that the insulator and the resistor are formed in order on the surface of the conductor.

A modified example of the electrostatic precipitator 1 to which the eighth embodiment is applied will be described.

Figure 52:
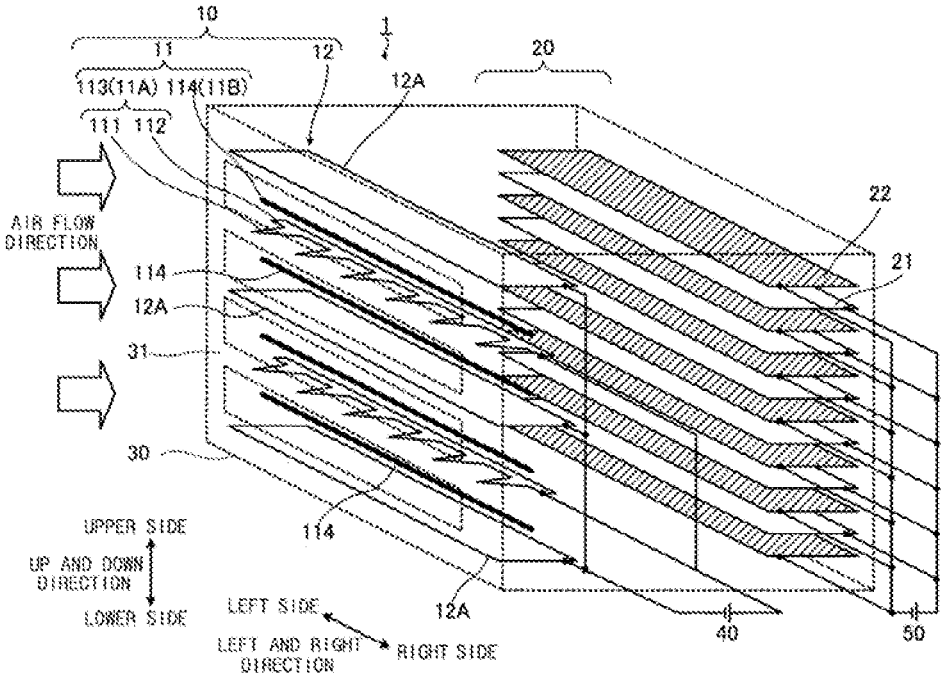
FIG. 52 is a view illustrating a modified example of the electrostatic precipitator to which the eighth embodiment is applied.

FIG. 52 is a view illustrating a modified example of the electrostatic precipitator 1 to which the eighth embodiment is applied.

As for the electrostatic precipitator 1, as illustrated in FIG. 48, the leading end of the tooth 111 of the master high voltage electrode 11A of the charger 10 is directed to the downstream side of the air flow direction. In the modified example as illustrated in FIG. 52, the leading end of the tooth 111 of the master high voltage electrode 11A of the charger 10 is directed to the upstream side of the air flow direction In this case, it is possible to have the same result as the example 20 of FIG. 50.

As for the electrostatic precipitator 1 according to the eighth embodiment, the voltage is not applied to the slave high voltage electrode 11B and thus the slave high voltage electrode 11B is in the floating state, as illustrated in example 20.

It is allowed that the voltage is applied to the slave high voltage electrode 11B. In this case, a half or less of the voltage applied to the master high-voltage electrode 11A is allowed to limit the ozone concentration. That is, the voltage applied to the master high voltage electrode 11A may be twice larger than the voltage applied to the slave high voltage electrode 11B. Meanwhile, it is appropriate that the voltage applied to the master high voltage electrode 11A is more than two times and less than five times of the voltage applied to the slave high voltage electrode 11B.

When the voltage is applied to the slave high voltage electrode 11B, the discharge is more stably performed in comparison with the floating state.

A Ninth Embodiment

Figure 53:
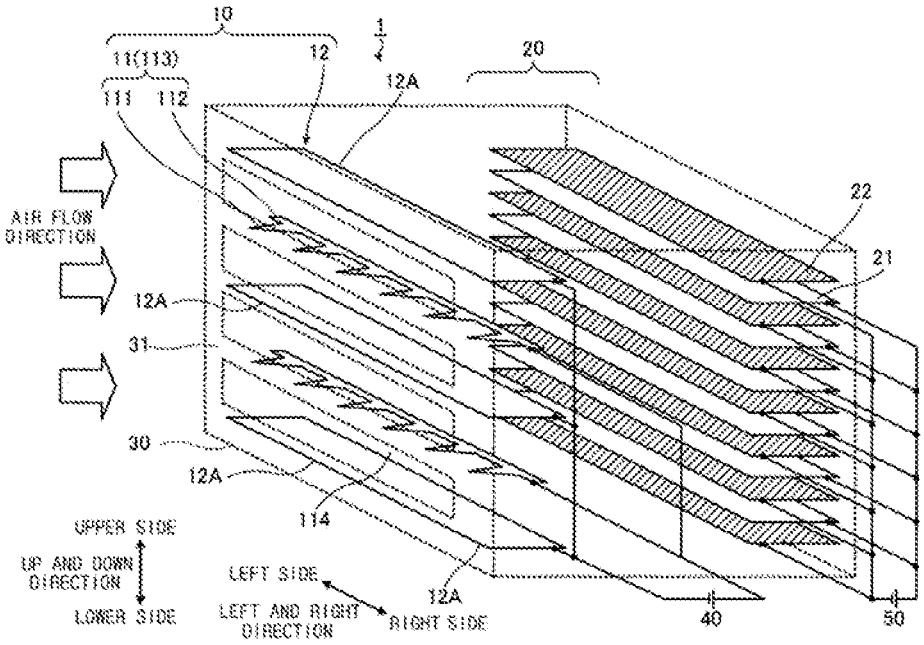
FIG. 53 is a view illustrating a modified example of the electrostatic precipitator to which the ninth embodiment.

FIG. 53 is a view illustrating an example of the electrostatic precipitator 1 according to the ninth embodiment.

As mentioned above, the high voltage electrode 11 of the charger 10 is provided with the plurality of the teeth 111 (toothed shape portion). Each the tooth 111 is connected to the connecting portion 112 to form the plurality of the tooth rows 113. Since the high voltage electrode 11 is formed with the tooth row 113, the high voltage electrode 11 is written as "11(113) in FIG. 53.

The counter electrode 12 is provided with a plurality of sub counter electrodes 12A as the eighth embodiment. The sub counter electrode 12A has a plate-shape, and is formed of conductive material.

The tooth 111 (toothed shape portion) of the high voltage electrode 11 is provided in parallel with the plate surface of the sub counter electrode 12A. The tooth 111 (toothed shape portion) of the high voltage electrode 11 and the sub counter electrode 12A are disposed at right angle with ("perpendicular to" in FIG. 53) the air flow direction.

A leading end of the tooth 111 is disposed to be directed to the upstream side of the air flow direction. The leading end of the tooth 111 is disposed in the downstream side than the upstream end of the air flow direction of the sub counter electrode 12A having the plate shape. The sub counter electrode 12A is formed over a length (distance) from the leading end of the tooth 111 (toothed shape portion) to the connecting portion 112.

The dust collector 20 is the same as the dust collector 20 in the electrostatic precipitator 1 to which the first embodiment to the eighth embodiment is applied. Therefore, a description of the dust collector 20 will be omitted.

The high voltage electrode 21 of the dust collector 20 is formed to have a predetermined distance in the downstream of the air flow direction, from an end portion of a member which is the closest to the dust collector 20, among members forming the charger 10. The predetermined distance is equal to or more than 5 mm.

The arrangement of the electrostatic precipitator 1 is not limited to the arrangement as illustrated in FIG. 53, and thus the electrostatic precipitator 1 may be disposed in any direction as long as securing the air flow.

It is allowed that the charger 10 includes the inductor (Ls) as illustrated in the fourth or fifth embodiment, and the current limit circuit 16 is provided, wherein the current limit circuit 16 is configured to reduce the potential of the high voltage electrode 11 by the pulse shaped current in the discharge occurring between the high voltage electrode 11 and the counter electrode 12.

Accordingly, the ozone generation is more suppressed.

In FIG. 53, the charger 10 of the electrostatic precipitator 1 is provided with two tooth rows 113 of the high voltage electrode 11 and three sub counter electrodes 12A of the counter electrode 12, but the number of the tooth row 113 and the sub counter electrode 12A is not limited thereto.

It is allowed that the tooth 111 is the needle-shaped portion and the brush shaped portion.

Figure 54:
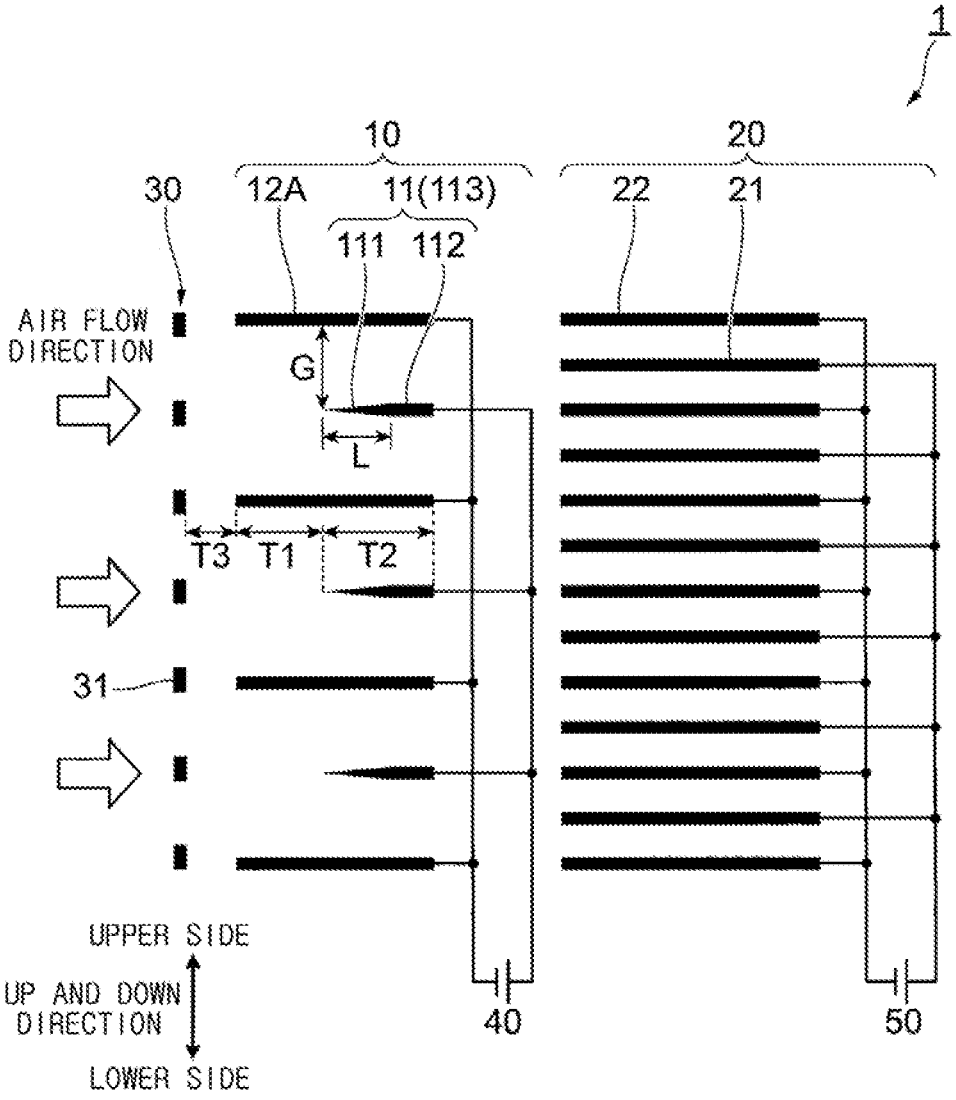
FIG. 54 is a cross-sectional view illustrating an air flow direction of main parts of the charger and the dust collector of the electrostatic precipitator according an example 21.

FIG. 54 is a cross-sectional view illustrating an air flow direction of main parts of the charger 10 and the dust collector 20 of the electrostatic precipitator 1 according an example 21.

As for the electrostatic precipitator 1 according to the example 21, the charger 10 is provided with the high voltage electrode 11 and the counter electrode 22 having the plurality of the sub counter electrode 12A formed of a conductive material and having a plate shape. The high voltage electrode 11 is provided with the tooth row 113 having the plurality of teeth 111 in which the leading end thereof is directed to the upstream side of the air flow direction.

The tooth row 113 of the high voltage electrode 11 is formed of stainless steel, and the sub counter electrode 12A is formed of aluminum. A distance G between the high voltage electrode 11 and the sub counter electrode 12A is 15 mm. In the high voltage electrode 11, a length L from the leading end of the tooth 111 to the connecting portion 112 is 3 mm. The leading end of the tooth 111 is disposed in a position where 2 mm ("T1" in FIG. 54) is apart from an end of the sub counter electrode 12A in the upstream side of the air flow direction. A distance from the leading end of the tooth 111 to an end of the sub counter electrode 12A in the downstream side of the air flow direction is 5 mm ("T2" in FIG. 54).

The case 30 provided with a plurality of grids (grill) 31 formed of resin is formed in a position where 3 mm ("T3" in FIG. 54) is apart from the end of the sub counter electrode 12A in the upstream side of the air flow direction. The grid (grill) 31 is disposed in the up and down direction, as illustrated in FIG. 54, to face the tooth 111 of the high voltage electrode 11 and the sub counter electrode 12A, so that it is prevented that a user contacts the charger 10.

The dust collector 20 has a structure in which the high voltage electrode 21 formed of a non-conductive material and the counter electrode 22 formed of a conduction material are alternately stacked.

Figure 55A:
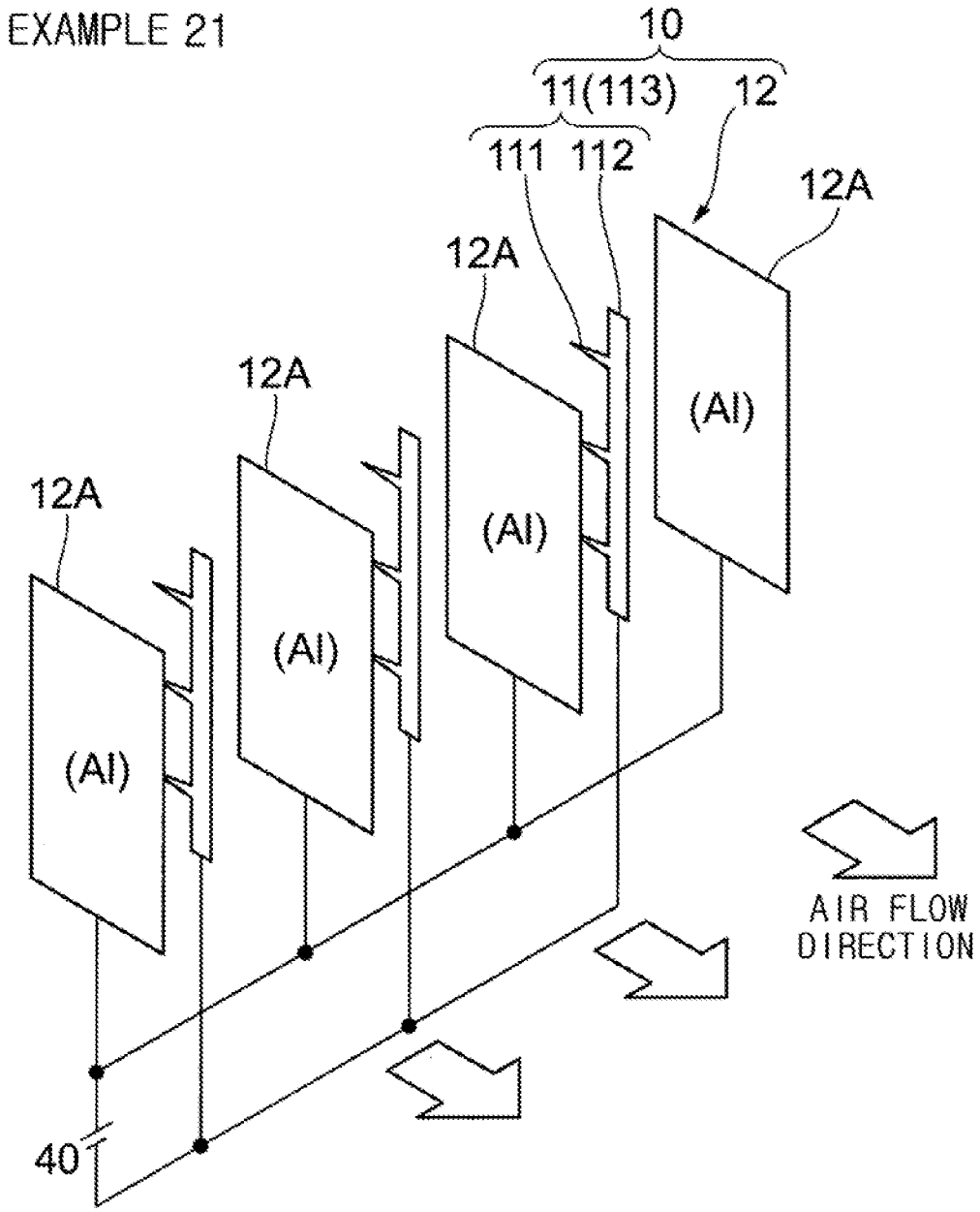
FIGS. 55A and 55B are perspective views illustrating main parts of the charger of the electrostatic precipitator according the example 21 and a comparative example 7, particularly.
Figure 55B:
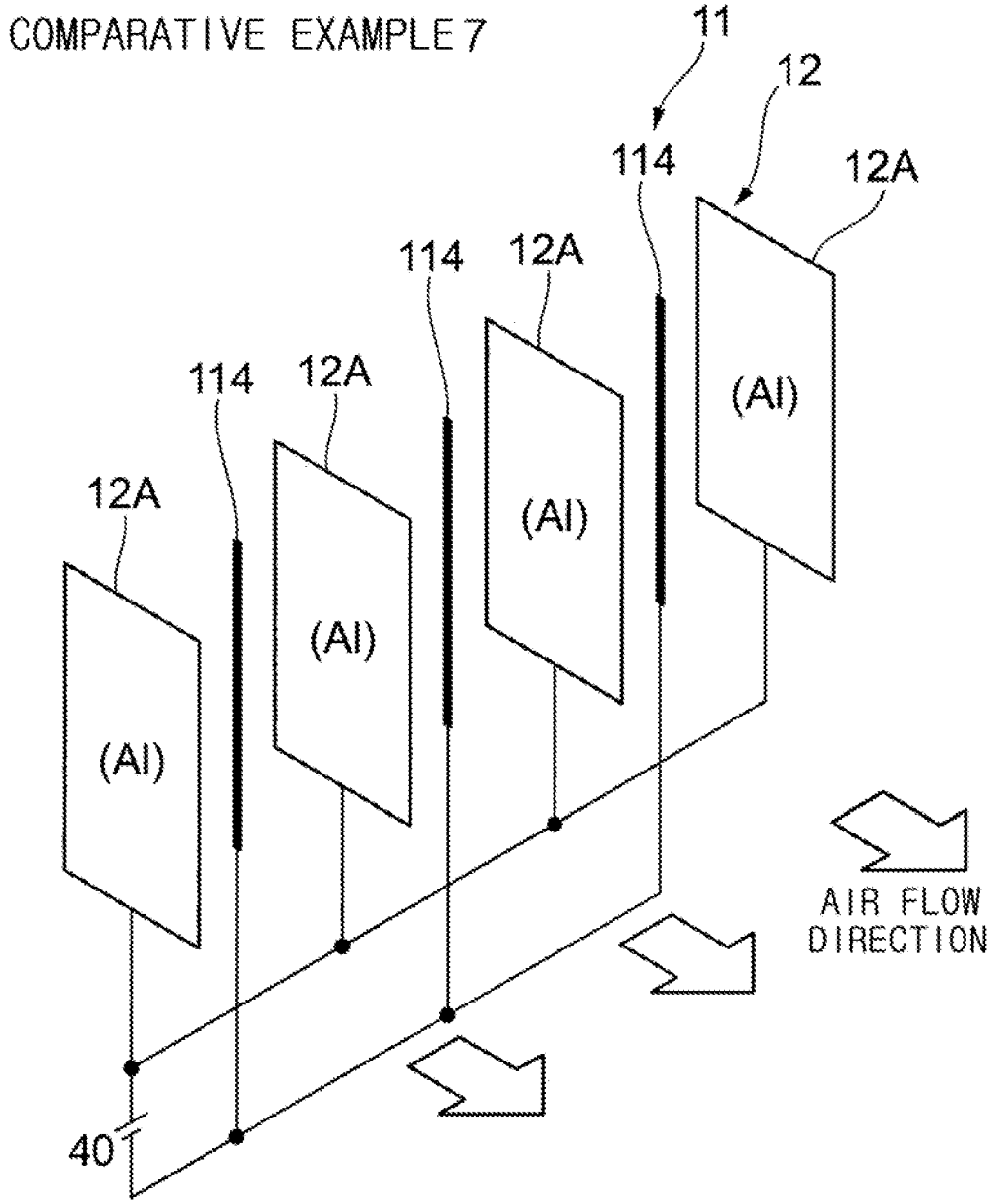

FIGS. 55A and 55B are perspective views illustrating main parts of the charger 10 of the electrostatic precipitator 1 according the example 21 and the comparative example 7. FIG. 55A illustrates the example 21 and FIG. 55B illustrates a comparative example 7. The comparative example 7 is the same as the electrostatic precipitator 1 according to the comparative example 7 as illustrated in the eighth embodiment (refer to FIG. 49C). That is, as for the electrostatic precipitator 1 according to the comparative example 7 as illustrated in FIG. 55B, the wire 114 formed by tungsten (W) having a diameter of 0.2 mm is used as the high voltage electrode 11 corresponding to the tooth row 113 (the high voltage electrode 11) of the electrostatic precipitator 1 according to the example 21 of FIG. 55A.

As for the electrostatic precipitator 1 according to the example 21 and the comparative example 7, the sub counter electrode 12A corresponds to A1. Therefore in FIGS. 55A and 55B, "A1" is written on the sub counter electrode 12A.

In FIG. 55A, the arrangement of the tooth row 113 of the high voltage electrode 11 and the sub counter electrode 12A of the counter electrode 12 is illustrated to be rotated by 90 degrees with respect to FIGS. 53 and 54. In FIG. 55B, the arrangement of the wire 114 and the sub counter electrode 12A is illustrated to be rotated by 90 degrees with respect to FIG. 49.

FIG. 56 is a table illustrating ozone concentration and collection efficiency by the particle diameter in the electrostatic precipitator 1 according to the example 21 and the comparative example 7.

In this case, the electrostatic precipitator 1 is installed in a wind tunnel test, a wind speed is set to 1 m/s by a fan, and wind is passed through from the charger 10 to the dust collector 20 by one time (one pass).

The collection efficiency is estimated such that a sampling port is installed in the upstream side and the downstream side of the wind tunnel test and Scanning Mobility Particle Sizer (SMPS) measures and estimates the number of the suspended particles by the particle diameter, via the sampling port.

The ozone concentration is obtained from a difference between the upstream side and the downstream side through the sampling port formed in the upstream side and the downstream side of the wind tunnel test using an ozone meter.

The comparative 7 in FIG. 56 corresponds to a case in which a current of the high voltage electrode 11 (master high voltage electrode) according to the comparative 7 in FIG. 50 is 440 μA and 5000 μA.

As illustrated in FIG. 56, as for the electrostatic precipitator 1 according to the example 21, the ozone concentration is suppressed as 3.0 ppb and the collection efficiency is improved to be equal to or more than 90% regardless of the particle diameter, in comparison with the comparative example 7.

A factor to improve the collection efficiency is that the leading end of the high voltage electrode 11 is directed to the upstream side of the air flow direction and the position of the leading end of the tooth 111 and the sub counter electrode 12A is optimized, and thus ions generated in the leading end of the tooth 111 is easily diffused between the high voltage electrode 11 (the tooth row 113) and the sub counter electrode 12A, so that the charge efficiency is improved and the charge efficiency of the ultrafine particle having a diameter of 0.1 μm or less is improved.

A factor to suppress the ozone concentration is in that the electric field concentration is increased since the tooth 111 is used as the high voltage electrode 11, and since the distance between the tooth 111 and the sub counter electrode 12A is large, the space resistance is increased when the discharge, and as for the discharge condition to generate a high density ion, the amount of the electron, which is a start point of the ozone generation, is suppressed.

According to the comparative example 7, when the current (discharge current) is great (e.g., 5000 μA), the collection efficiency may be high regardless of the particle diameter. However, the ozone concentration is at least 60 times greater than that according to the example 21. That is, as for the electrostatic precipitator 1 according to the comparative example 7 in which the wire 114 is used as the high voltage electrode 11, when the ion density (the current) is increased to charge particles having a small diameter, the ozone concentration is increased.

In contrast, as for the electrostatic precipitator 1 according to the ninth embodiment, (the electrostatic precipitator 1 according to the example 21), in a state in which the ion density is high, it is possible to form the discharge to suppress the ozone concentration (to prevent oxygen molecules from being disassociated and excited)

As for the electrostatic precipitator 1 according to the ninth embodiment, it is not needed that the counter electrode 12 (the sub counter electrode 12A) is coated with the insulator, and thus it is possible to reduce the cost and to improve the productivity.

The numbers as illustrated in the first embodiment to the ninth embodiment are merely exemplary and thus the number is not limited thereto.

Although a few embodiments of the present disclosure have been shown and described, it would be appreciated by those skilled in the art that changes may be made in these embodiments without departing from the principles and spirit of the disclosure, the scope of which is defined in the claims and their equivalents.

The invention claimed is:

1. An electrostatic precipitator comprising:

a first high voltage generator configured to generate a first high voltage and a reference voltage;

a second high voltage generator configured to generate a second high voltage;

a charger including:

a first high voltage electrode configured to receive the first high voltage, and a counter electrode configured to receive the reference voltage, wherein the charger is configured to charge suspended particles by generating a discharge between the first high voltage electrode and the counter electrode; and a dust collector disposed in a downstream side of an air flow direction of the charger including:

a second high voltage electrode, and a ground electrode, wherein the second high voltage is applied between the second high voltage electrode and the ground electrode, so that the dust collector collects the suspended particles onto a surface of the ground electrode, wherein the counter electrode comprises a conductor formed of a conductive material, and a resistor covering at least one surface of the conductor, the resistor configured to suppress a discharge current between the first high voltage electrode and the counter electrode.

2. The electrostatic precipitator of claim 1, wherein having a volume resistivity of $10^{14}$ Ω·cm or more and $10^{18}$ Ω·cm or less.

3. The electrostatic precipitator of claim 1, wherein the first high voltage electrode has a wire shape or a brush shape.

4. The electrostatic precipitator of claim 1, wherein the first high voltage electrode is provided with a tooth shaped portion having a pointed leading end or a needle shaped portion having a pointed leading end.

5. The electrostatic precipitator of claim 4, wherein a plurality of tooth shaped portions or a plurality of needle shaped portions are arranged in a plurality of rows across the air flow direction wherein in each of the plurality of rows a leading end of each of the plurality of tooth shaped portions are parallel to each other or a leading end of each of the plurality of needle shaped portions are parallel to each other.

6. The electrostatic precipitator of claim 1, wherein the first high voltage electrode comprises a master high voltage electrode and a slave high voltage electrode.

7. The electrostatic precipitator of claim 6, wherein the master high voltage electrode is provided with a tooth shaped portion or a needle shaped portion and the slave high voltage electrode is provided as a wire shape.

8. The electrostatic precipitator of claim 2, wherein the conductor of the counter electrode comprises a plurality of flat plates disposed at an interval to guide the air flow direction, and one of a mesh having an opening, a punching metal having an opening, or an expanded metal having an opening.

9. The electrostatic precipitator of claim 1, wherein the counter electrode is disposed in an upstream side of the air flow direction with respect to the first high voltage electrode.

10. The electrostatic precipitator of claim 1, further comprising:

a case formed of resin and configured to accommodate the charger, wherein the case accommodating the charger is in electric contact with the conductor of the counter electrode.

11. The electrostatic precipitator of claim 1, wherein the counter electrode further comprises:

a conductor formed of a conductive material, a first member covering a portion of the conductor on a side of the first high voltage electrode, and a second member covering a portion of the first member on the side of the first high voltage electrode, wherein the counter electrode has a connection area in which the second member is electrically connected to the conductor.

12. The electrostatic precipitator of claim 1, wherein the counter electrode comprises a substrate, a first member formed in a surface of the substrate directed toward the first high voltage electrode and a second member having conductivity formed in the substrate.

13. The electrostatic precipitator of claim 1, wherein the counter electrode further comprises a substrate, a first member formed in a first surface of the substrate directed toward the first high voltage electrode and a second member having conductivity formed in a second surface of the substrate directed toward the dust collector.

14. The electrostatic precipitator of claim 1, wherein the first high voltage electrode comprises a plurality of tooth shaped portions or a plurality of needle shaped portions that are arranged perpendicular to the air flow direction, and the counter electrode further comprises a sub counter electrode formed of a conductive material that is plate shaped and is arranged perpendicular to the air flow direction, and the plurality of tooth shaped portions or the plurality of needle shaped portions are arranged in parallel with a surface of the sub counter electrode.

15. The electrostatic precipitator of claim 14, wherein a leading end of the plurality of tooth shaped portions of the high voltage electrode or a leading end of the plurality of needle shaped portions of the first high voltage electrode is directed to a upstream side of the air flow direction.

16. The electrostatic precipitator of claim 14, wherein the sub counter electrode is disposed in the downstream side of the air flow direction from a leading end of the plurality of tooth shaped portions of the high voltage electrode or a leading end of the plurality of needle shaped portions of the high voltage electrode, and the sub counter electrode is disposed along at least a length of the tooth shaped portion or the needle shaped portion.

17. The electrostatic precipitator of claim 1, wherein the counter electrode further comprises an insulator disposed between the conductor and the resistor.

18. An electrostatic precipitator comprising:

a charger including a high voltage electrode configured to receive a high voltage from a high voltage generator circuit and a counter electrode and configured to receive a reference voltage from the high voltage generator circuit, wherein the charger is configured to charge suspended particles by generating a discharge between the high voltage electrode and the counter electrode; and a dust collector disposed in a downstream side of an air flow direction of the charger and configured to collect the suspended particles charged by the charger, wherein the counter electrode includes a conductor formed of a conductive material, and a resistor covering at least one surface of the conductor, the resistor configured to suppress a discharge current between the first high voltage electrode and the counter electrode and having a volume resistivity of $10^{14}$ Ω·cm or more and $10^{18}$ Ω·cm or less.

19. An electrostatic precipitator comprising:

a charger including a high voltage electrode configured to receive a high voltage from a high voltage generator and a counter electrode configured to receive a reference voltage from the high voltage generator, configured to charge suspended particles by generating a discharge between the high voltage electrode and the counter electrode; and a dust collector disposed in a downstream side of an air flow direction of the charger and configured to collect the suspended particles charged by the charger, wherein the high voltage electrode comprises a master high voltage electrode and a slave high voltage electrode.

* * * * *